US009972946B2

(12) United States Patent
Ju et al.

(10) Patent No.: US 9,972,946 B2
(45) Date of Patent: May 15, 2018

(54) ELECTRICAL CONNECTOR AND ELECTRICAL CONNECTOR ASSEMBLY

(71) Applicant: LOTES CO., LTD, Keelung (TW)

(72) Inventors: Ted Ju, Keelung (TW); Wu Feng, Keelung (TW); Ya Jun Zeng, Keelung (TW); Nan Fang He, Keelung (TW); Jun Fan, Keelung (TW); Jin Ke Hu, Keelung (TW); Guo Sheng Zhou, Keelung (TW); Chin Chi Lin, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days. days.

(21) Appl. No.: 15/678,517

(22) Filed: Aug. 16, 2017

(65) Prior Publication Data

US 2017/0346238 A1 Nov. 30, 2017

Related U.S. Application Data

(63) Continuation of application No. 14/626,709, filed on Feb. 19, 2015, now Pat. No. 9,917,405.

(Continued)

(51) Int. Cl.
*H01R 13/73* (2006.01)
*H01R 13/6585* (2011.01)

(Continued)

(52) U.S. Cl.
CPC ..... *H01R 13/6585* (2013.01); *H01R 13/6581* (2013.01); *H01R 13/6583* (2013.01);

(Continued)

(58) Field of Classification Search
CPC ..... H01R 13/6594

(Continued)

(56) References Cited

U.S. PATENT DOCUMENTS 4,983,127 A * 1/1991 Kawai ..... H01R 13/658 439/79
5,507,653 A * 4/1996 Stoner ..... H01R 12/716 439/374

(Continued)

FOREIGN PATENT DOCUMENTS

CN 203423303 U 2/2014
TW M440566 U 11/2012

*Primary Examiner* — Neil Abrams
(74) *Attorney, Agent, or Firm* — Locke Lord LLP; Tim Tingkang Xia, Esq.

(57) ABSTRACT

An electrical connector includes an insulation body having a base portion and a tongue located at a front end of the base portion. Multiple terminals are fixed on the base portion and partially exposed from a surface of the tongue. An outer metal casing surrounds the base portion and the tongue and forms an insertion space receiving the tongue. The outer metal casing has a bottom wall and two side walls. Each side wall extends downward to form a stop wall. Each stop wall extends downward to form two soldering pins. The four soldering pins are arranged in two rows. A cushion block is located below the bottom wall and fixed on the two stop walls. Four protruding blocks are formed by protruding downward from a bottom surface of the cushion block. At least two of the protruding blocks are located disposed between the soldering pins in the two rows.

20 Claims, 54 Drawing Sheets

Related U.S. Application Data

(60) Provisional application No. 62/024,728, filed on Jul. 15, 2014, provisional application No. 61/942,830, filed on Feb. 21, 2014.

(51) Int. Cl.

| | |
|---|---|
| ***H01R 13/6583*** | (2011.01) |
| ***H01R 13/6591*** | (2011.01) |
| ***H01R 24/60*** | (2011.01) |
| ***H01R 13/6594*** | (2011.01) |
| ***H01R 13/6581*** | (2011.01) |
| *H01R 12/72* | (2011.01) |
| *H01R 107/00* | (2006.01) |

(52) U.S. Cl.
CPC ..... *H01R 13/6591* (2013.01); *H01R 13/6594* (2013.01); *H01R 24/60* (2013.01); *H01R 12/724* (2013.01); *H01R 2107/00* (2013.01)

(58) Field of Classification Search
USPC ..... 439/607.27, 607, 24, 607.4
See application file for complete search history.

(56) References Cited

U.S. PATENT DOCUMENTS

| | | | | |
|---|---|---|---|---|
| 6,022,227 | A * | 2/2000 | Huang | H01R 13/512 439/79 |
| 6,257,934 | B1 * | 7/2001 | Gong | H01R 13/7031 439/358 |
| 6,354,875 | B1 * | 3/2002 | Wu | H01R 13/658 439/607.13 |
| 6,793,507 | B2 * | 9/2004 | Sandoval | H01R 12/7047 439/79 |
| 7,473,127 | B2 * | 1/2009 | Wang | H01R 24/58 439/541.5 |
| 8,376,783 | B2 * | 2/2013 | Kondo | H01R 12/712 439/660 |
| 8,961,230 | B2 * | 2/2015 | Chou | H01R 9/032 439/607.27 |
| 9,306,335 | B2 * | 4/2016 | Fan | H01R 13/6471 |
| 9,577,387 | B2 * | 2/2017 | Hu | H01R 13/6597 |
| 9,627,817 | B2 * | 4/2017 | Chang | H01R 13/6594 |
| 9,806,467 | B2 * | 10/2017 | Long | H01R 13/659 |
| 9,917,405 | B2 * | 3/2018 | Ju | H01R 13/6585 |
| 2016/0352052 | A1 * | 12/2016 | Yu | H01R 13/6585 |

* cited by examiner

200

100

ELECTRICAL CONNECTOR AND ELECTRICAL CONNECTOR ASSEMBLY

CROSS-REFERENCE TO RELATED APPLICATION

This application is a continuation application of U.S. application Ser. No. 14/626,709, filed Feb. 19, 2015, which itself claims priority to and the benefit of, pursuant to 35 U.S.C. § 119(e), U.S. provisional patent application Ser. No. 61/942,830, filed Feb. 21, 2014, and U.S. provisional patent application Ser. No. 62/024,728, filed Jul. 15, 2014. The entire contents of the above identified applications are incorporated herein by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector and an electrical connector assembly, and more particularly to an electrical connector with high-frequency performance and an electrical connector assembly.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With fast development of electronic elements, design specifications of the universal serial bus (USB) organization are also always being updated and upgraded. From USB 2.0 at beginning to USB 3.0 and USB 3.1 at present, or even the USB TYPE C specification, the transmission speed is higher and higher. To satisfy higher high-frequency requirements, a large quantity of efforts and capitals has been required in cooperatively developing those types of products, so that mass production can be implemented, and efficiency can be improved.

Therefore, it is necessary to design an improved electrical connector and an electrical connector assembly, so as to overcome the foregoing problem.

SUMMARY OF THE INVENTION

In view of the above problems in the related art, the present invention is directed to an electrical connector in firm snap-fit to ensure stable high-frequency performance and an electrical connector assembly thereof.

To achieve the foregoing objective, the present invention uses the following technical means:

An electrical connector is used for mating with a mating connector. The mating connector has at least two metal elastic sheets. The electrical connector includes: an insulation body, where the insulation body has a base portion and a tongue located at a front end of the base portion; multiple terminals fixedly disposed in the base portion in a manner of an upper row and a lower row, where each of the terminals has a contact portion exposed from either an upper surface or a lower surface of the tongue, and the mating connector and the contact portion are contacted; a middle shielding sheet, fixedly disposed at the base portion and the tongue, where the middle shielding sheet is located between the upper row of terminals and the lower row of terminals; at least two snap-fit portions disposed at two sides of the middle shielding sheet and exposed from two sides of the tongue, where two of the metal elastic sheets buckle the snap-fit portions to stop the metal elastic sheet from being disengaged; and an outer metal casing, where the outer metal casing surrounds peripheries of the base portion and the tongue.

In one embodiment, the electrical connector further has an inner metal casing. The inner metal casing has at least one covering portion disposed on an upper surface of the tongue, and at least one extending portion extending from the covering portion toward the base portion. The extending portion has at least one contact arm, and the contact arm urges an inner wall of the outer metal casing. The extending portion is provided with two positioning portions, the base portion is provided with two positioning slots corresponding to the two positioning portions, and the two positioning slots accommodate and fix the two positioning portions.

In one embodiment, the upper row of multiple terminals are separately two grounding terminals, two power supply terminals and two signal terminals, the lower row of multiple terminals are separately two grounding terminals, two power supply terminals and two signal terminals, and the upper row of multiple terminals and the lower row of multiple terminals are disposed symmetrically on the upper surface and the lower surface of the tongue.

In one embodiment, the middle shielding sheet has a plate portion fixedly disposed in the tongue. Two protruding portions extend separately from two sides of the plate portion out of the two sides of the tongue, two of the snap-fit portions are grooves disposed at the two protruding portions, and the two grooves are located out of the two sides of the tongue.

In one embodiment, the outer metal casing has an interior casing and a shielding casing. The interior casing surrounds the peripheries of the base portion and the tongue. The shielding casing is disposed out of the interior casing. Each of two sides of the interior casing has a first soldering pin. Each of two sides of the shielding casing has a second soldering pin. The first soldering pin and the second soldering pin are staggered front and back. The first soldering pin is close to a lateral side of the base portion, and the second soldering pin is close to a lateral side of the tongue.

In one embodiment, the interior casing has a first rear wall, and the shielding casing has a second rear wall. The first rear wall has a first middle portion and first sheltering portions located at two sides of the first middle portion. The second rear wall has a second middle portion and a second sheltering portion connected to a lower part of the second middle portion. The first middle portion and the second middle portion are approximately superposed front and back, the second rear wall forms a notch at a place corresponding to the first sheltering portion, and the second sheltering portion exceeds the first middle portion downward.

Another technology means is as follows:

An electrical connector assembly includes an electrical connector and a mating connector. The electrical connector includes: an insulation body, where the insulation body has a base portion and a tongue located at a front end of the base portion, multiple terminals are fixedly disposed in the base portion in a manner of an upper row and a lower row, and each of the terminals has a contact portion exposed from either of an upper surface and a lower surface of the tongue; a middle shielding sheet, fixedly disposed at the base portion and the tongue, where the middle shielding sheet is located between the upper row of terminals and the lower row of terminals; at least two snap-fit portions disposed at two sides of the middle shielding sheet and exposed from two sides of the tongue; and an outer metal casing, where the outer metal casing surrounds peripheries of the base portion and the tongue, and two of the metal elastic sheets buckle the snap-fit portions to stop the metal elastic sheet from being disengaged. The mating connector has two metal elastic sheets corresponding to two of the snap-fit portions. When the mating connector and the electrical connector are mated, the two metal elastic sheets are respectively cooperatively fixed to two of the snap-fit portions, and the mating connector and the contact portion are contacted.

In one embodiment, the mating connector has an insertion portion, the insertion portion has a mating space, each of two sides of the insertion portion has a hollowing portion in communication with the mating space, the two metal elastic sheets are at least partially located at the two sides of the insertion portion, and pass through the hollowing portion to enter the mating space, and the tongue and the snap-fit portions are located in the mating space.

In one embodiment, the mating connector has a metal cover. The metal cover is formed by means of one-piece drawing or stretching. The metal cover has a front segment and a rear segment connected to each other. The front segment has a top surface and a bottom surface provided opposite to each other, and two side surfaces connected to the top surface and the bottom surface. A place at where the top surface or the bottom surface is connected to the rear segment is provided with a step. The two side surfaces and the rear segment are in a form of direct extension.

Preferably, another aspect of the present invention relates to an electrical connector, which includes: an insulation body, having a base portion and a tongue located at a front end of the base portion; a plurality of terminals, fixedly disposed on the base portion and partially exposed from the surface of the tongue; an outer metal casing, surrounding the base portion and the tongue and forming an insertion space receiving the tongue, wherein the outer metal casing has a bottom wall located below the insertion space and two side walls located at two opposite sides of the bottom wall, the two side walls respectively extend downward to form two stop walls located below the bottom wall, and the two stop walls extends downward to form four soldering pins, wherein two of the four soldering pins are formed on each of the two stop walls, and the four soldering pins are arranged in two rows in a front-rear direction; and a cushion block, located below the bottom wall and fixedly disposed on the two stop walls, wherein four protruding blocks are formed by protruding downward from a bottom surface of the cushion block, and at least two of the four protruding blocks are located between the soldering pins in the two rows.

In one embodiment, the four protruding blocks are arranged in two rows in the front-rear direction, and comprise two first protruding blocks located in a front row and two second protruding blocks located in a back row, and wherein the second protruding blocks are located between the soldering pins in the two rows.

In one embodiment, distances from the second protruding blocks to the soldering pins in one of the two rows and distances from the second protruding blocks to the soldering pins in the other of the two rows are not equal.

In one embodiment, areas of bottom surfaces of the two protruding blocks in a same row are equal, and the first protruding blocks are not connected with a side edge of the bottom surface of the cushion block.

In one embodiment, the two stop walls are respectively provided with two fastening portions for fastening the cushion block, and the two fastening portions are located in front of the soldering pins in a front row.

In one embodiment, the two fastening portions and the first protruding blocks are arranged in a same row in the front-rear direction.

In one embodiment, two opposite sides of the cushion block respectively protrude to form two buckling blocks, each of the two stop walls is provided with a buckling hole corresponding to and fastened to one of the two buckling blocks, and on a same stop wall, the fastening hole is located between upward extending lines of the two soldering pins.

In one embodiment, a front end surface of the cushion block is in front of a front end surface of the tongue.

In one embodiment, the base portion comprises a connecting portion formed by extending backward from the tongue and an elevated portion formed by extending backward from the connecting portion, a bottom surface of the elevated portion is lower than a bottom surface of the connecting portion, and the cushion block is located right below the connecting portion and the tongue and in front of the elevated portion.

In one embodiment, each of the terminals has a soldering portion extending out of the bottom surface of the elevated portion, and the soldering portions of the terminals are arranged in a row, wherein the soldering portion is soldered onto an upper surface of a circuit board, and is located behind the protruding blocks and behind the soldering pins in a back row.

In one embodiment, the bottom surface of the elevated portion protrudes downward to form two symmetric positioning posts, and the positioning posts are located in front of the soldering portion and behind the soldering pins in the back row.

In one embodiment, the outer metal casing has a rear wall located behind the elevated portion, a lower edge of the rear wall extends downward to form at least one supporting leg located on a circuit board, and the at least one supporting leg is located behind the soldering portions.

In one embodiment, the outer metal casing has an interior casing and a shielding casing, the interior casing surrounds peripheries of the tongue and the base portion to form the insertion space, the shielding casing wraps the interior casing and the cushion block, and the side walls are arranged at the shielding casing.

In one embodiment, the bottom wall is arranged on the interior casing, and a distance between the bottom wall and the cushion block is smaller than a distance between the bottom wall and the tongue.

In one embodiment, the cushion block upward abuts the bottom wall.

In one embodiment, two opposite sides of the interior casing respectively extend to form two extending sheets, bottom surfaces of the extending sheets are lower than the bottom wall, and the extending sheets are behind the four protruding blocks.

In one embodiment, the base portion comprises a connecting portion formed by extending backward from the tongue and an elevated portion formed by extending backward from the connecting portion, and the extending sheets are located between the stop walls and the elevated portion.

In one embodiment, the extending sheets and the soldering pins in a back row are arranged in a same row.

In one embodiment, a width of each of the extending sheets is greater than twice of a width of each of the soldering pins in the front-rear direction.

In one embodiment, a front end surface of the cushion block is located behind a front edge of the interior casing.

The present invention has the following beneficial effects.

When the mating connector is inserted into the electrical connector after the electrical connector is completely assembled, two of the snap-fit portions are disposed at two sides of the tongue and cooperatively fixed to the mating connector, thereby being in firm snap-fit to ensure stable high-frequency performance. Two of the four protruding blocks are located between the soldering pins in two rows, thus enabling the heat produced in soldering the soldering portions of the terminals with a circuit board to be dissipated from a gap between the two protruding blocks located between the soldering pins in the front row and the back row, thereby avoiding overheating of the soldering portions, and preventing the terminals from being unfirmly soldered with the circuit board. Further, the four protruding blocks are arranged in a distributing manner, so that when the protruding blocks are supported on the circuit board, a supporting force applied to the entire electrical connector is uniform, thereby enhancing the structural stability thereof.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
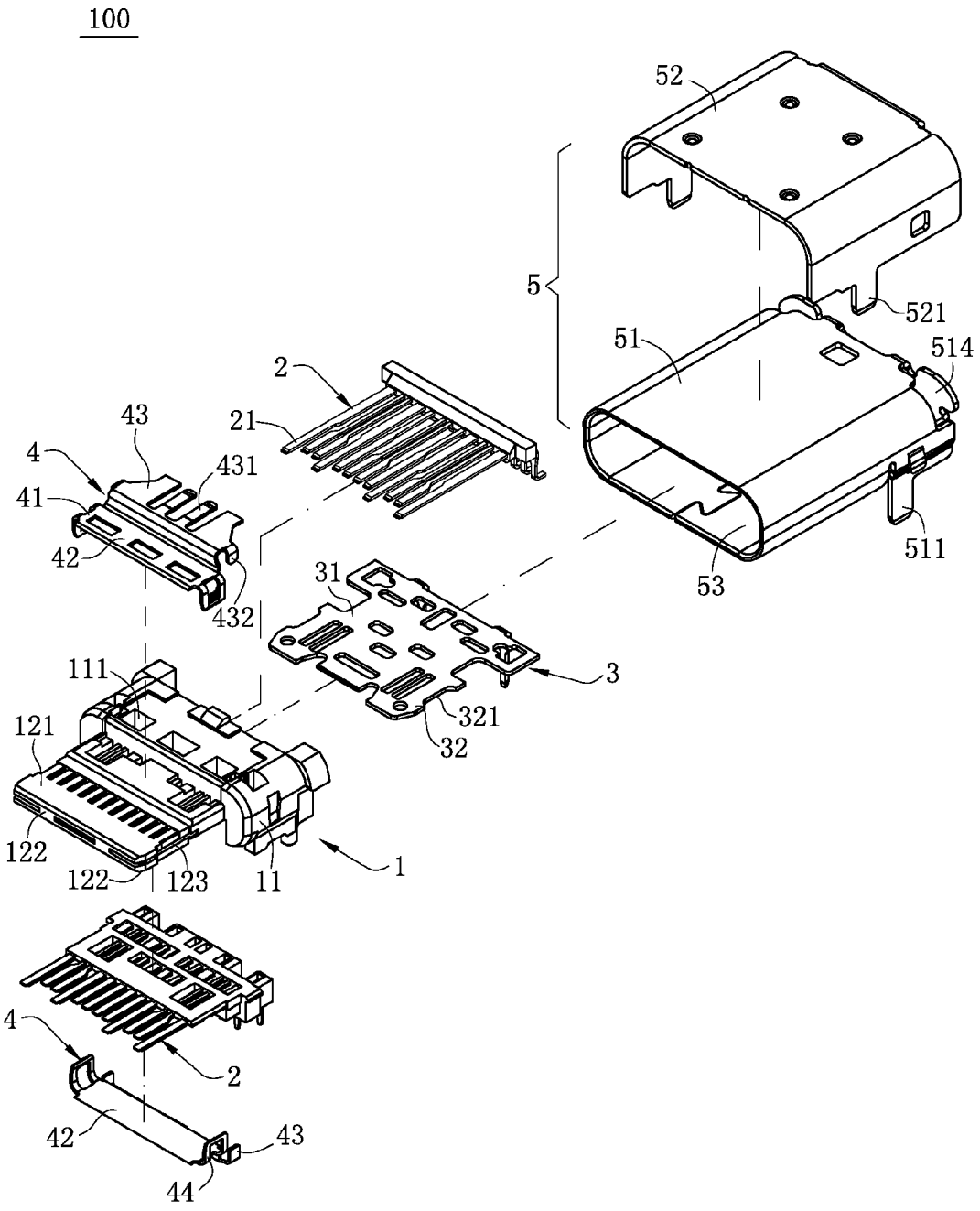
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" and/or "multiple" means two or more.

As used herein, the terms "comprising", "including", "carrying", "having", "containing", "involving", and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

Furthermore, relative terms, such as "lower" or "bottom" and "upper" or "top", may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

For convenience of better understanding objectives, structures, features and efficacies of the present invention, the present invention is further described with reference to accompanying drawings and specific implementation manners.

As shown in FIG. 1, FIG. 16, FIG. 7, and FIG. 12, an electrical connector 100 of the present invention is an electrical connector socket supporting high-speed data transmission, and a mating connector 200 is an electrical connection plug supporting high-speed data transmission.

Figure 16:
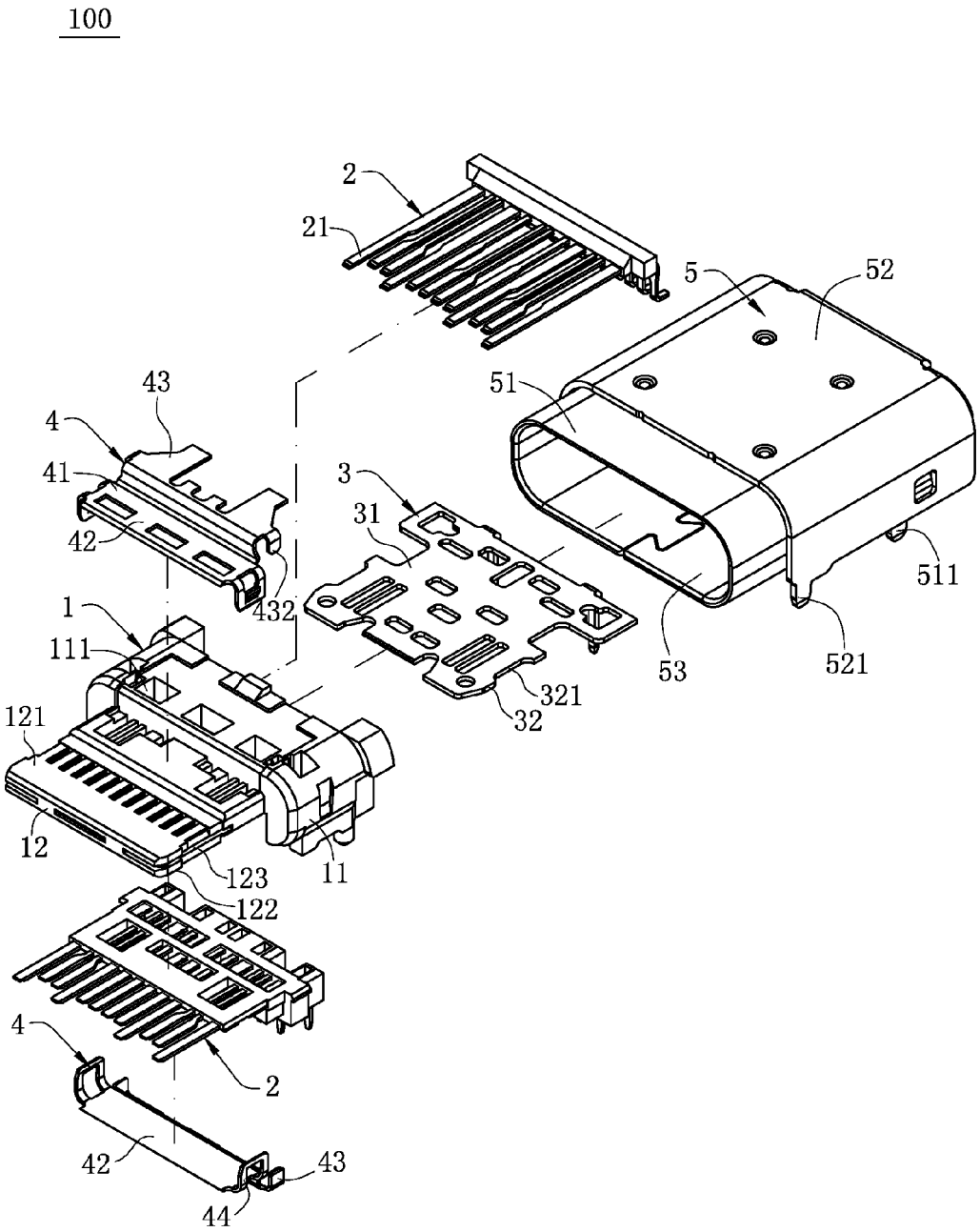
FIG. 16 is a three-dimensional exploded view of an electrical connector according to a third embodiment of the present invention.
Figure 17:
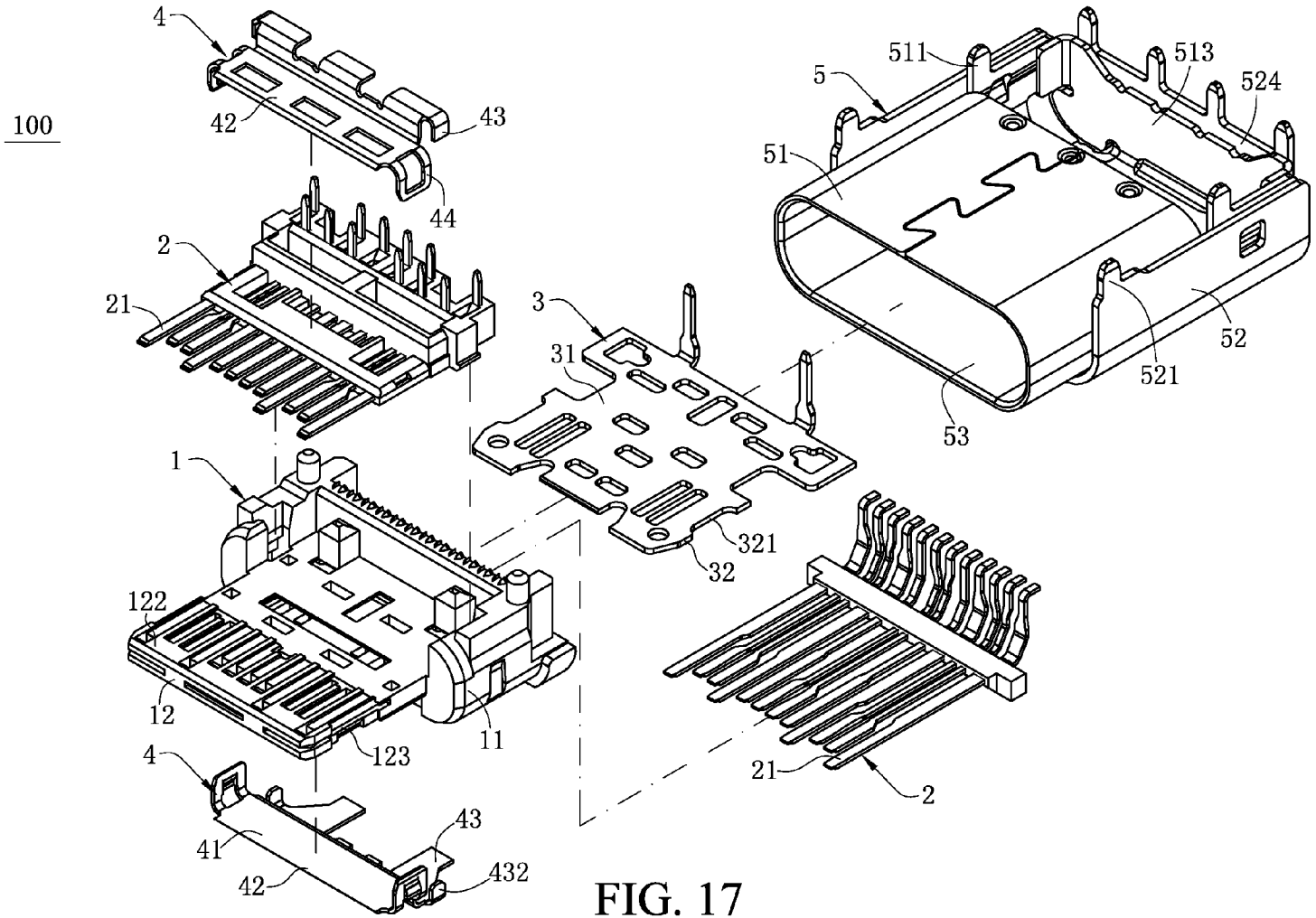
FIG. 17 is a three-dimensional exploded view of the electrical connector viewed from another viewing angle according to the third embodiment of the present invention.

As shown in FIG. 1 and FIG. 16, the electrical connector 100 includes an insulation body 1; multiple terminals 2 fixedly disposed at the insulation body 1; a middle shielding sheet 3 fixedly disposed at the insulation body 1; an inner metal casing 4, covering and fixed onto the insulation body 1; and an outer metal casing 5, framing the insulation body 1 and the inner metal casing 4 to form an insertion space 53.

As shown in FIG. 7 to FIG. 11, the mating connector 200 has a main body 6 and an insertion portion 7 formed by extending forward from the main body 6. The insertion portion 7 has Each of two sides of the insertion portion 7 has a hollowing portion 74 in communication with the mating space 73. Two metal elastic sheets 8 are fixed to two sides of the main body 6, and partially extend forward and are located at the two sides of the insertion portion 7. The two metal elastic sheets 8 pass through the hollowing portion 74 to enter the mating space 73, and are conveniently for stable snap-fitting with the electrical connector 100. An upper grounding sheet 81 and a lower grounding sheet 82 are respectively disposed at a top 71 and a bottom 72 of the insertion portion 7. The upper grounding sheet 81 and the lower grounding sheet 82 at least partially pass through the insertion portion 7 to enter the mating space 73, so as to be cooperatively fixed to the electrical connector 100, and a grounding objective may further be achieved. A middle grounding sheet 83 is located in the main body 6 and the insertion portion 7.

As shown in FIG. 12 to FIG. 15, the mating connector 200 further has a metal cover 9 surrounding the main body 6 and the insertion portion 7. The metal cover 9 is formed by means of one-piece drawing or stretching. The metal cover 9 has a front segment 91 and a rear segment 92 connected to each other. The front segment 91 has a top surface 911 and a bottom surface 912 disposed opposite to each other, and two side surfaces 913 connected to the top surface 911 and the bottom surface 912. A place at which the top surface 911 or the bottom surface 912 is connected to the rear segment 92 is provided with a step 93. The two side surfaces 913 and the rear segment 92 are in a form of direct extension, that is, the top surface 911 and the bottom surface 912 of the front segment 91 are backward reamed, so that the place at which the top surface 911 or the bottom surface 912 is connected to the rear segment 92 is provided with the step 93, while the two side surfaces 913 of the front segment 91 are not backward reamed, and therefore a place at which each of the two side surfaces 913 is connected to the rear segment 92 is not provided with any step 93, so as to facilitate molding and save the space in the width direction. The upper grounding sheet 81, the lower grounding sheet 82 and the middle grounding sheet 83 all contact the metal cover 9, grounding paths become more, and the grounding effect is stable.

Figure 2:
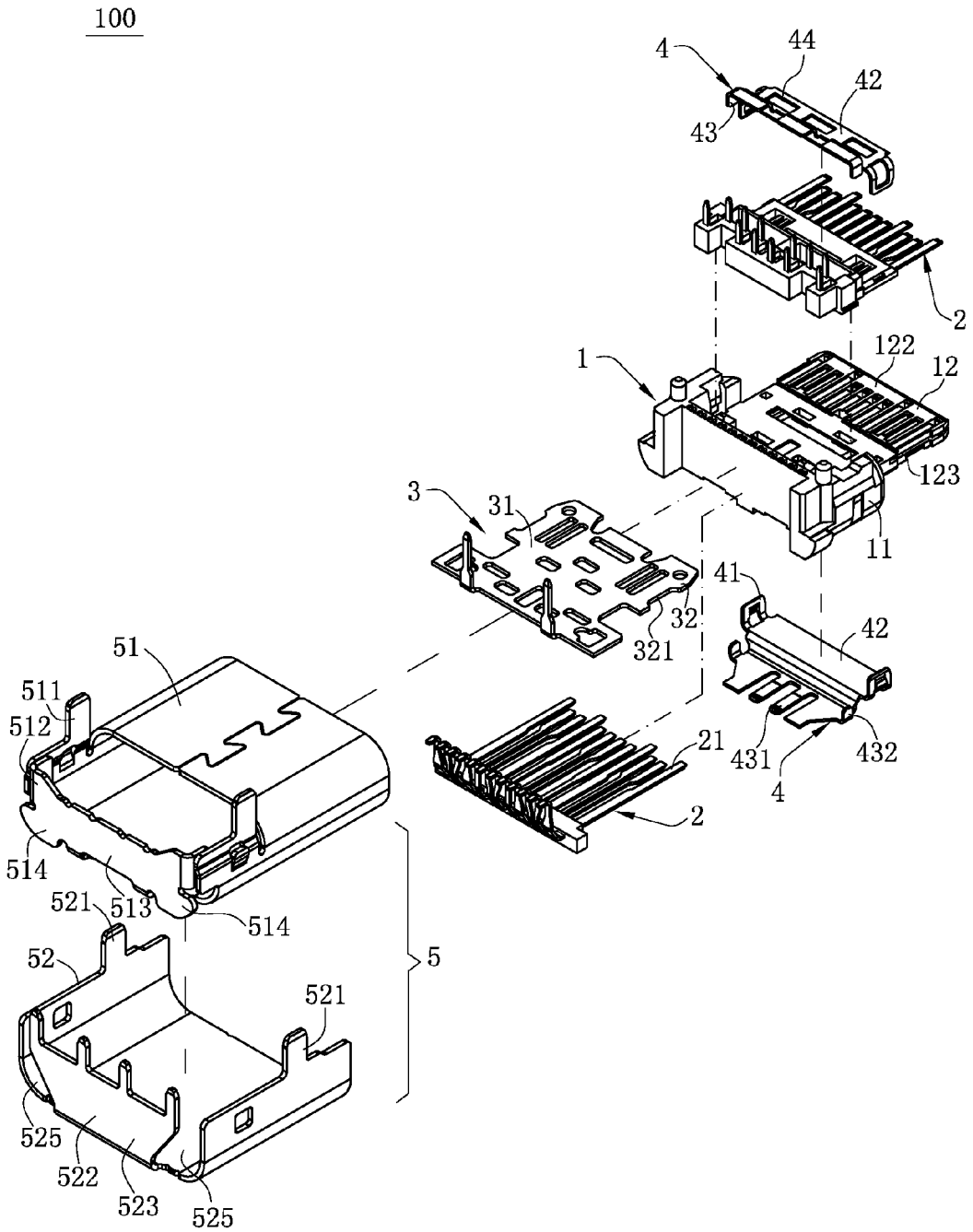
FIG. 2 is a three-dimensional exploded view of the electrical connector viewed from another viewing angle according to one embodiment of the present invention.
Figure 3:
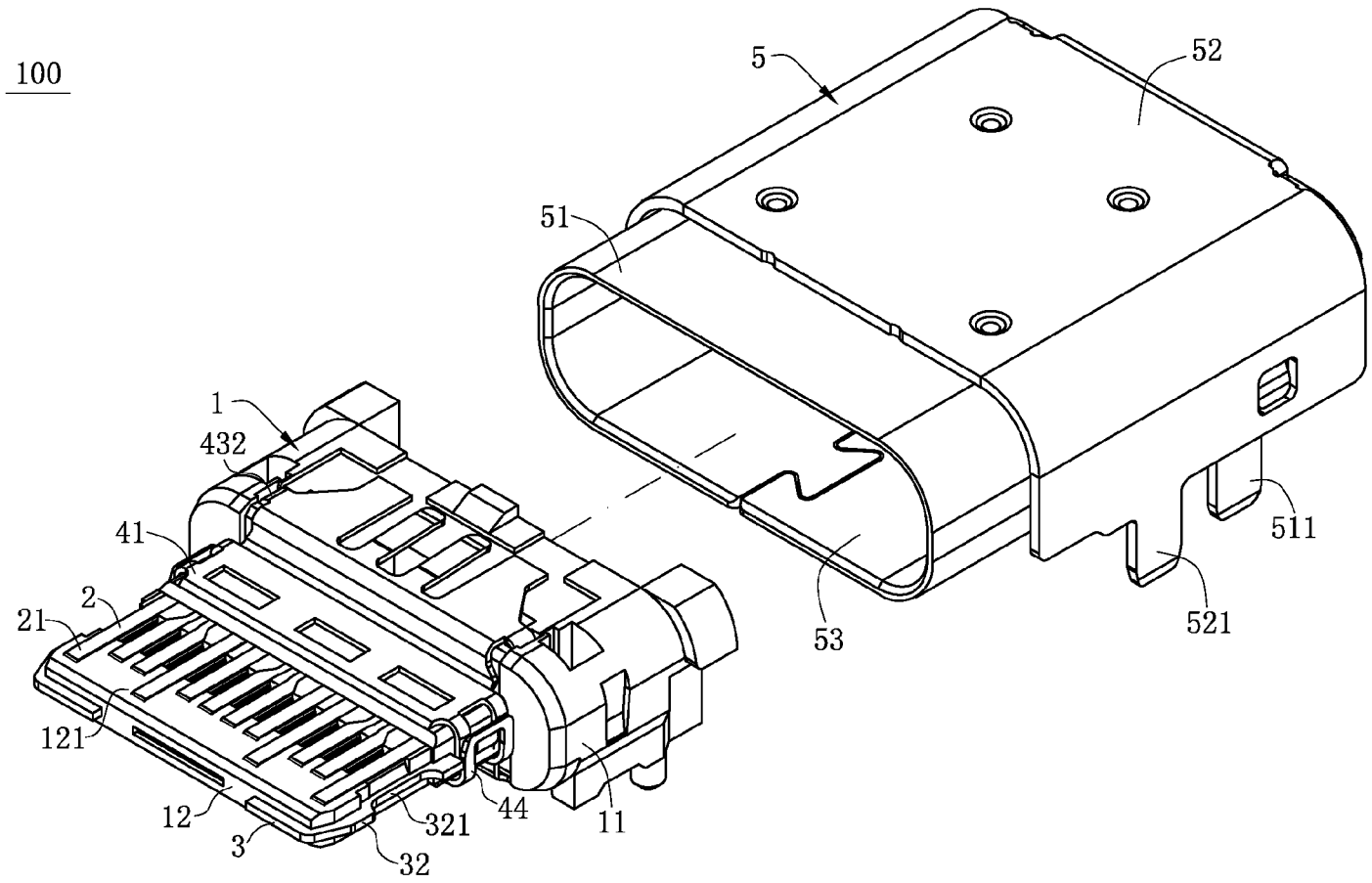
FIG. 3 is a partial three-dimensional exploded view of the electrical connector according to one embodiment of the present invention.
Figure 4:
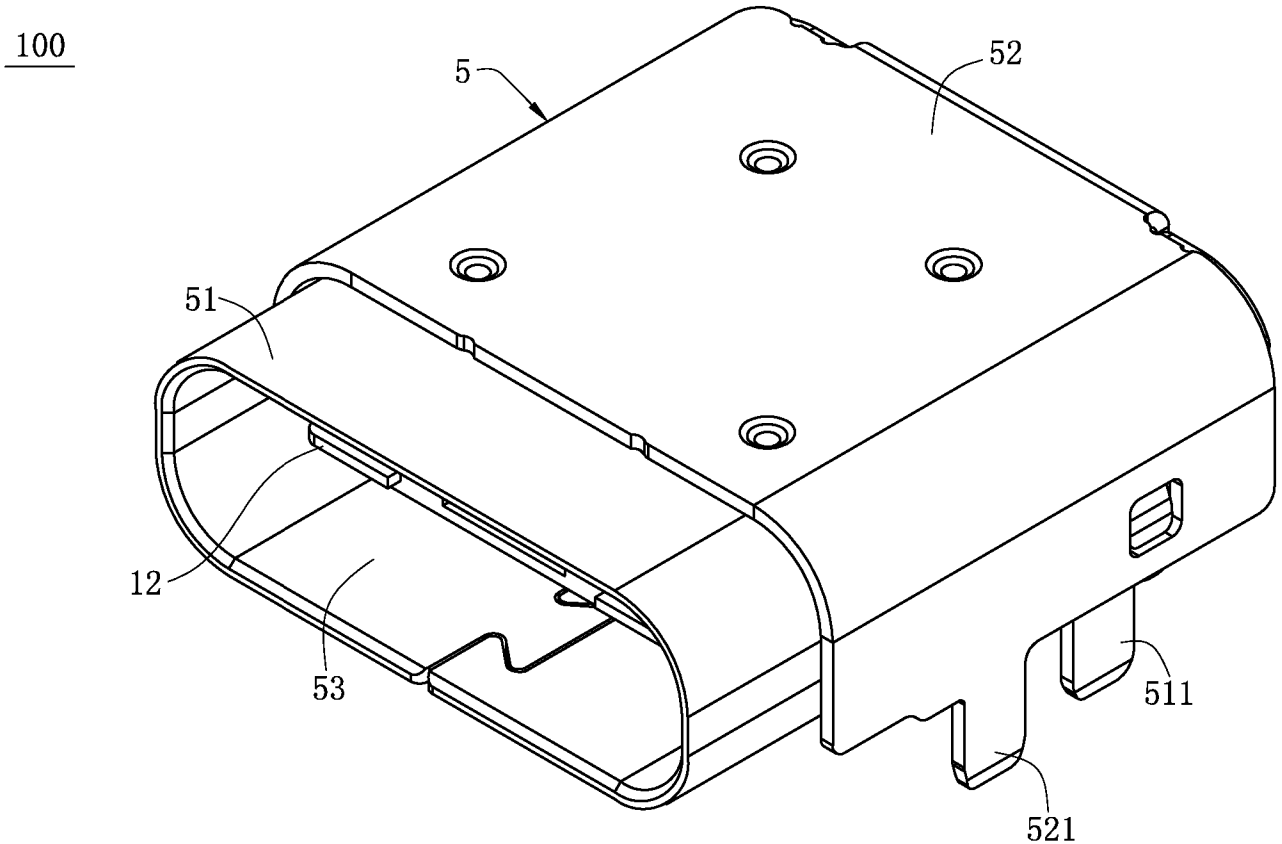
FIG. 4 is a three-dimensional assembly drawing of the electrical connector according to one embodiment of the present invention.

As shown in FIG. 1 to FIG. 3, the insulation body 1 has a base portion 11 and a tongue 12 located at a front end of the base portion 11. The base portion 11 is provided with two positioning slots 111. The tongue 12 has an upper surface 121 and a lower surface 122 disposed opposite to each other. Each of two sides of the tongue 12 is provided with a snap-fit slot 123, and the two snap-fit slots 123 are formed into two snap-fit portions (not labeled). When the mating connector 200 and the electrical connector 100 are mated, the two metal elastic sheets 8 are respectively cooperatively fixed to the two snap-fit portions, and the tongue 12 and the snap-fit slots 123 are all located in the mating space 73.

As shown in FIG. 1 to FIG. 3, the multiple terminals 2 are fixedly disposed in the base portion 11 in a manner of an upper row and a lower row. Each of the terminals has a contact portion 21 exposed from an upper surface 121 or a lower surface 122 of the tongue 12, so that the mating connector 200 and the contact portions 21 are contacted. The multiple terminals 2 include multiple pairs of high-speed terminals (not labeled), two power supply terminals (not labeled), two grounding terminals (not labeled), two reserved terminals (not labeled) and the like. In other embodiments (not shown), the upper row of multiple terminals 2 are separately two grounding terminals, two power supply terminals, two signal terminals and two reserved terminals, the lower row of multiple terminals 2 are separately two grounding terminals, two power supply terminals, two signal terminals and two reserved terminals, the upper row of multiple terminals 2 and the lower row of multiple terminals 2 are disposed symmetrically on the upper surface 121 and the lower surface 122 of the tongue 12, where the signal terminals are non-high-speed terminals. Certainly, in some embodiments, the reserved terminals (not shown) may further be removed. That is, the terminal type may be adjusted when necessary, and the functionality is enhanced. The high-speed terminals of the multiple terminals 2 are differential signal terminals. Parts of the differential signal terminals, located in the base portion 11 and the tongue 12, are close to each other, and the differential signal terminals are away from the grounding terminals at an adjacent side.

The number of the multiple terminals 2 may reach to 24. The upper row of terminals 2 are 12 in number, and are separately a grounding terminal, a pair of high-speed terminals, a power supply terminal, a reserved terminal, two USB 2.0 terminals, a reserved terminal, a power supply terminal, a pair of high-speed terminals and a grounding terminal. Correspondingly, the lower row of terminals 2 are 12 in number, and are distributed corresponding to the upper row of terminals 2, so that the mating connector 200 may be inserted into the electrical connector 100 in dual orientation.

The terminals 2 are large in number, and the electrical connector 100 is very small in volume, and therefore the multiple terminals 2 are arranged very densely in the insulation body 1. In this way, the assembly difficulty increases, and the electrical connector 100 is in the USB C TYPE, which has very high requirements on volume and high-frequency, and therefore the terminals 2 in the electrical connector 100 cannot be mounted to the insulation body 1 in an assembly manner. Therefore, the insulation body 1 has three parts independent from each other. The upper row of terminals 2 are integrally formed in a first part of the insulation body 1 by means of injection molding, the lower row of terminals 2 are integrally formed in a second part of the insulation body 1 by means of injection molding, and then the two are mounted in a third part of the insulation body 1. Certainly, in other embodiments, it may also be that, the insulation body 1 has two parts independent from each other, the upper row of terminals 2 are integrally formed in a first part of the insulation body 1 by means of injection molding, the lower row of terminals 2 are integrally formed in a second part of the insulation body 1 by means of injection molding, then the two are mounted and fixed together, and a third part does not need to be used. Alternatively, when requirements on high-frequency and functions of the electrical connector 100 are low, the terminals 2 are correspondingly reduced in number, and it may be appropriately considered that some of the terminals 2 are mounted, and other terminals are integrally formed by means of injection molding.

Multiple locations of the insulation body 1, corresponding to the terminals 2, are each provided with an adjustment hole (not labeled). The adjustment hole enables the terminals 2 to be exposed out of the insulation body 1, and is used for adjusting impedance of the terminals 2, so that the electrical connector 100 may meet the high-frequency requirements in the industry.

As shown in FIG. 1, the middle shielding sheet 3 is fixedly disposed at the base portion 11 and the tongue 12, and the middle shielding sheet 3 is located between the upper row of terminals 2 and the lower row of terminals 2, so as to ensure the shielding effect, and ensure high-frequency performance. The middle shielding sheet 3 has a plate portion 31 fixedly disposed in the tongue 12. Two protruding portions 32 separately extend out of the two sides of the tongue 12 from two sides of the plate portion 31. The two snap-fit portions are grooves 321 disposed at the two protruding portions 32. The two grooves 321 are located out of the two sides of the tongue 12, and locations of the grooves 321 are corresponding to locations of the snap-fit slots 123. When the mating connector 200 is inserted into the electrical connector 100 (not shown), the insertion portion 7 enters the insertion space 53, and the metal elastic sheet 8 are snap-fit in the snap-fit slots 123 and the grooves 321. Certainly, in other embodiments, the tongue 12 is not provided with the snap-fit slots 123, and only the protruding portions 32 are provided with the grooves 321 cooperatively fixed to the metal elastic sheet 8, or, only the tongue 12 is provided with the snap-fit slots 123 cooperatively fixed to the metal elastic sheets 8.

Two sides of the middle shielding sheet 3 separately extend out of the tongue 12 laterally, the front end of the middle shielding sheet 3 extends forward out of the front end of the tongue 12, and when the mating connector 200 and the electrical connector 100 are butted, the front end of the tongue 12 may be prevented from abrasion. A baffle plate (not labeled) extends from the back end of the middle shielding sheet 3, and the baffle plate is located between a welding portion (not labeled) of the upper row of terminals 2 and a welding portion (not labeled) of the lower row of terminals 2, and used for shielding signal interference between the two rows of terminals 2.

As shown in FIG. 1, the inner metal casing 4 is formed by buckling an upper shielding sheet 41 and a lower shielding sheet 44 to each other, and is assembled simply and easily. Each of the upper shielding sheet 41 and the lower shielding sheet 44 has a covering portion 42 disposed respectively on the upper surface 121 or the lower surface 122 of the tongue 12, an extending portion 43 extends backward from each of the covering portions 42. The extending portions 43 are stuck to and are covering the base portion 11. The extending portion 43 close to the upper surface 121 has two contact arms 431, and the contact arms 431 urge an inner wall of the outer metal casing 5, so as to increase shielding performance and be grounded. Certainly, in other embodiments, the extending portion 43 may extend backward only from the covering portion 42 stuck and covering to the upper surface 121, and the extending portion 43 has one or more contact arms 431, as long as the one or more contact arms 431 can contact the inner wall of the outer metal casing 5. Additionally, the extending portion 43 is provided with two positioning portions 432, and the two positioning slots 111 accommodate and fix the two positioning portions 432. The upper shielding sheet 41 and the lower shielding sheet 44 are in a frame shape and integrally formed, and the covering portion 42 of each of the upper shielding sheet 41 and the lower shielding sheet 44 is provided with at least one blind hole (not labeled), which helps the mating connector 200 snap-fit and fix with the blind hole. Certainly, the blind hole may also run through in the direction of the tongue 12 to form a through-hole (not labeled), or even, a through-hole corresponding to the upper surface 121 and the lower surface 122 of the tongue 12 is also further depressed, which further helps the mating connector 200 snap-fit and fix with the blind hole, which is not easily disengaged.

Figure 18:
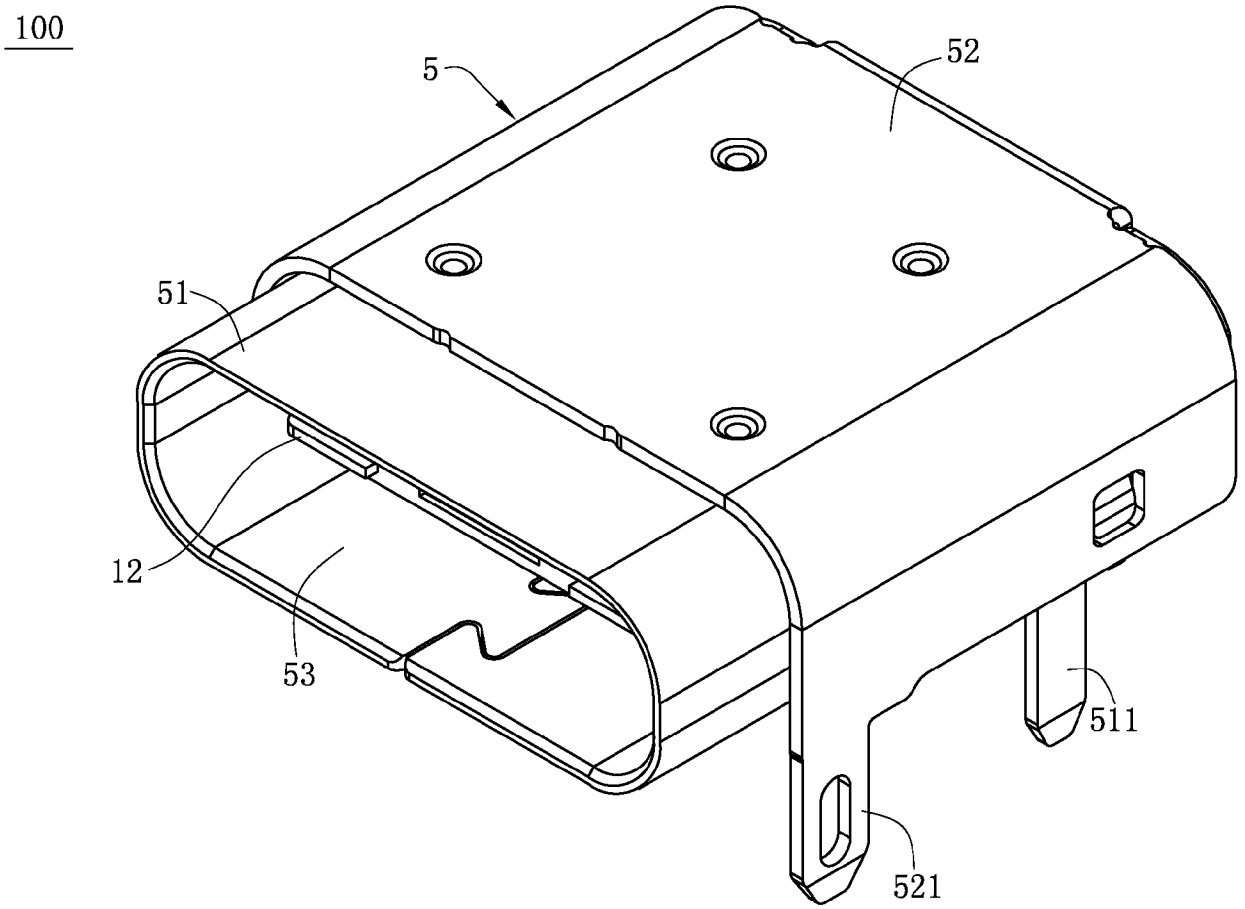
FIG. 18 is a three-dimensional assembly view of an electrical connector according to a fourth embodiment of the present invention.
Figure 19:
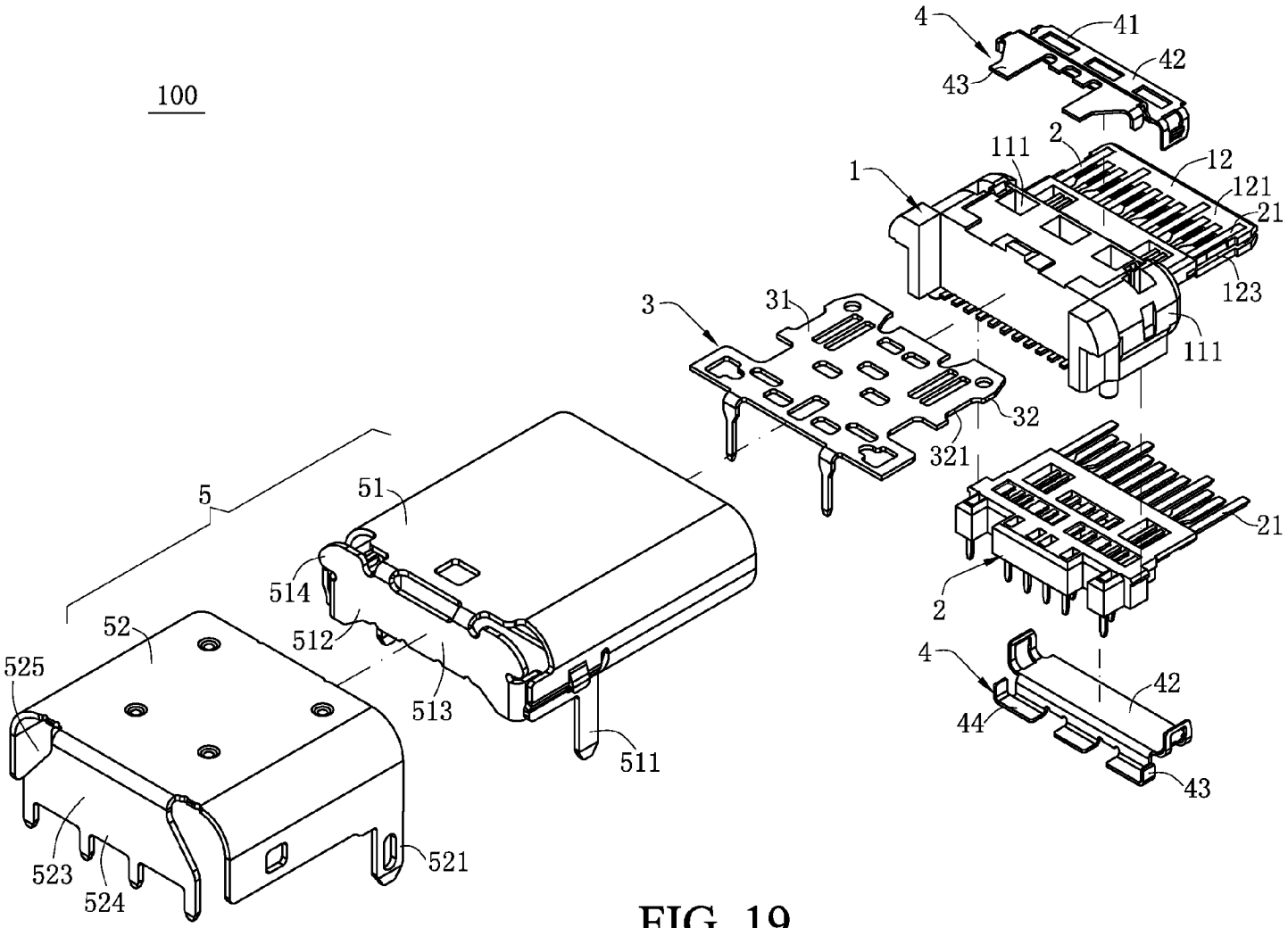
FIG. 19 is a three-dimensional exploded view of the electrical connector according to the fourth embodiment of the present invention.
Figure 20:
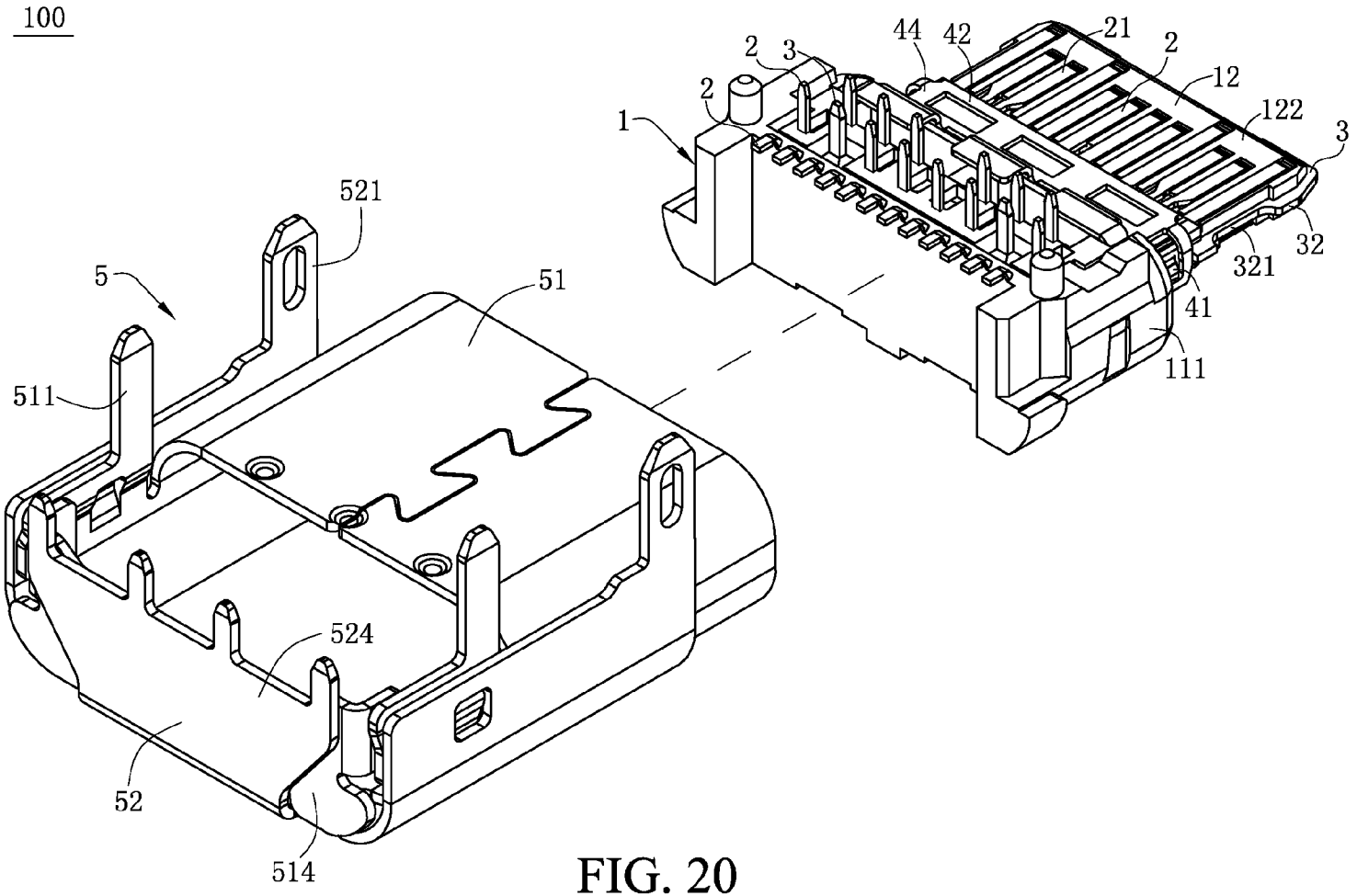
FIG. 20 is a partial three-dimensional exploded view of the electrical connector according to the fourth embodiment of the present invention.

As shown in FIG. 1 to FIG. 5, the outer metal casing 5 surrounds peripheries of the base portion 11 and the tongue 12. The outer metal casing 5 has an interior casing 51 and a shielding casing 52. The interior casing 51 surrounds the peripheries of the base portion 11 and the tongue 12, and the shielding casing 52 is disposed out of the interior casing 51. The double protection can reduce signal loss as much as possible. Each of two sides of the interior casing 51 has a first soldering pin 511, each of two sides of the shielding casing 52 has a second soldering pin 521. The first soldering pin 511 and the second soldering pin 521 are staggered front and back. The first soldering pin 511 is close to the lateral side of the base portion 11, and the second soldering pin 521 is close to the lateral side of the tongue 12, and therefore the electrical connector 100 is stably mounted on a circuit board 300, and not easily disengaged. Certainly, in other embodiments, it may also be that, the first soldering pins 511 and the second soldering pins 521 are all located at the front end, or are all located at the back end, the multiple terminals 2 in the electrical connector 100 are welded on the circuit board 300 at welding locations (not labeled), and from a side viewing angle, the front and back arrangement relationship among the first soldering pins 511, the second soldering pins 521 and the welding locations may be appropriately adjusted and changed, as long as the electrical connector 100 is well and stably mounted on the circuit board 300. As shown in FIG. 18, a through-hole (not labeled) runs through each of the second soldering pin 521, and when the second soldering pins 521 are welded onto the circuit board 300, the contact area of coated solder paste and the second soldering pins 521 are increased, so as to ensure that the second soldering pins 521 and the circuit board 300 are stably positioned.

Figure 5:
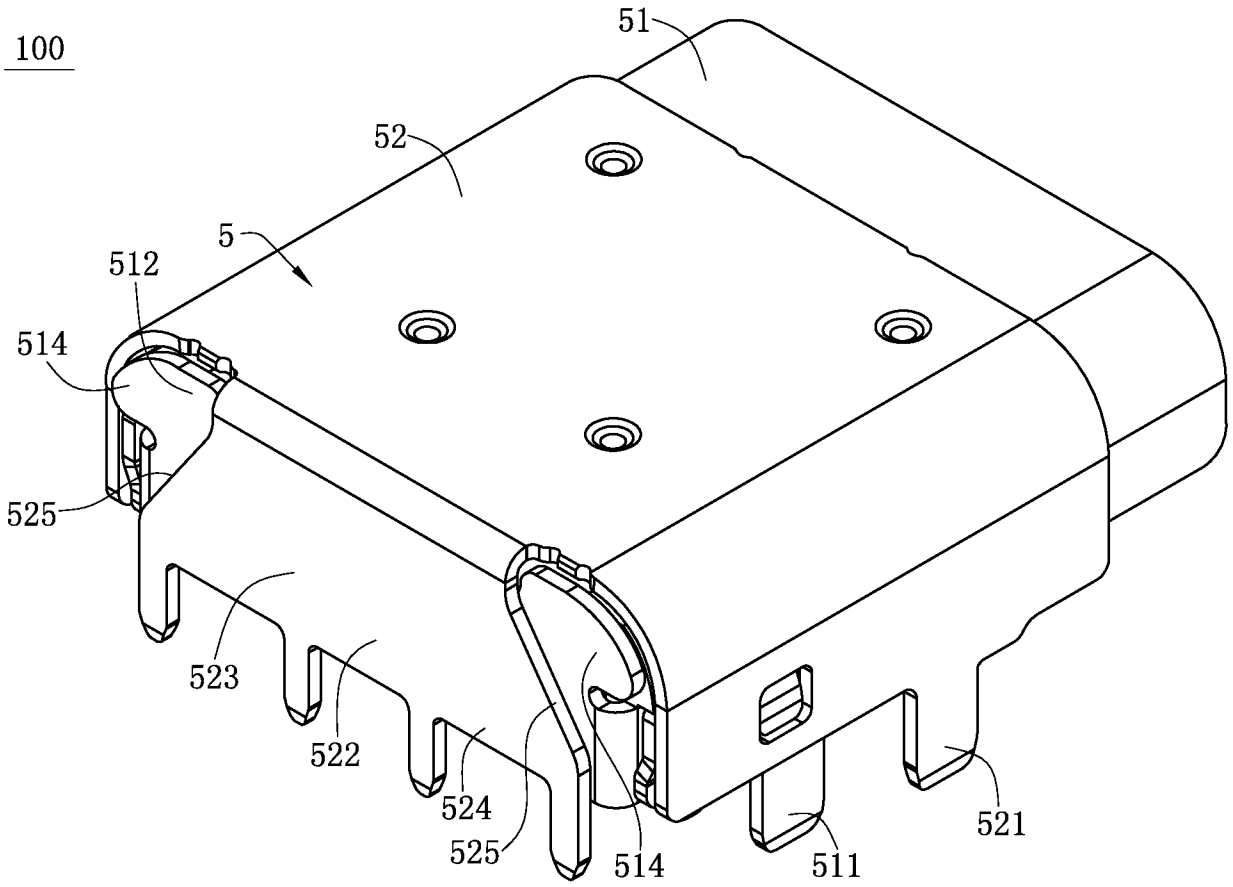
FIG. 5 is a three-dimensional exploded view of the electrical connector viewed from another viewing angle according to one embodiment of the present invention.
Figure 6:
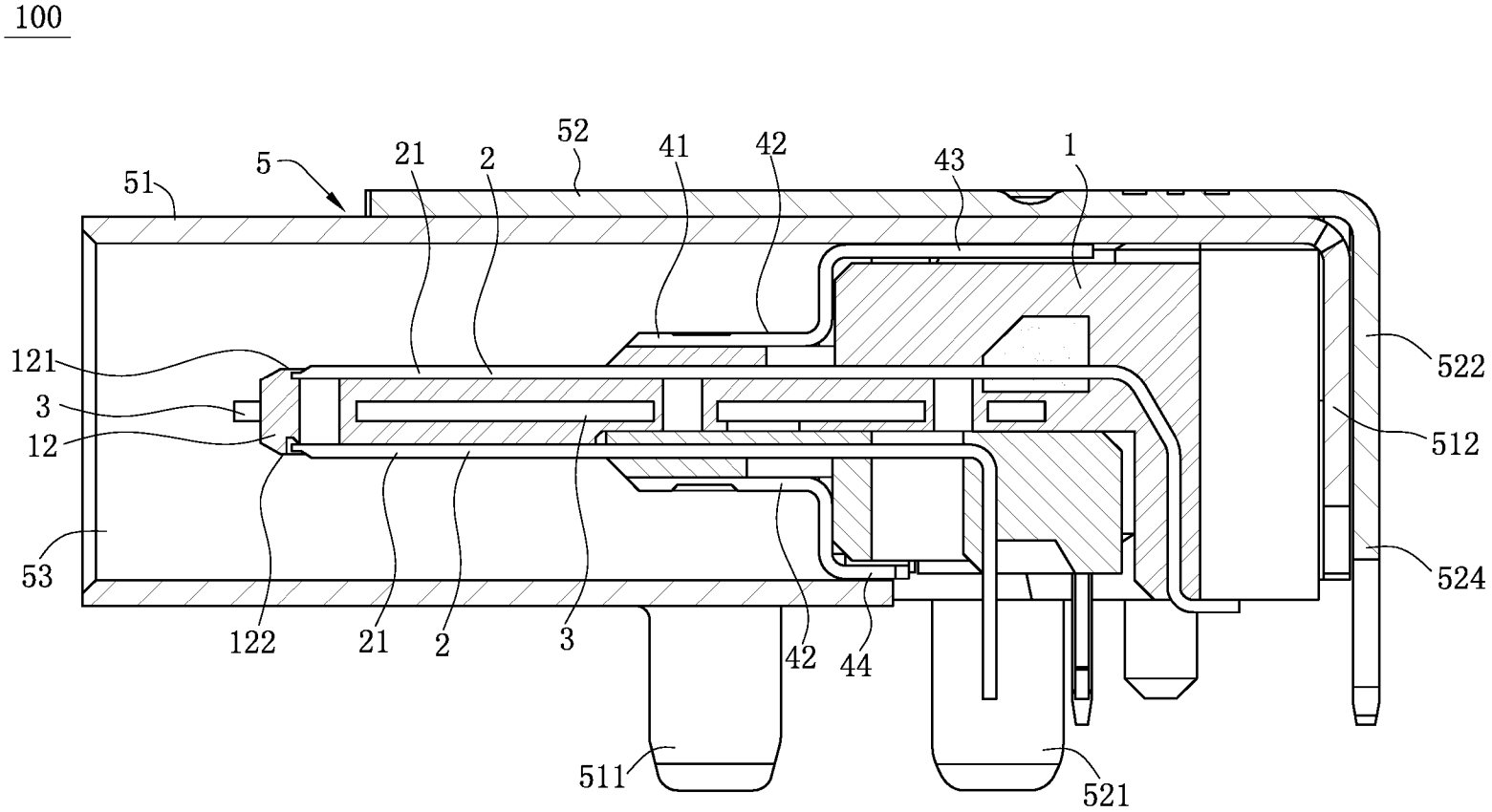
FIG. 6 is a sectional view of the electrical connector according to one embodiment of the present invention.
Figure 7:
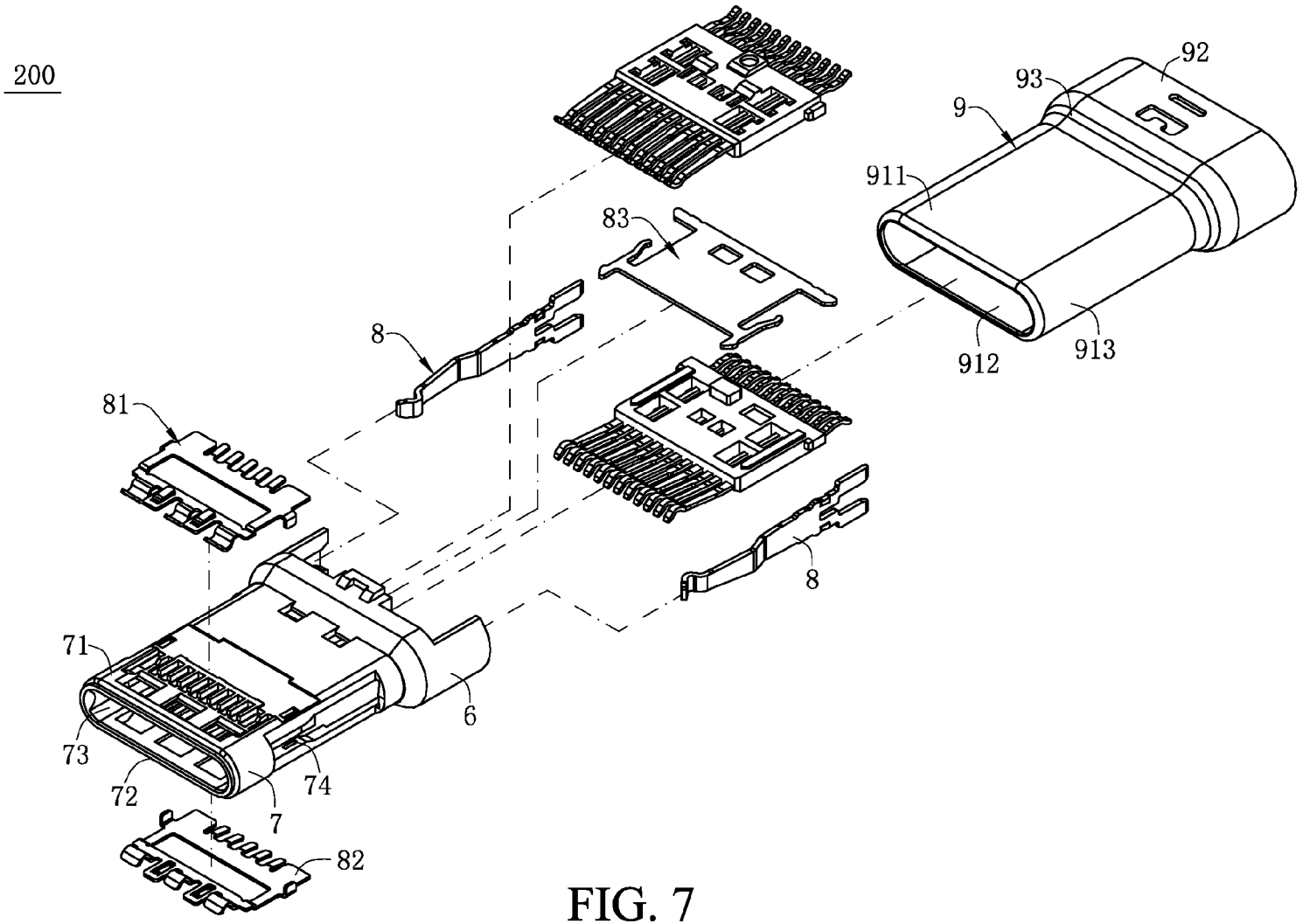
FIG. 7 is a three-dimensional exploded view of a mating connector according to one embodiment of the present invention.
Figure 8:
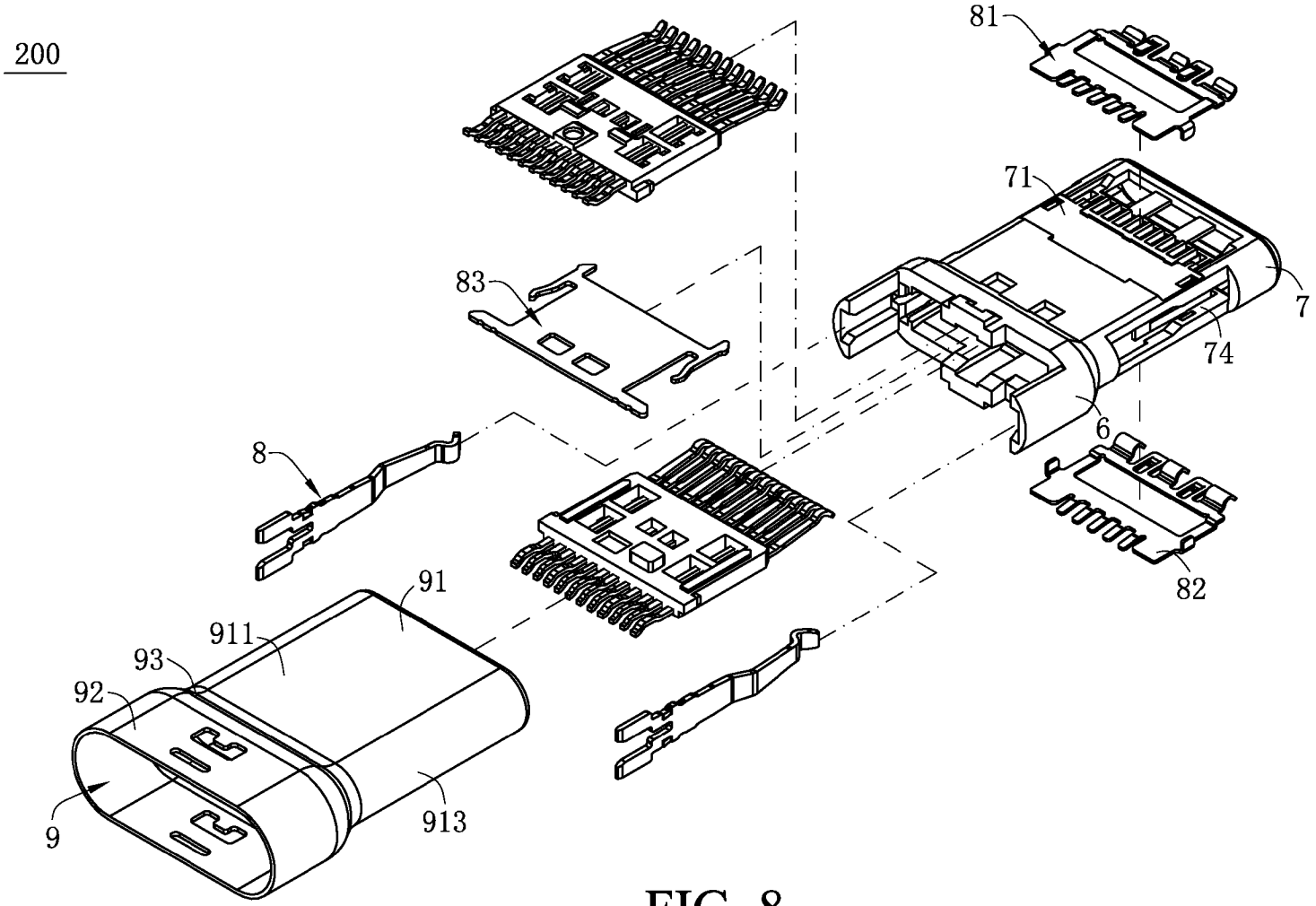
FIG. 8 is a three-dimensional exploded view of the mating connector viewed from another viewing angle according to one embodiment of the present invention.
Figure 9:
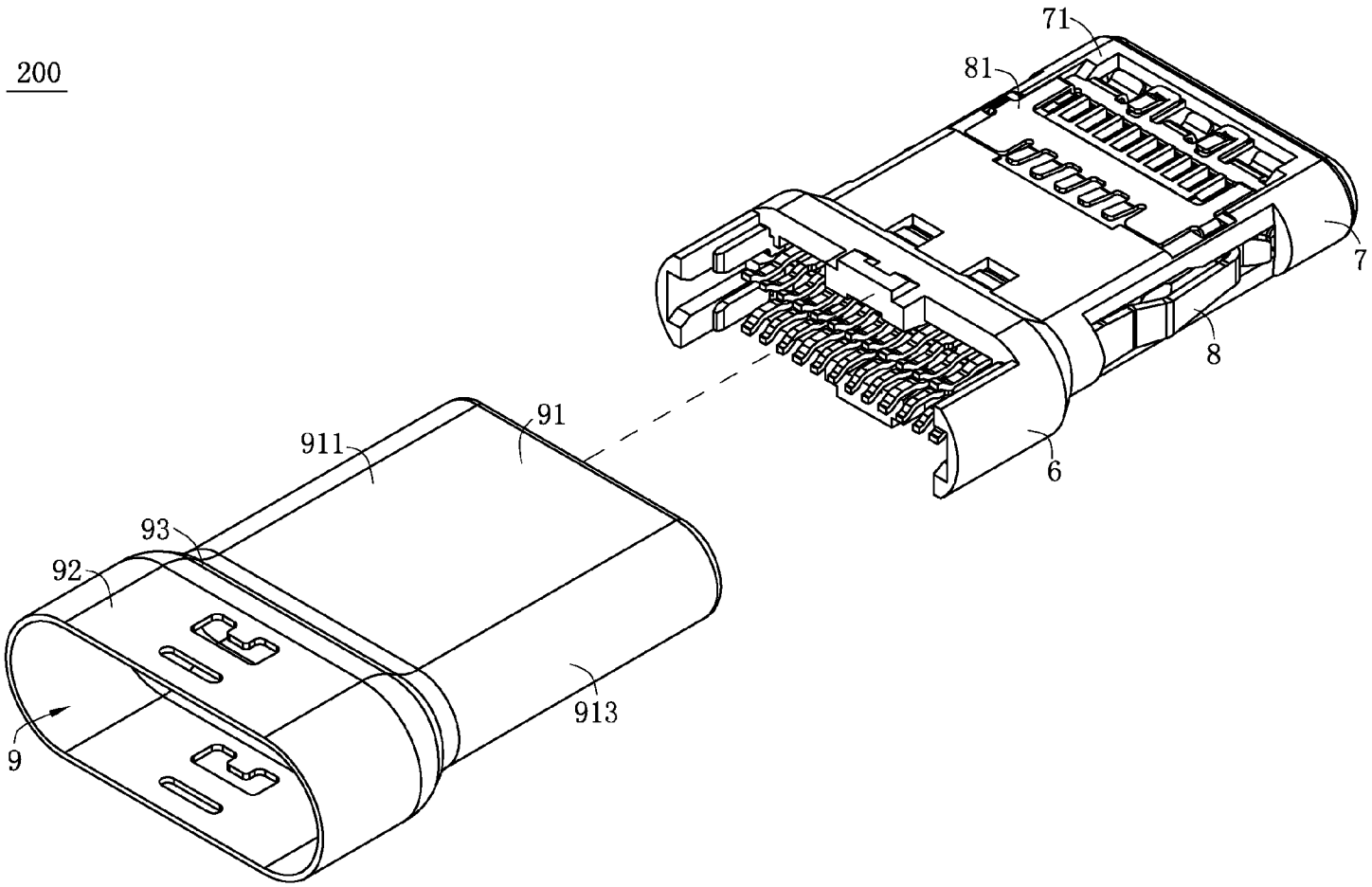
FIG. 9 is a partial three-dimensional exploded view of the mating connector according to one embodiment of the present invention.
Figure 10:
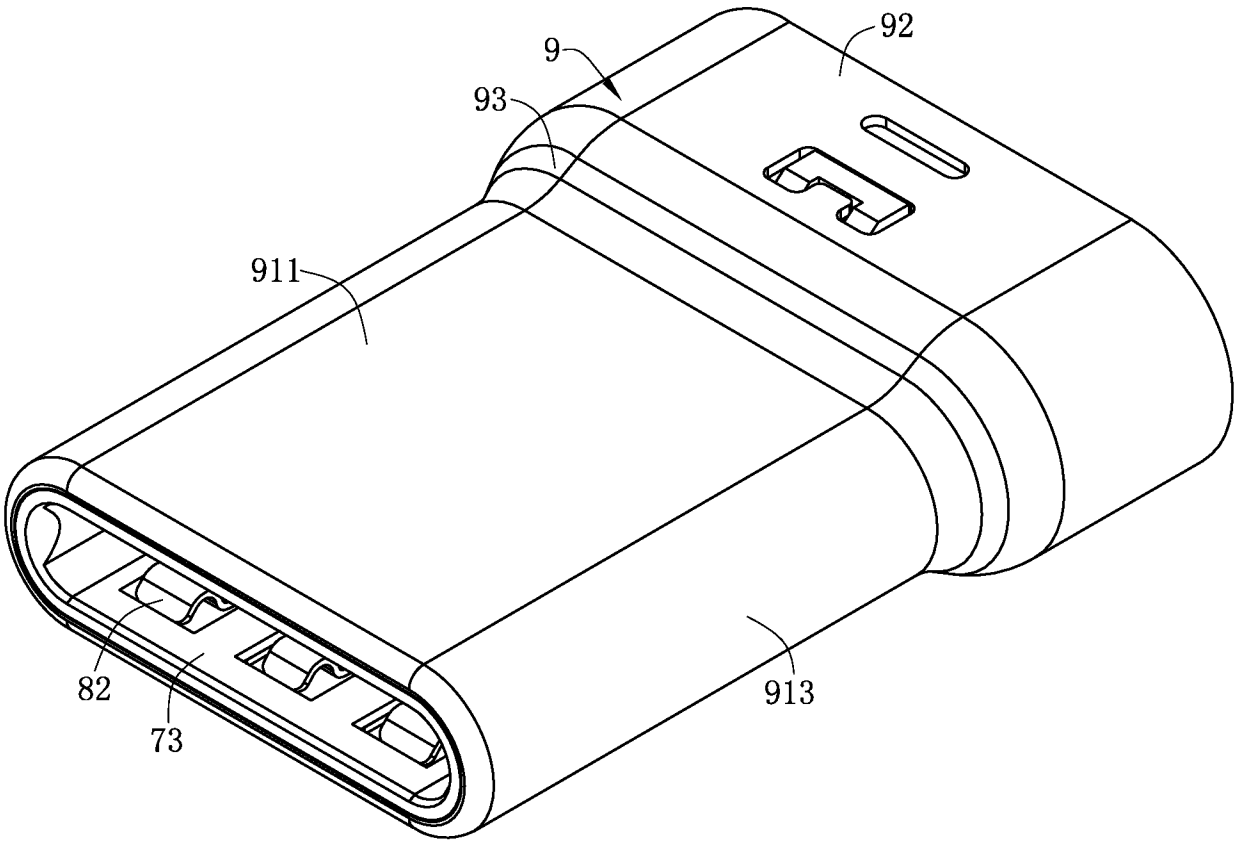
FIG. 10 is a three-dimensional assembly drawing of the mating connector according to one embodiment of the present invention.
Figure 11:
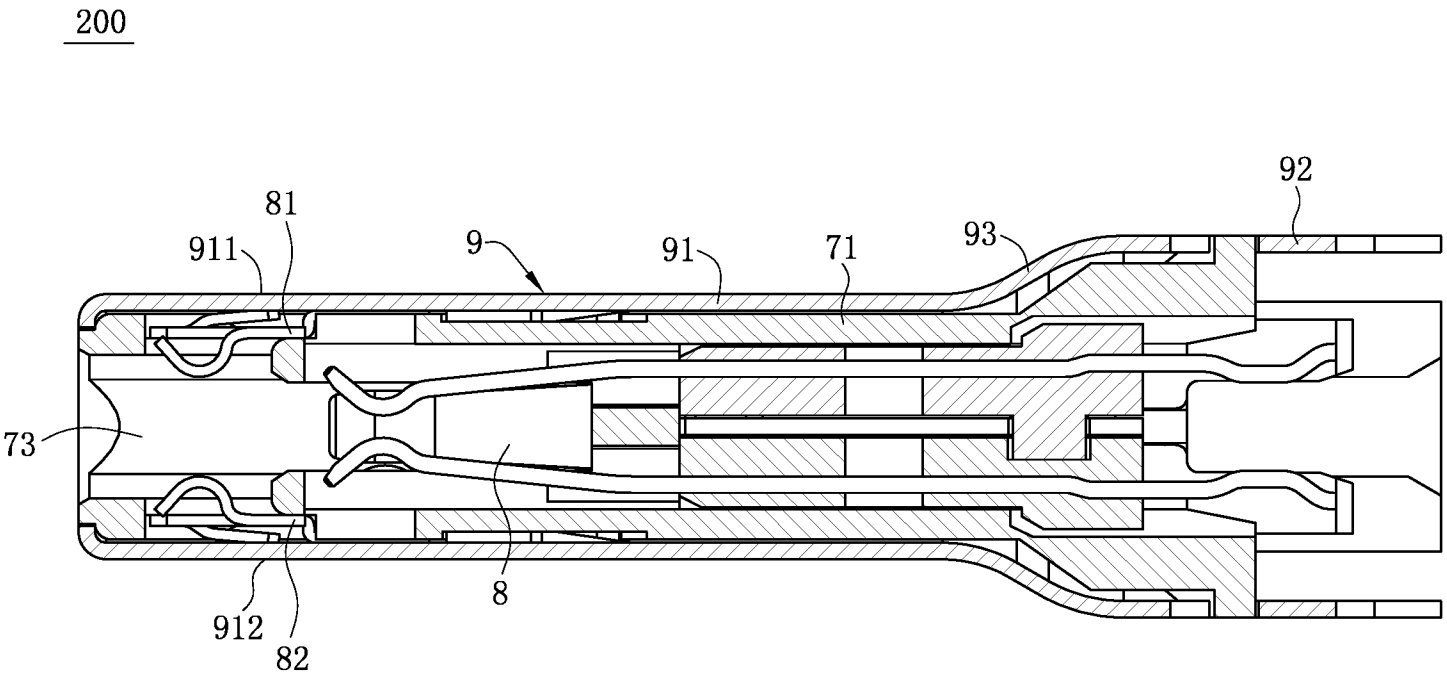
FIG. 11 is a sectional view of the mating connector according to one embodiment of the present invention.
Figure 12:
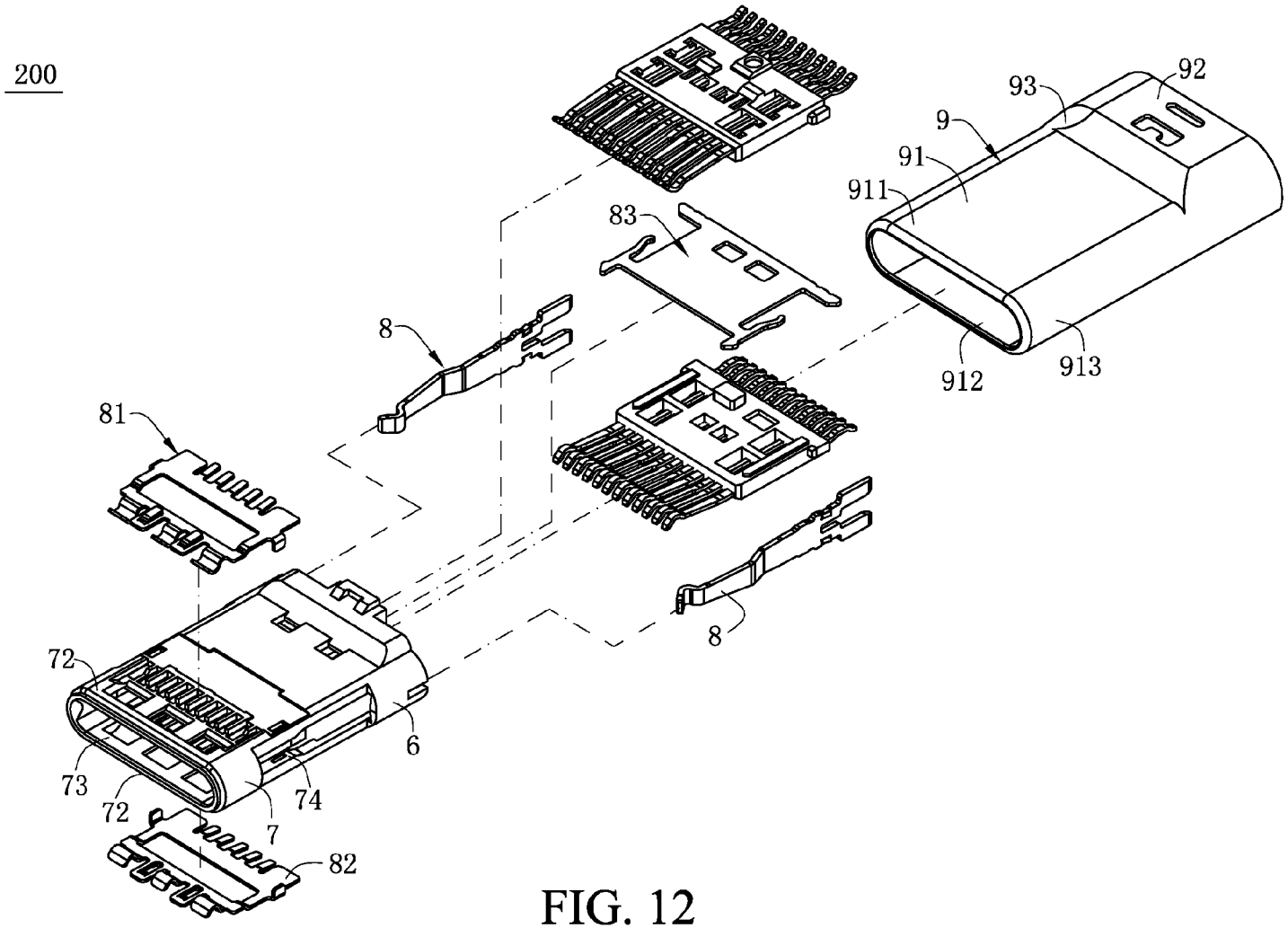
FIG. 12 is a three-dimensional exploded view of a mating connector according to a second embodiment of the present invention.
Figure 13:
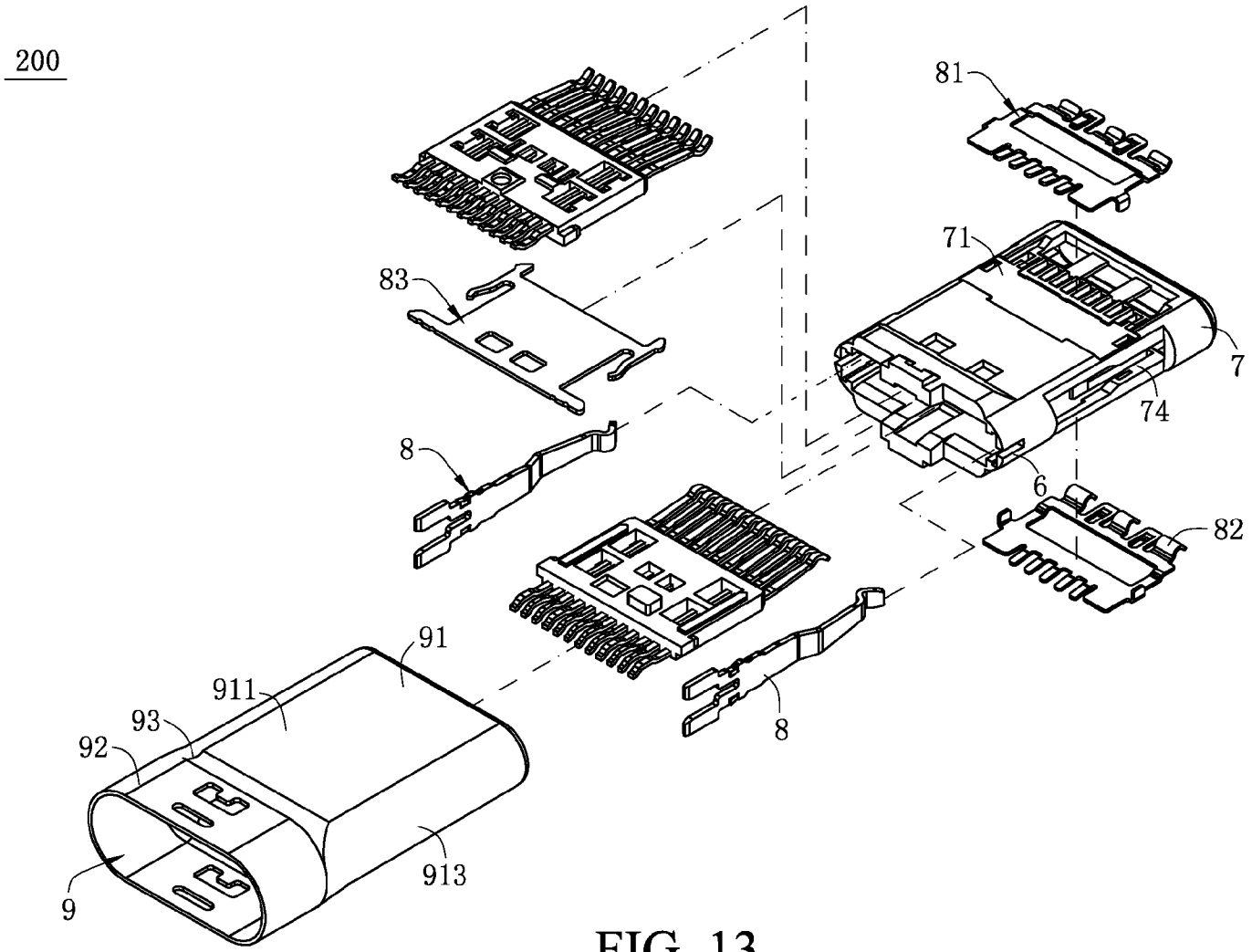
FIG. 13 is a three-dimensional exploded view of the mating connector viewed from another viewing angle according to the second embodiment of the present invention.
Figure 14:
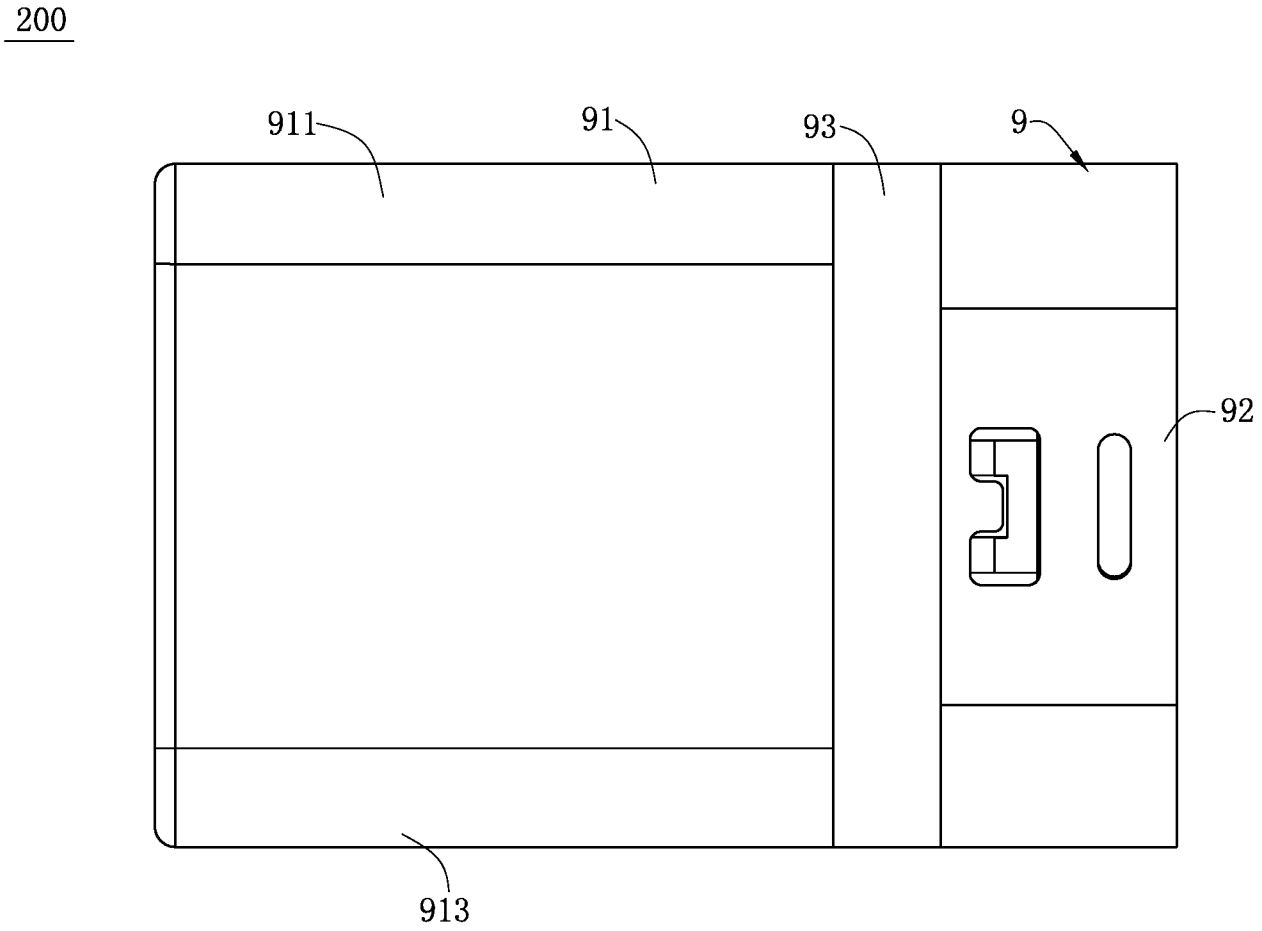
FIG. 14 is a top view of a metal cover of the mating connector according to the second embodiment of the present invention.
Figure 15:
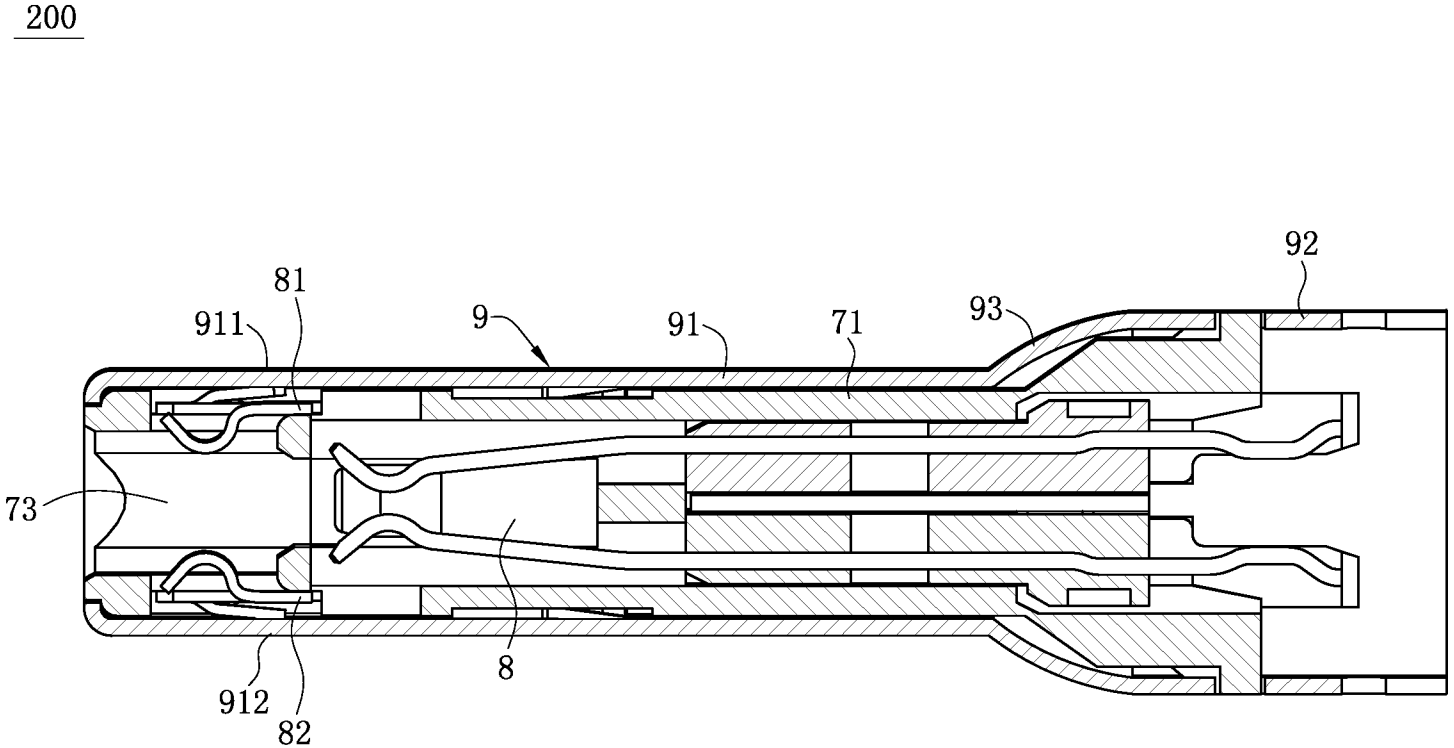
FIG. 15 is a sectional view of the mating connector according to the second embodiment of the present invention.

As shown in FIG. 5 and FIG. 6, the interior casing 51 has a first rear wall 512, and the shielding casing 52 has a second rear wall 522. The first rear wall 512 has a first middle portion 513 and first sheltering portions 514 located at two sides of the first middle portion 513. The second rear wall 522 has a second middle portion 523 and a second sheltering portion 524 connected to a lower part of the second middle portion 523. The first middle portion 513 and the second middle portion 523 are approximately superposed front and back. A place of the second rear wall 522 corresponding to the first sheltering portion 514 forms a notch 525, and the second sheltering portion 524 exceeds the first middle portion 513 downward. The electrical connector 100 can be conveniently welded, and a good shielding effect can be ensured, so as to prevent signals from being leaked from the behind, and save materials. Multiple fixing pins (not labeled) extend downward from the second rear wall 522, and are used for cooperating with the first soldering pins 511 and the second soldering pins 521 to stably position the electrical connector 100 onto the circuit board 300.

Figure 48:
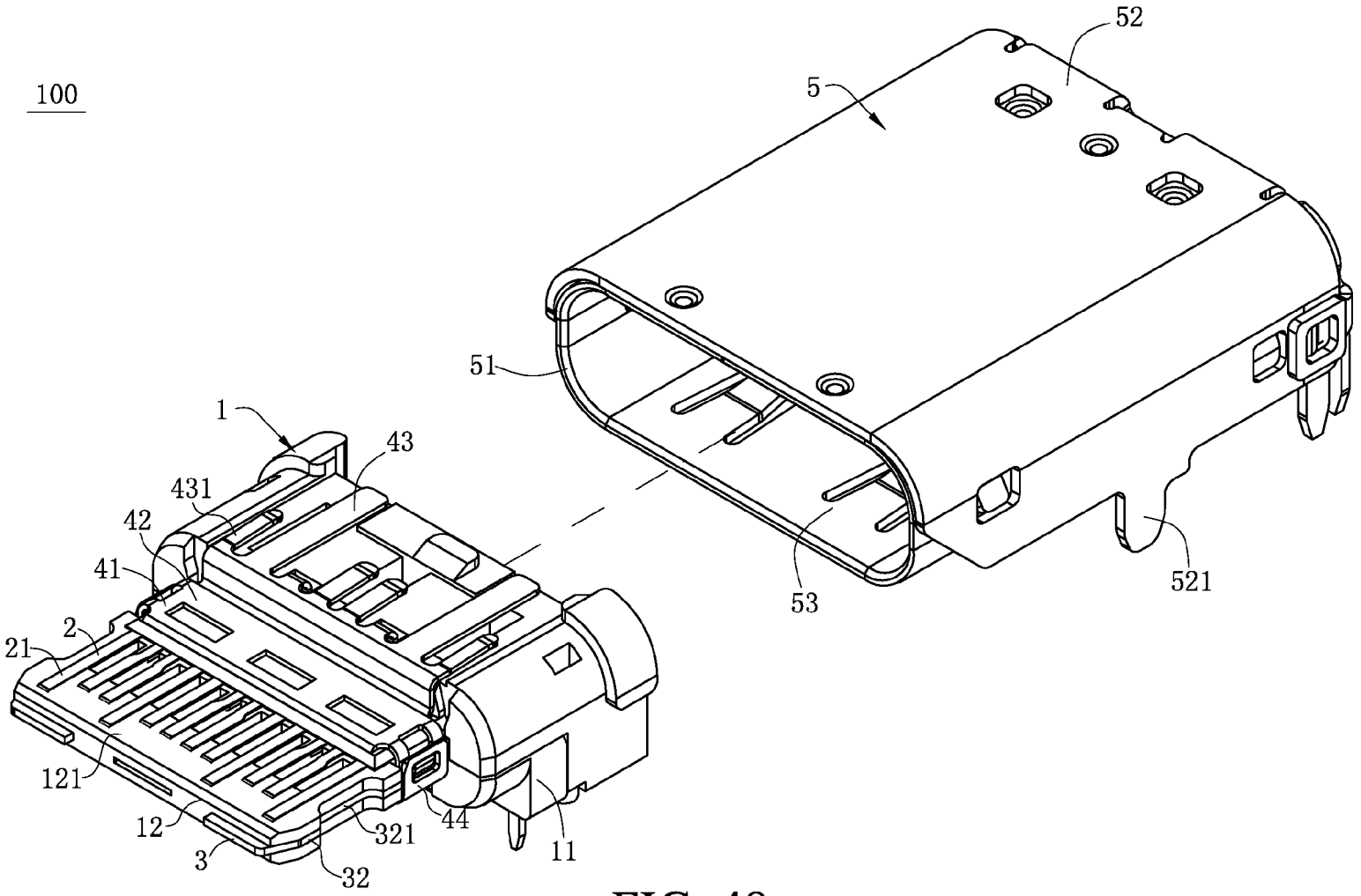
FIG. 48 is a partial three-dimensional exploded view of the electrical connector according to the thirteenth embodiment of the present invention.
Figure 49:
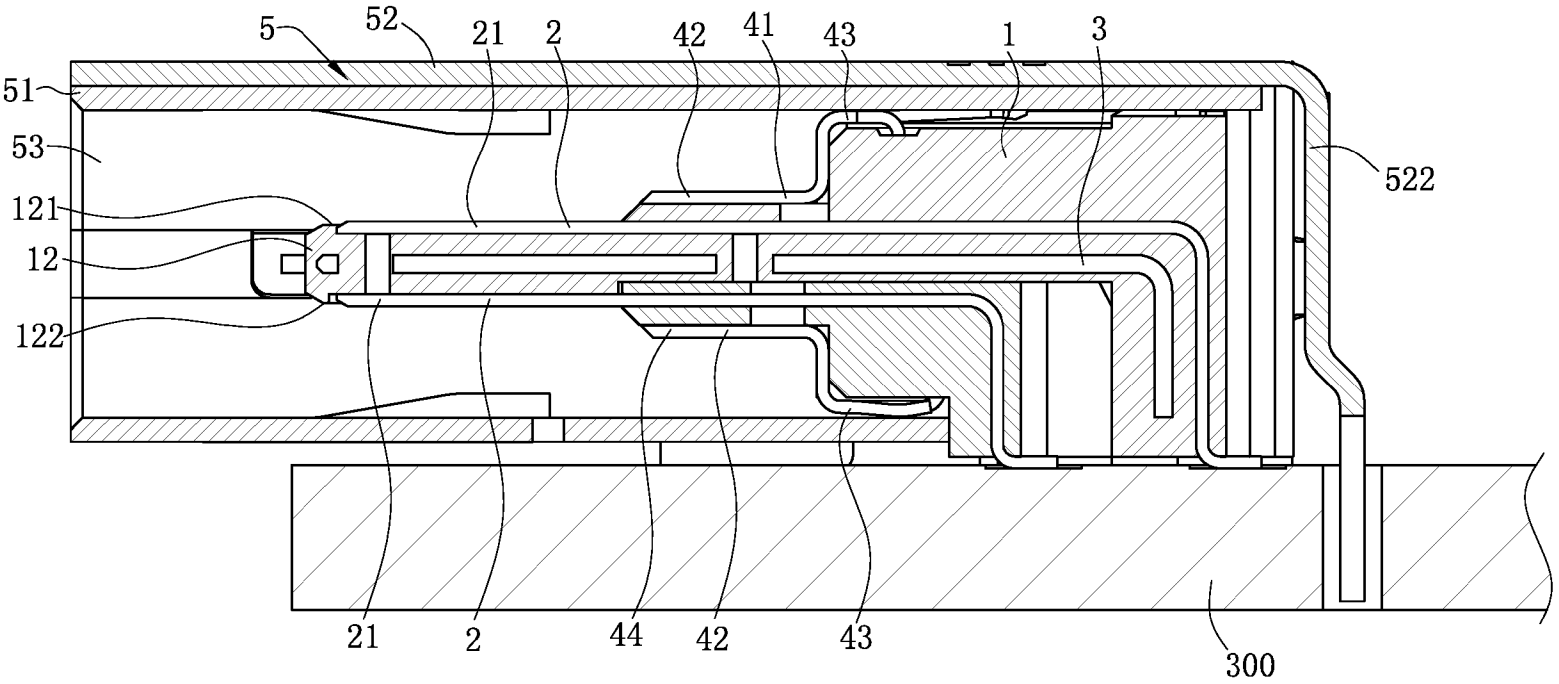
FIG. 49 is a sectional view of the electrical connector according to the thirteenth embodiment of the present invention.
Figure 50:
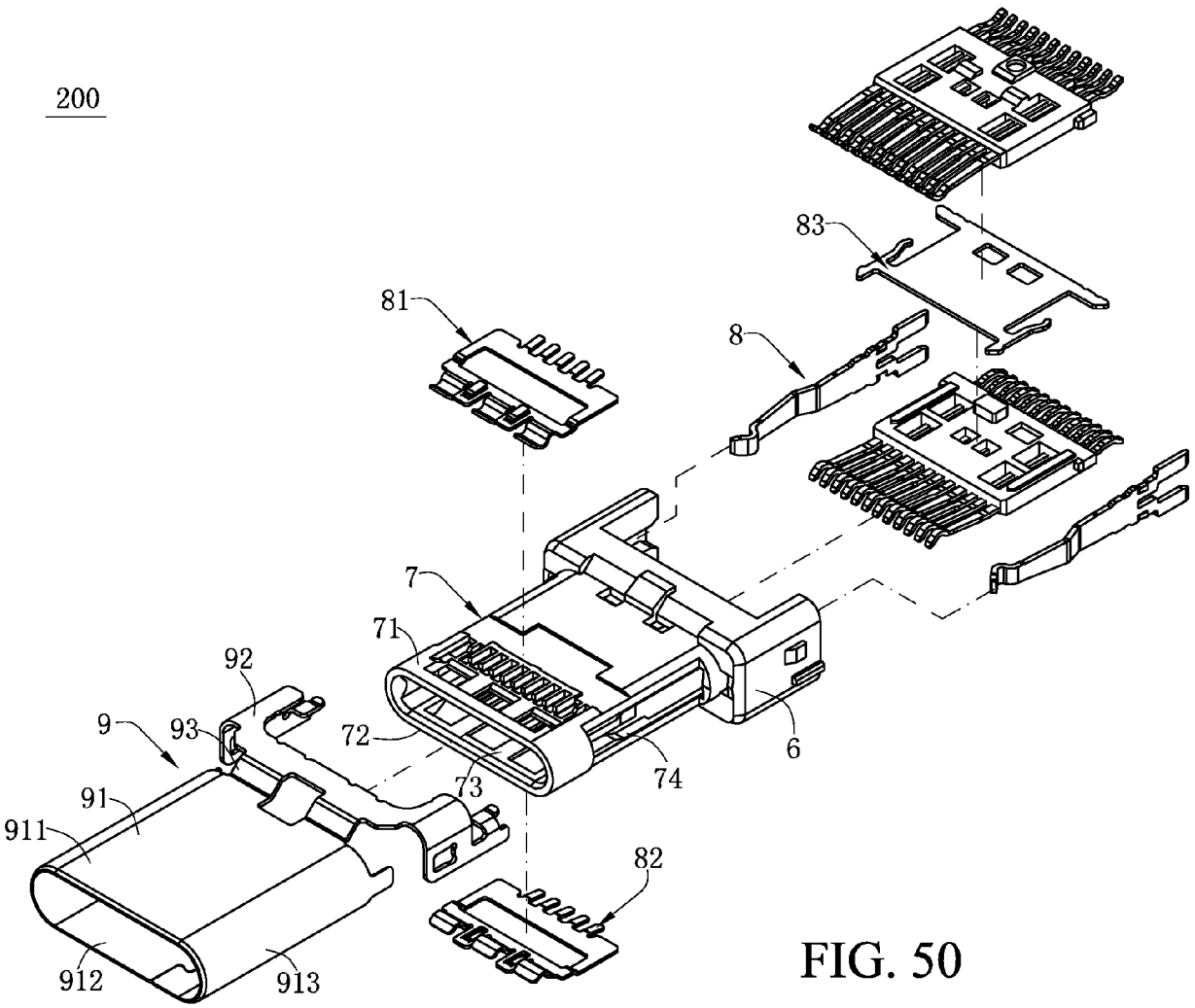
FIG. 50 is a three-dimensional exploded view of a mating connector according to a fourteenth embodiment of the present invention.
Figure 51:
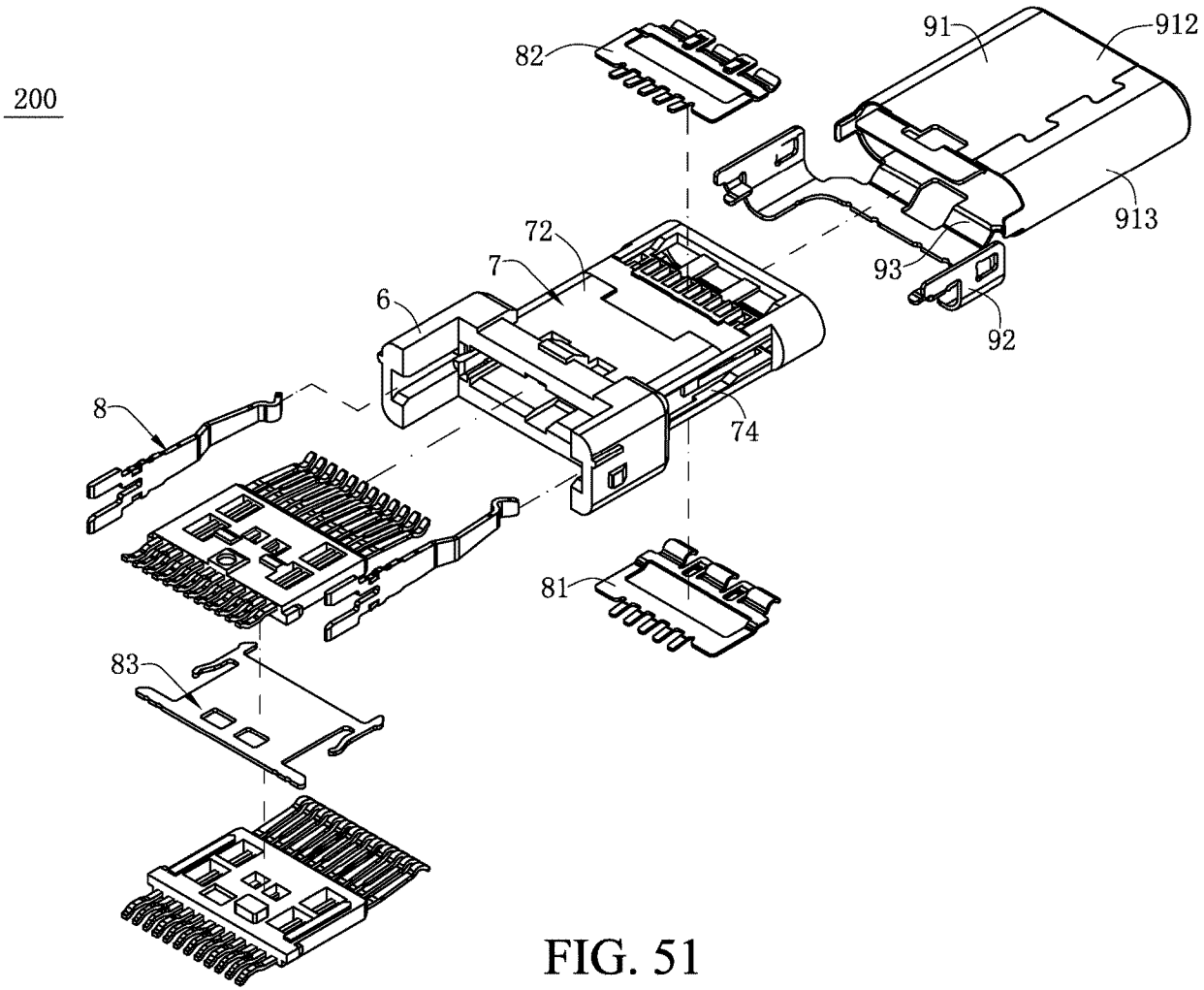
FIG. 51 is a three-dimensional exploded view of the mating connector viewed from another viewing angle according to the fourteenth embodiment of the present invention.
Figure 52:
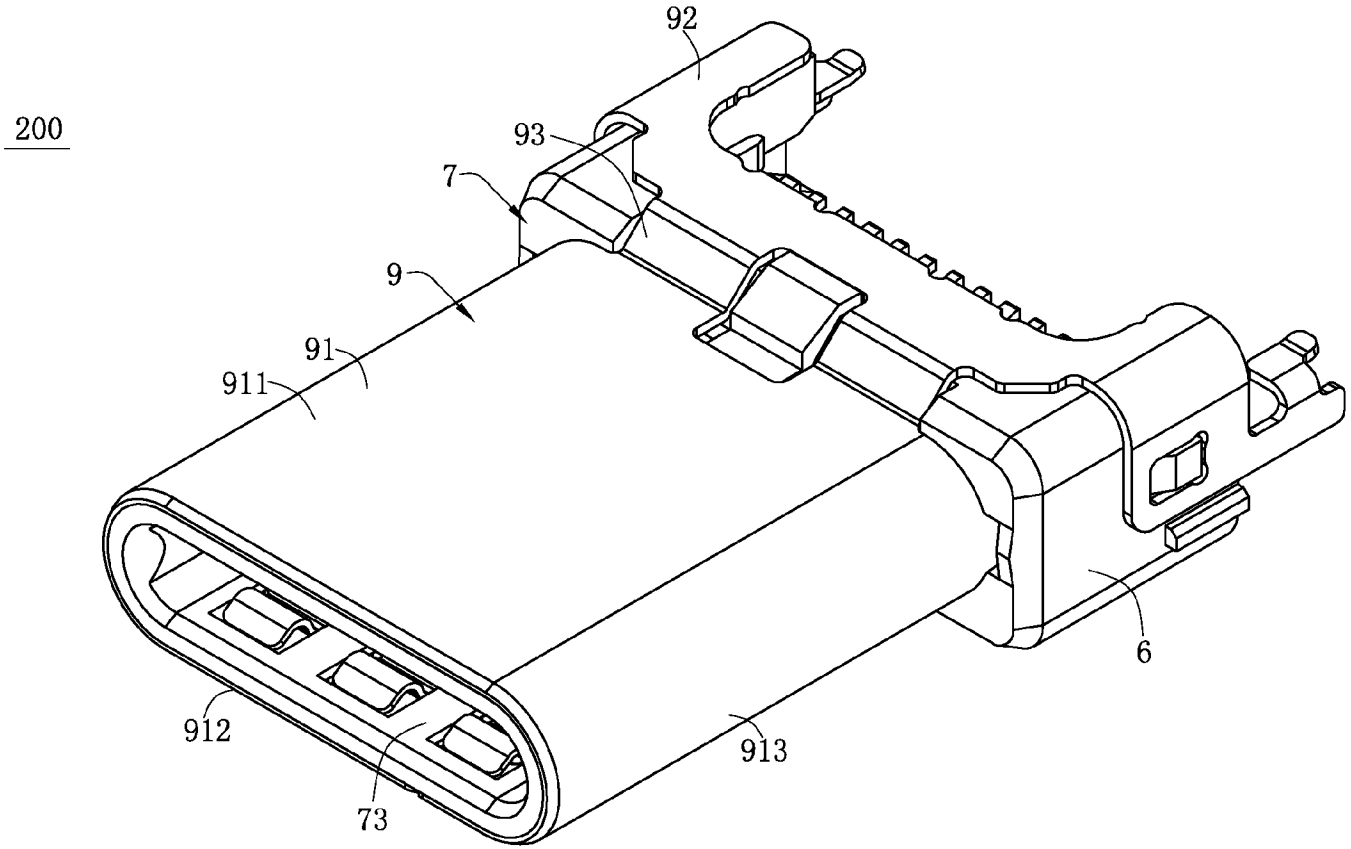
FIG. 52 is a three-dimensional assembly view of the mating connector according to the fourteenth embodiment of the present invention.
Figure 53:
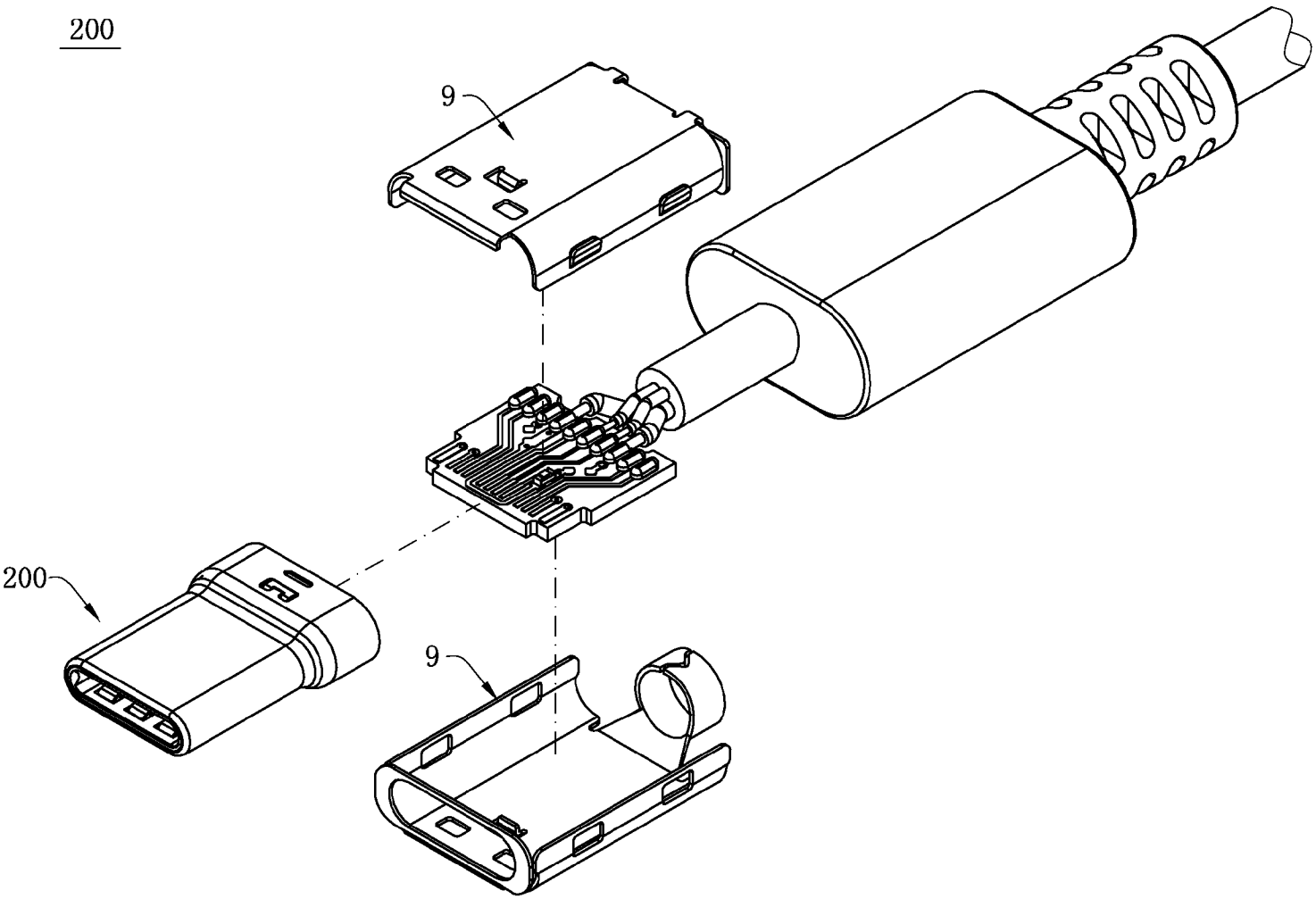
FIG. 53 is a three-dimensional exploded view of a mating connector according to a fifteenth embodiment of the present invention.
Figure 54:
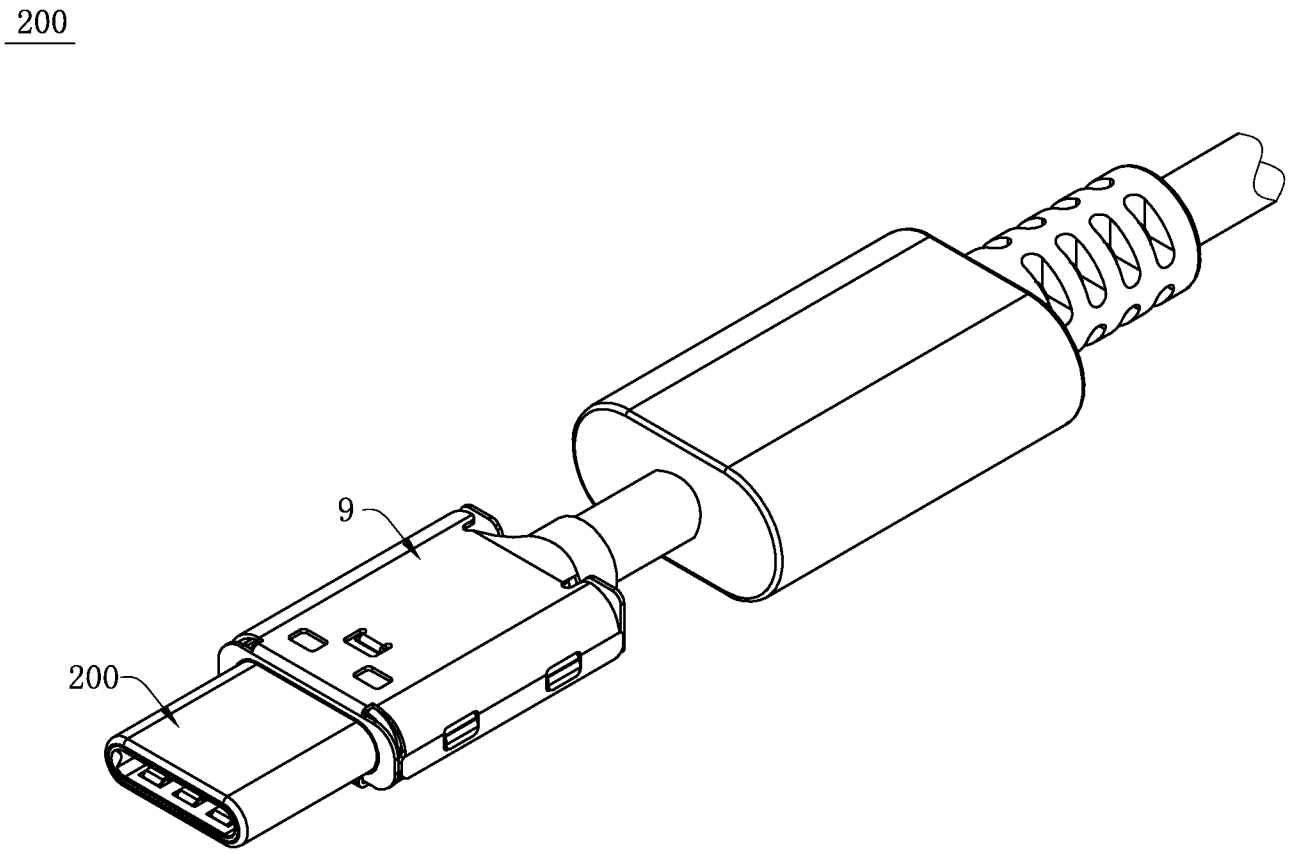
FIG. 54 is a three-dimensional assembly view of the mating connector according to the fifteenth embodiment of the present invention.

As shown in FIG. 48, structures bending forward are further disposed at two sides of the second rear wall 522, to further snap-fit two side walls of the shielding casing 52, so that the shielding casing 52 does not easily loosen, and it may also ensure that the signals in the electrical connector 100 are not easily leaked from behind the rear side.

Figure 21:
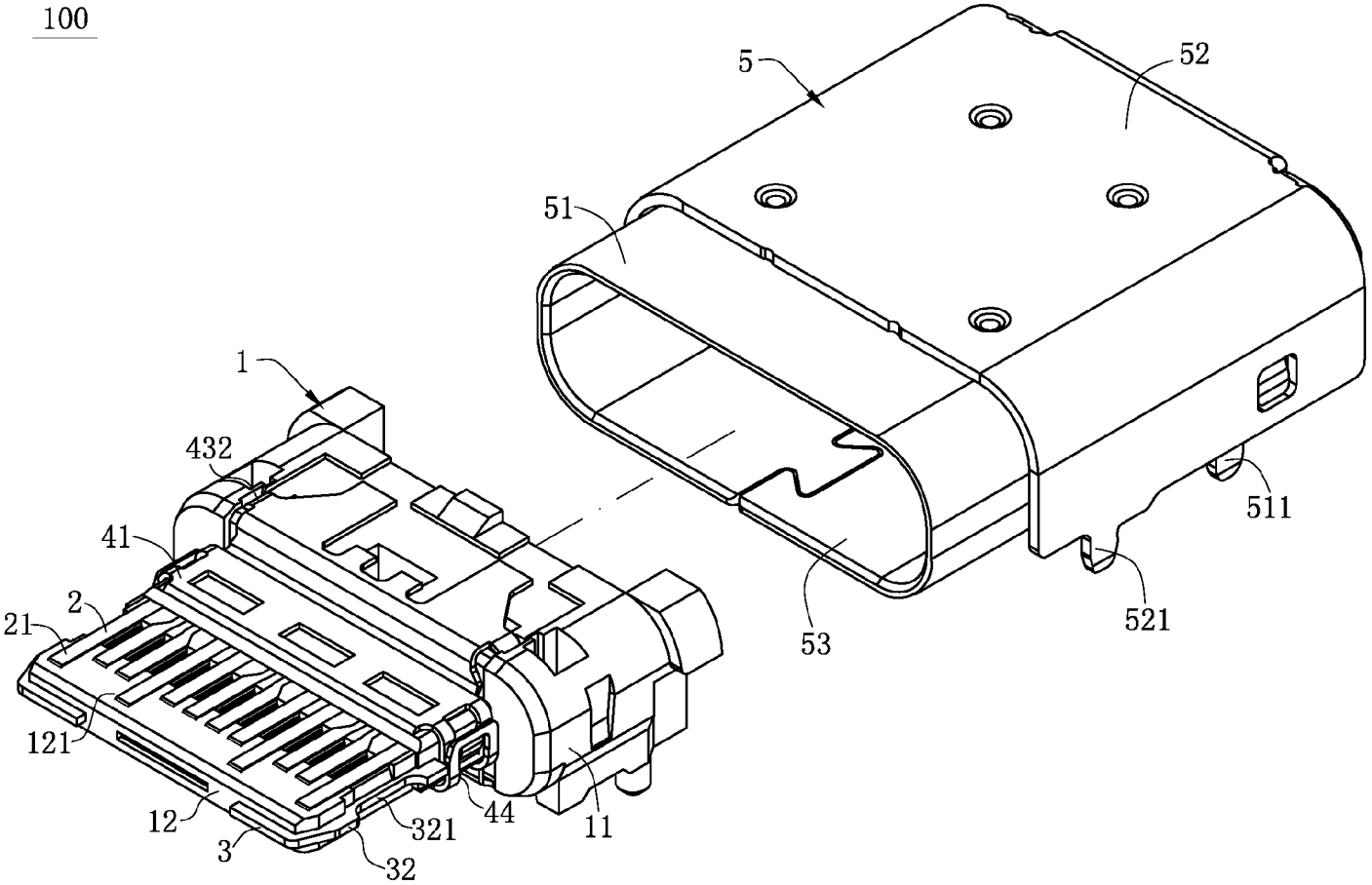
FIG. 21 is a partial three-dimensional exploded view of an electrical connector according to a fifth embodiment of the present invention.
Figure 22:
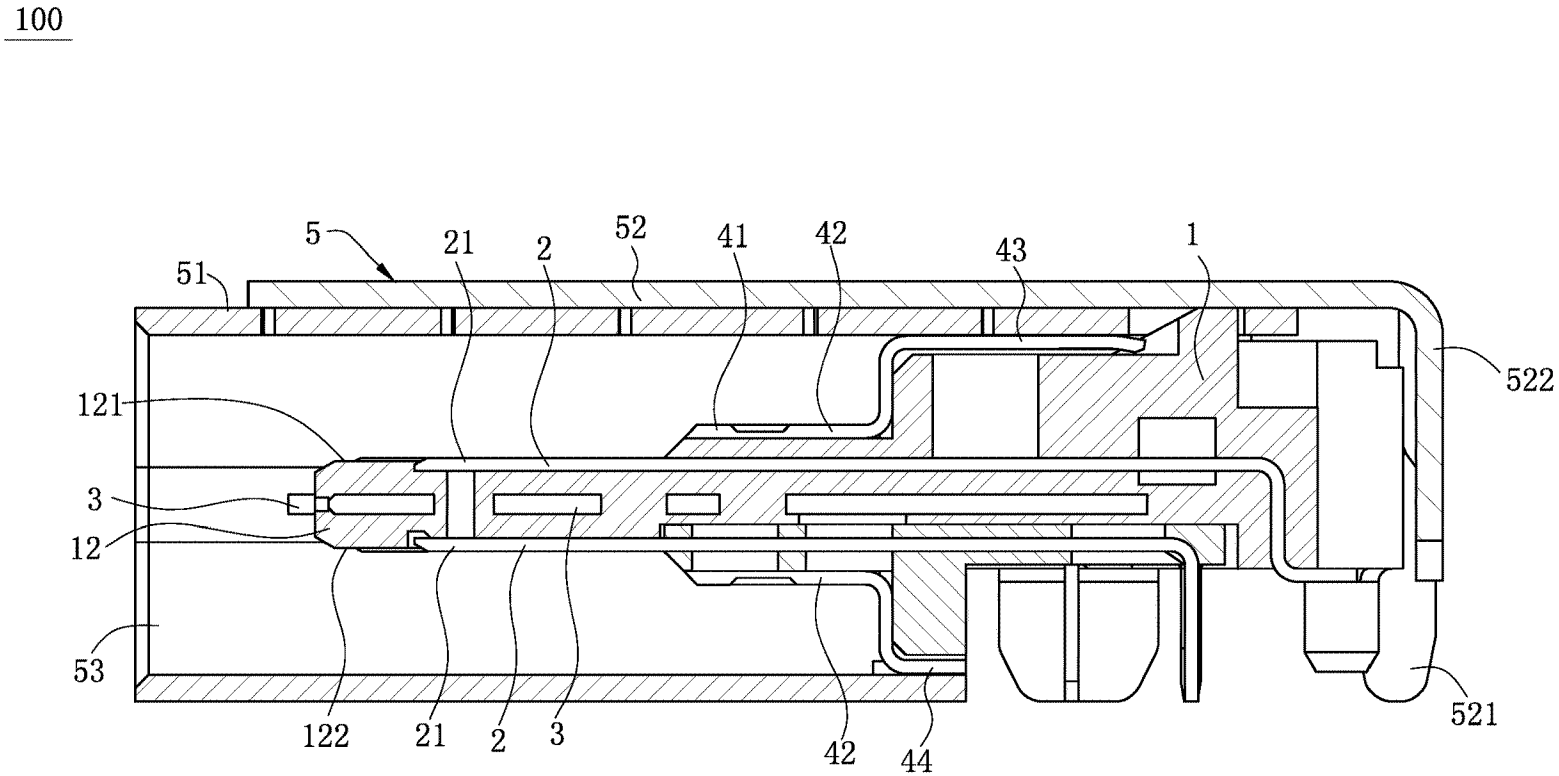
FIG. 22 is a sectional view of the electrical connector according to the fifth embodiment of the present invention.
Figure 23:
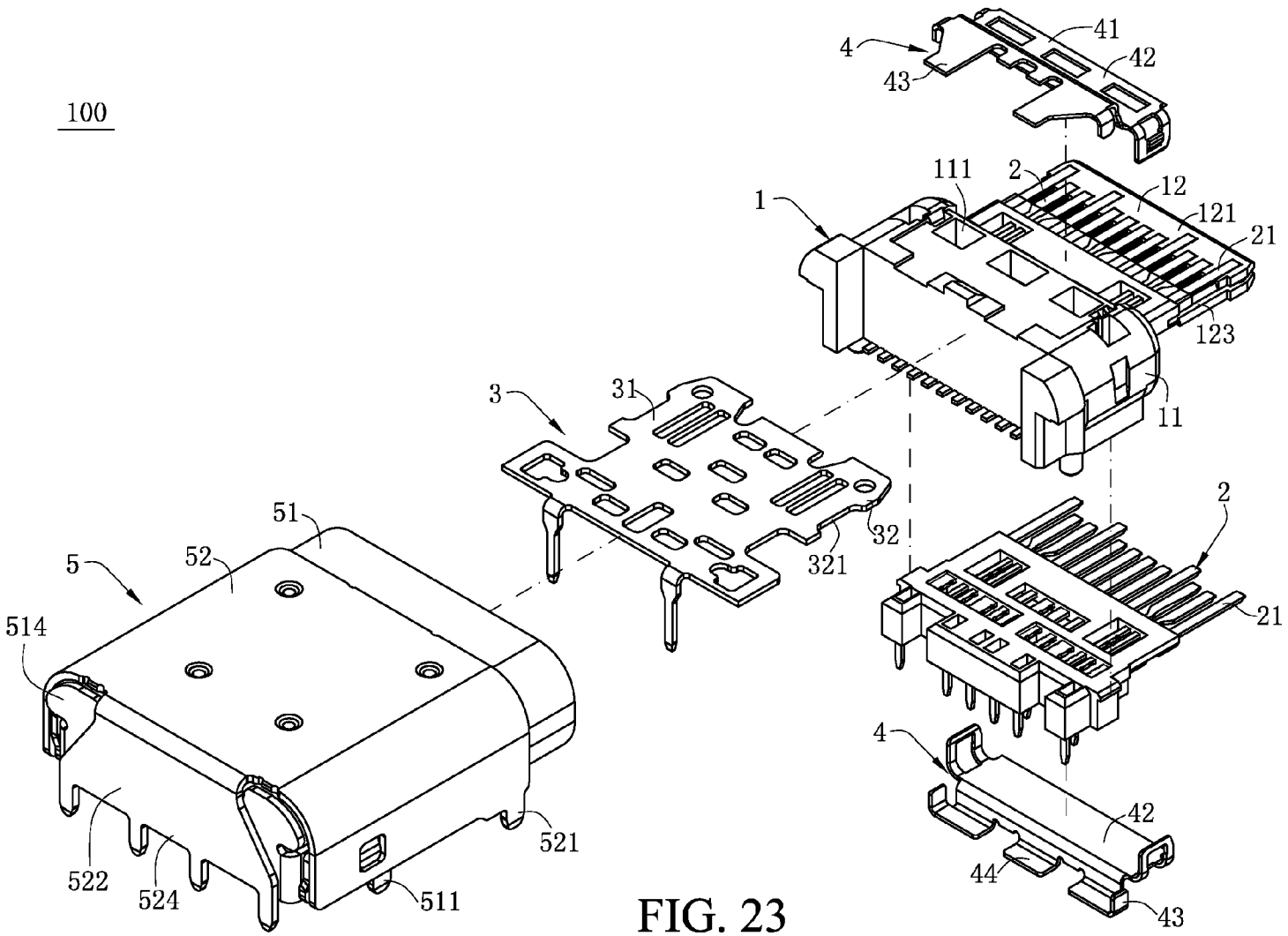
FIG. 23 is a three-dimensional exploded view of an electrical connector according to a sixth embodiment of the present invention.
Figure 24:
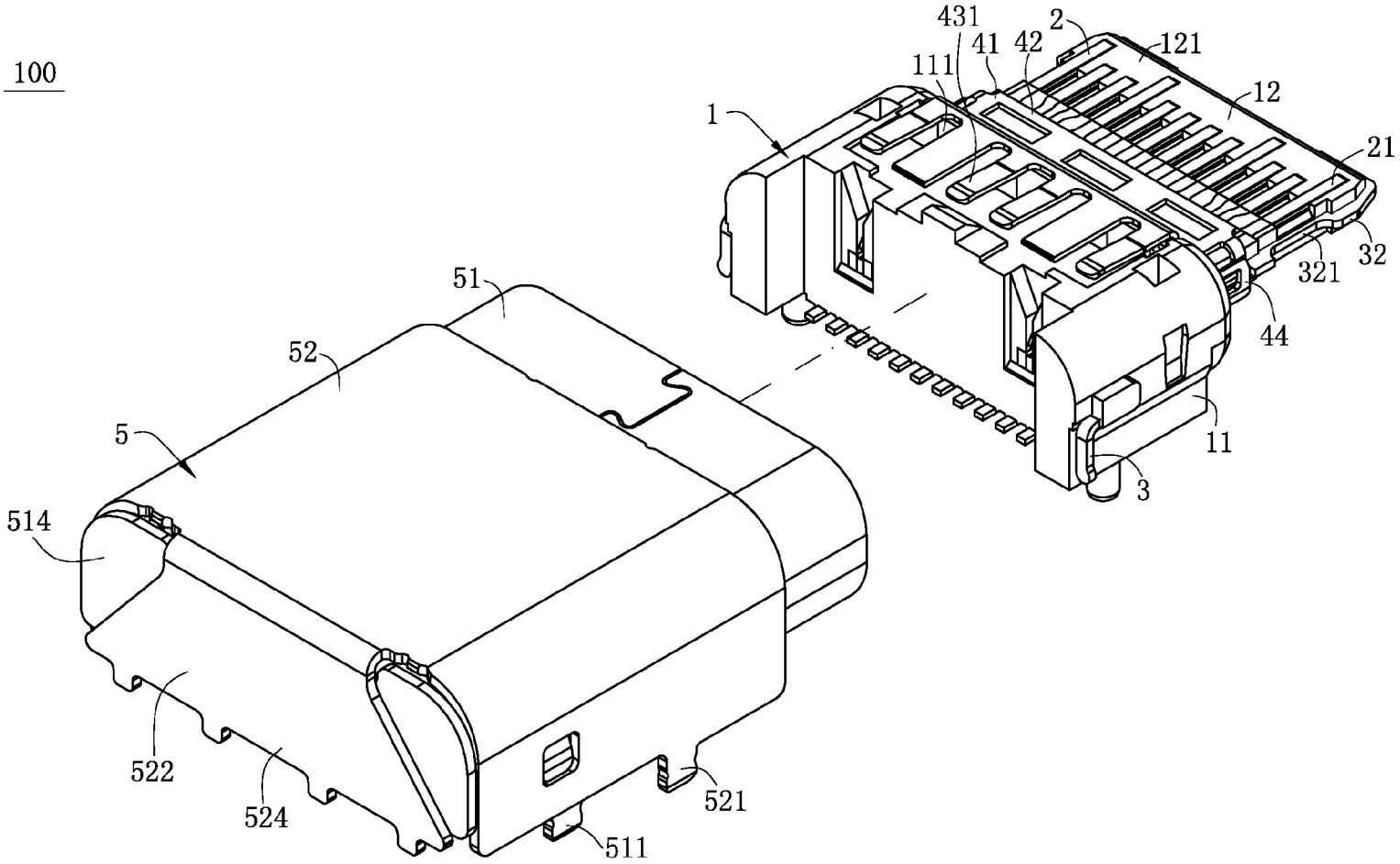
FIG. 24 is a partial three-dimensional exploded view of an electrical connector according to a seventh embodiment of the present invention.
Figure 25:
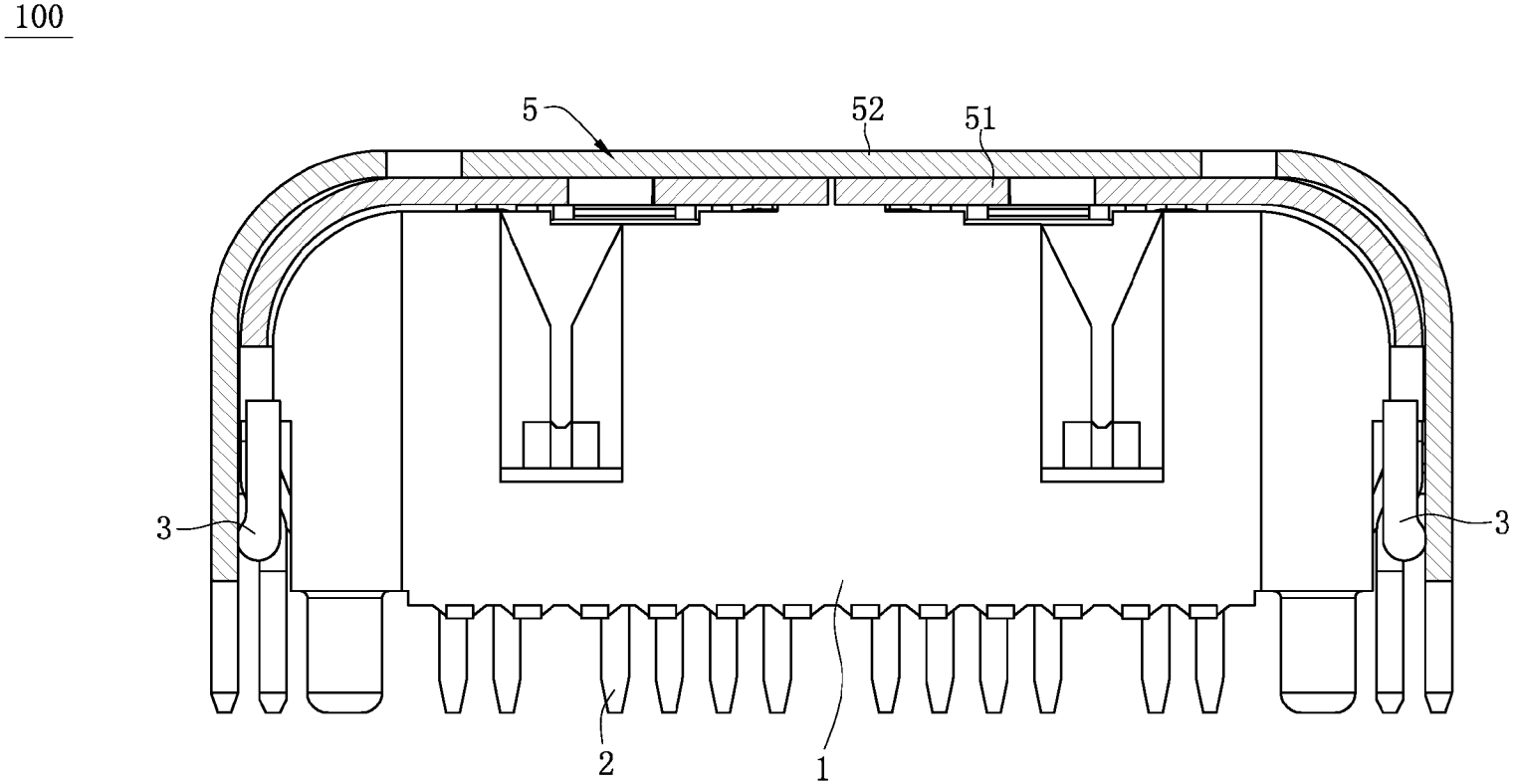
FIG. 25 is a sectional view of the electrical connector according to the seventh embodiment of the present invention.
Figure 26:
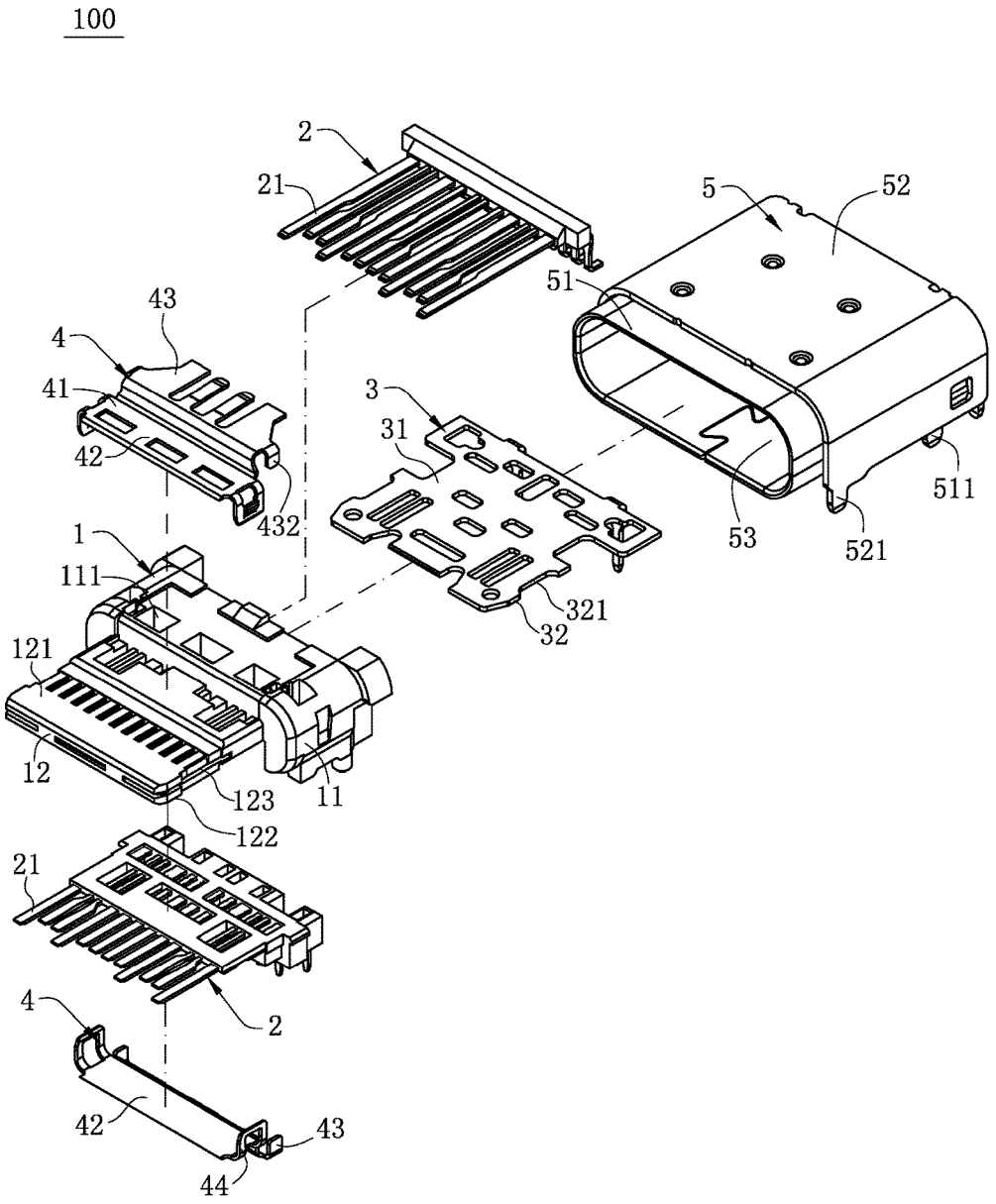
FIG. 26 is a three-dimensional exploded view of an electrical connector according to an eighth embodiment of the present invention.
Figure 27:
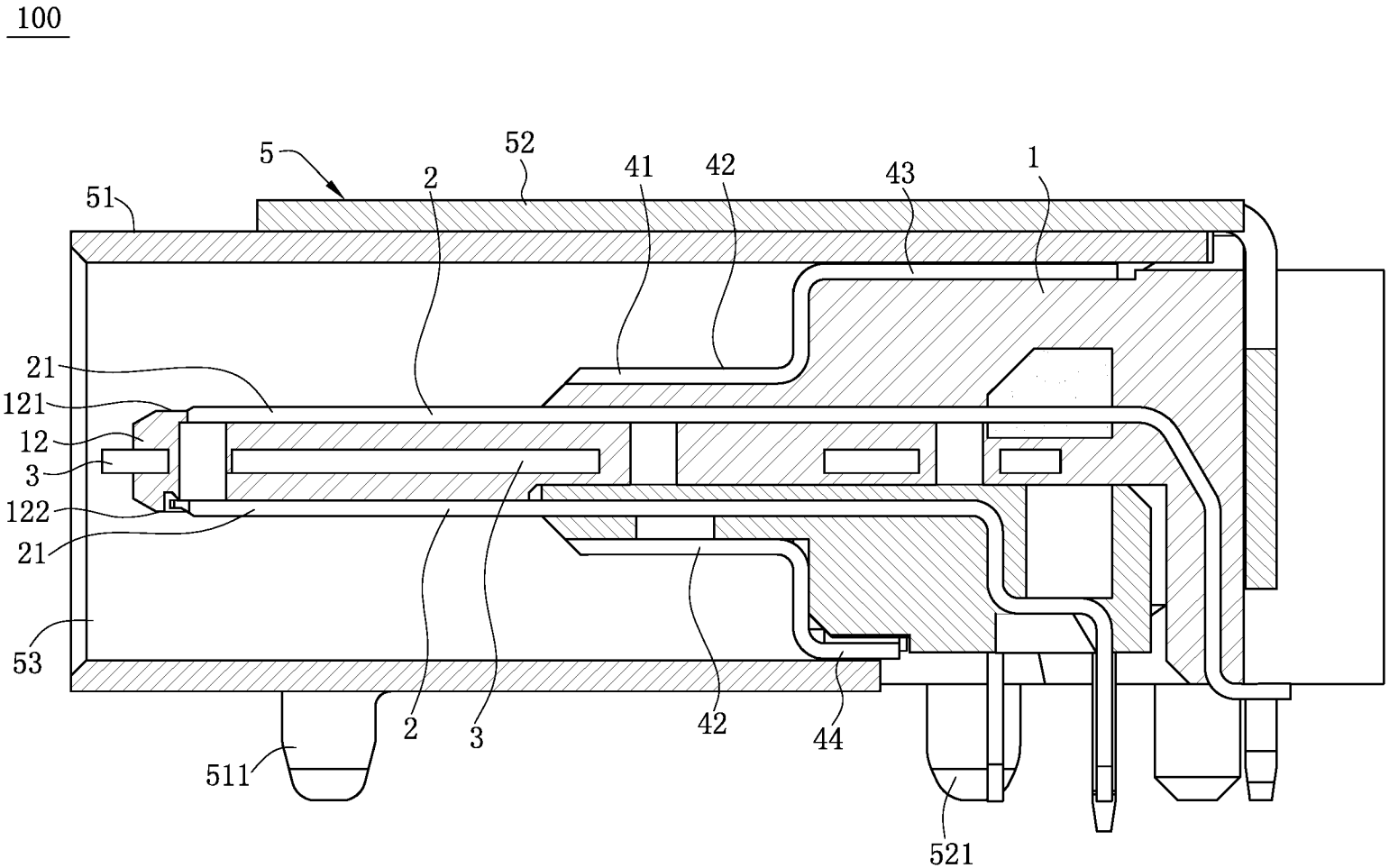
FIG. 27 is a sectional view of the electrical connector according to the eighth embodiment of the present invention.
Figure 28:
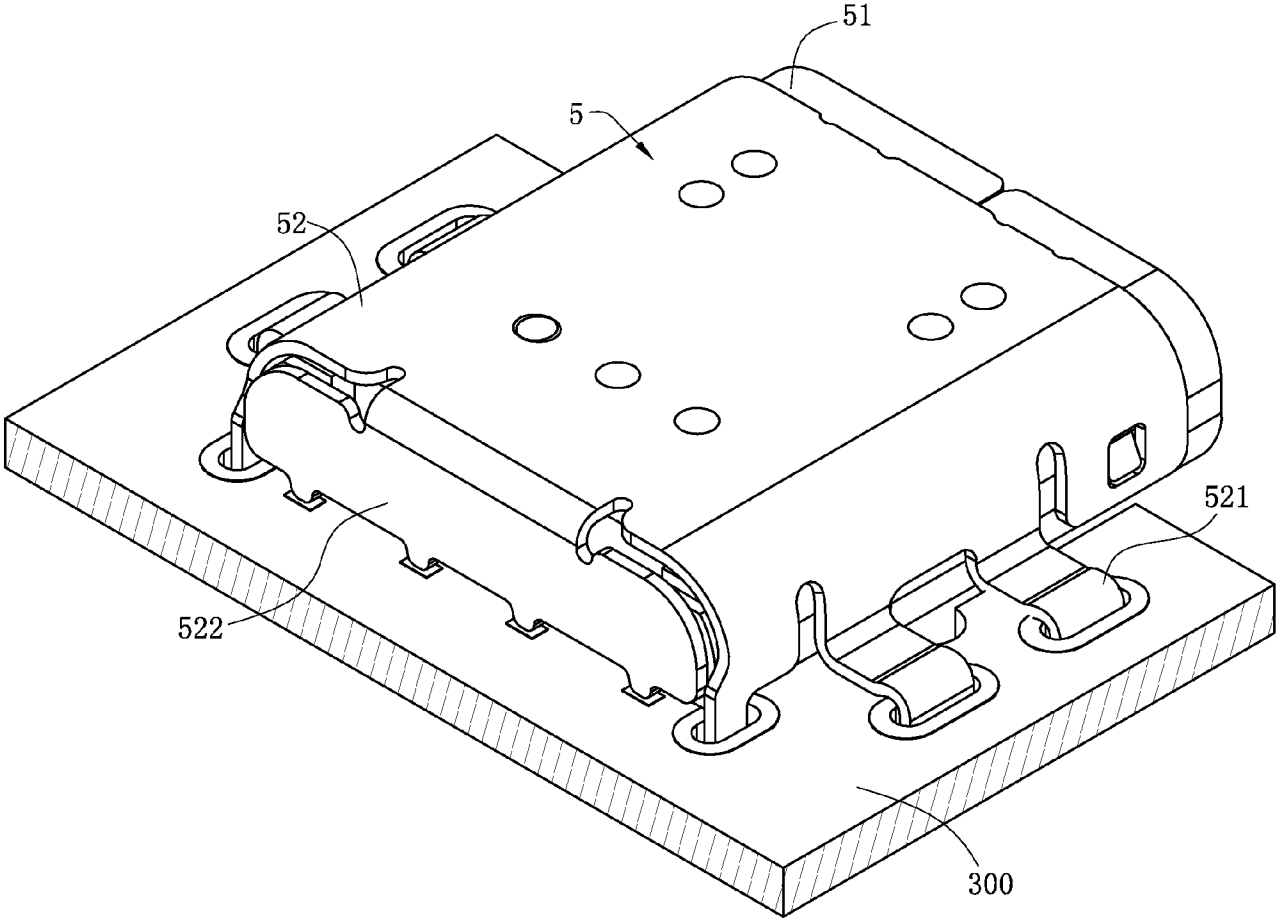
FIG. 28 is a three-dimensional assembly view of an electrical connector mounted on a circuit board according to a ninth embodiment of the present invention.
Figure 29:
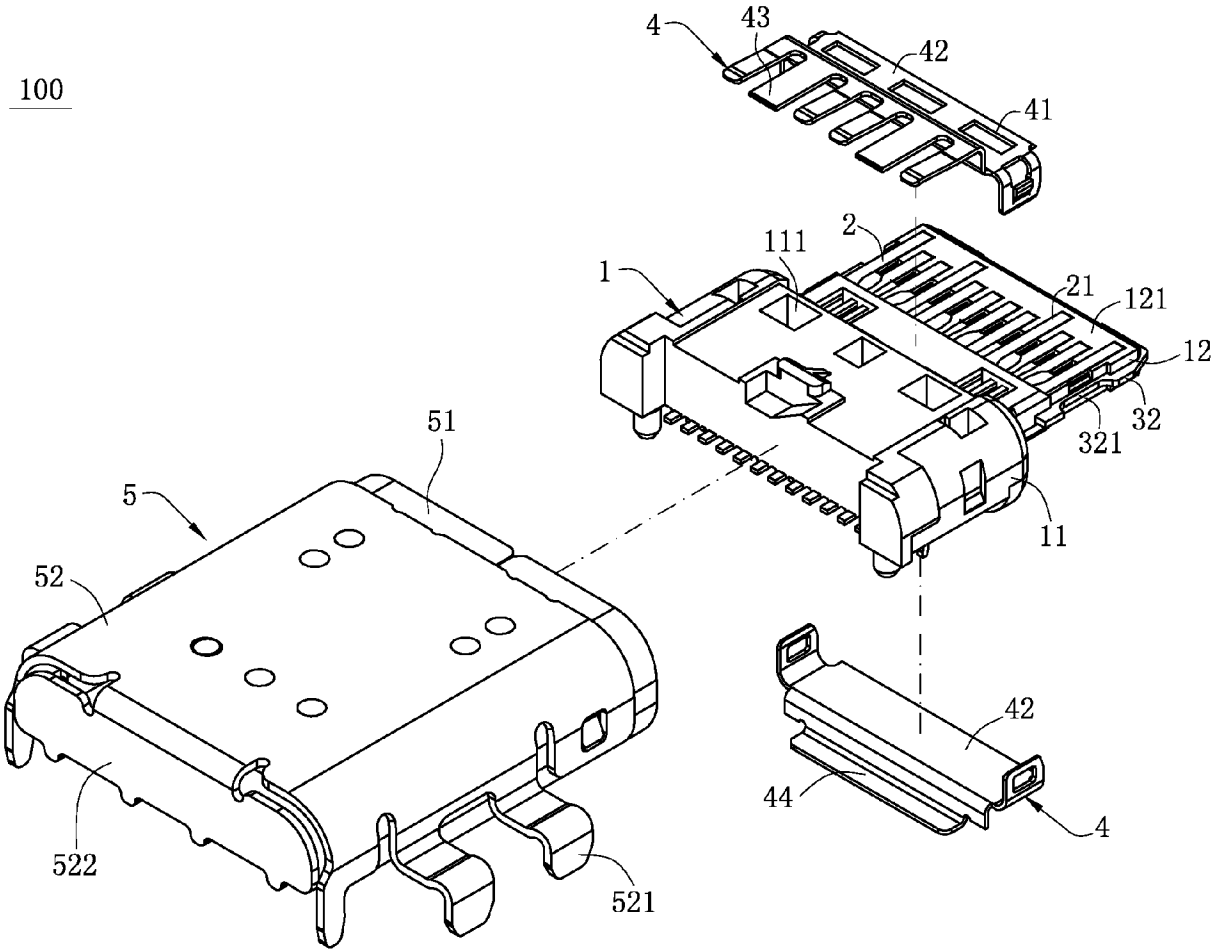
FIG. 29 is a three-dimensional exploded view of the electrical connector according to the ninth embodiment of the present invention.
Figure 30:
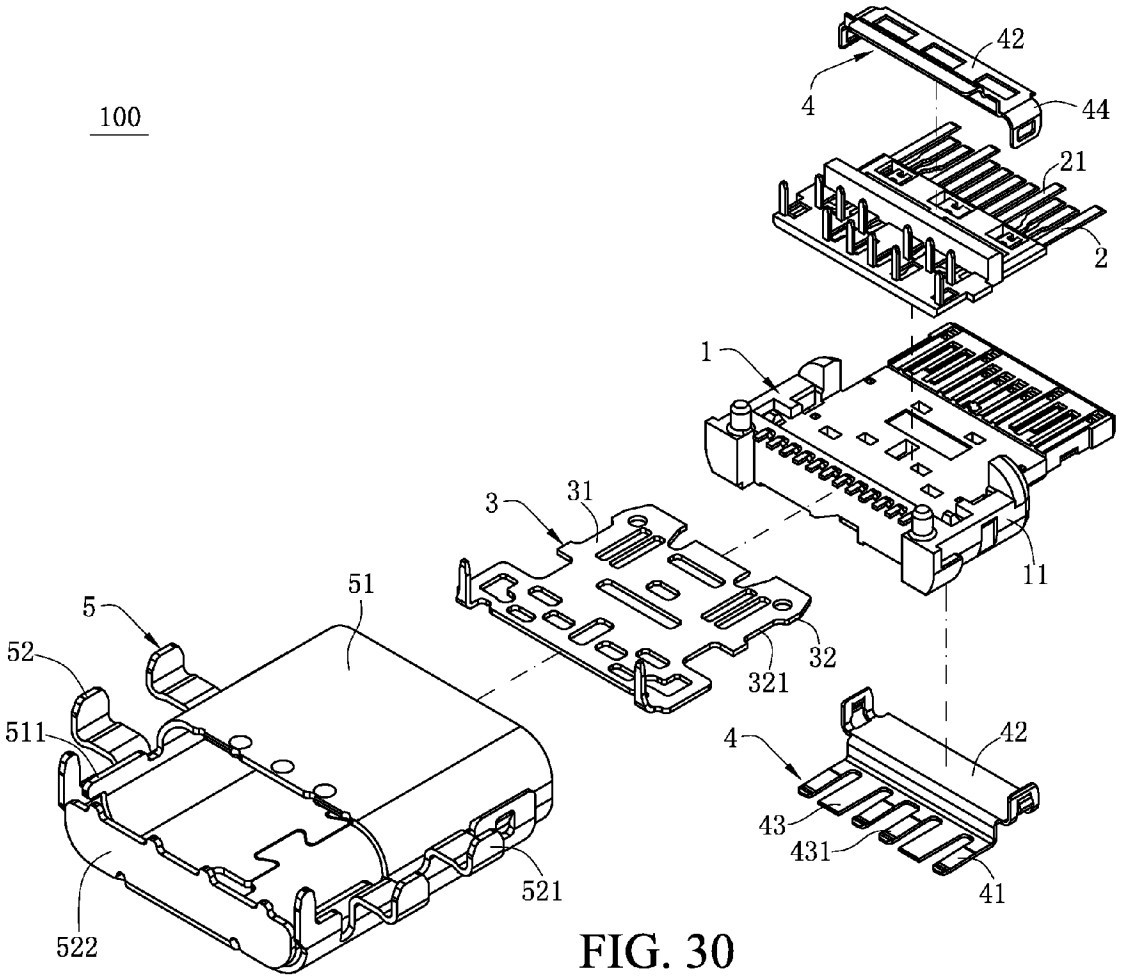
FIG. 30 is a three-dimensional exploded view of the electrical connector viewed from another viewing angle according to the ninth embodiment of the present invention.

As shown in FIG. 21 and FIG. 22, the electrical connector 100 is of a sinking board type, and the tongue 12 and the terminals 2 are all located above the circuit board 300.

Figure 31:
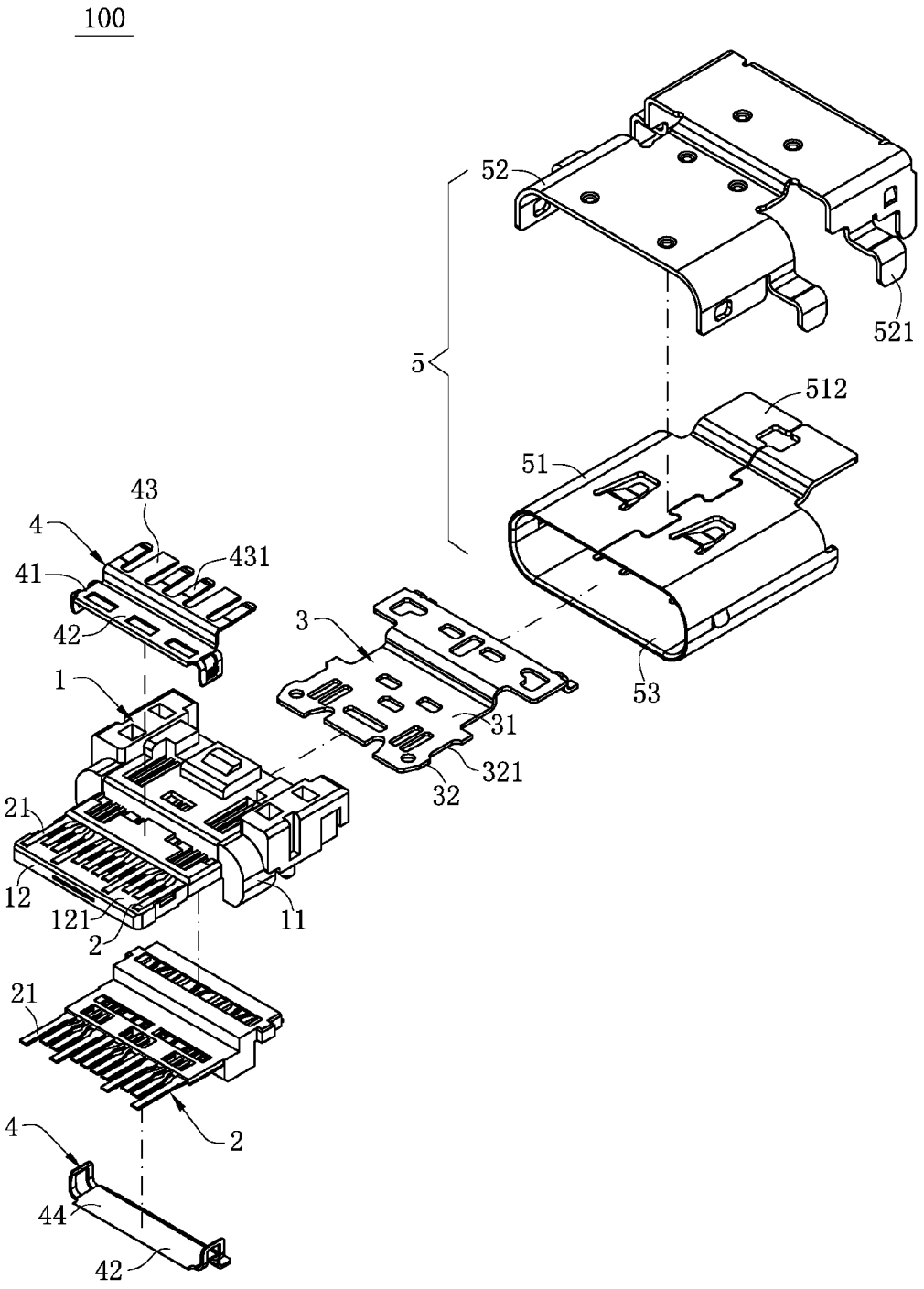
FIG. 31 is a three-dimensional exploded view of an electrical connector according to a tenth embodiment of the present invention.
Figure 32:
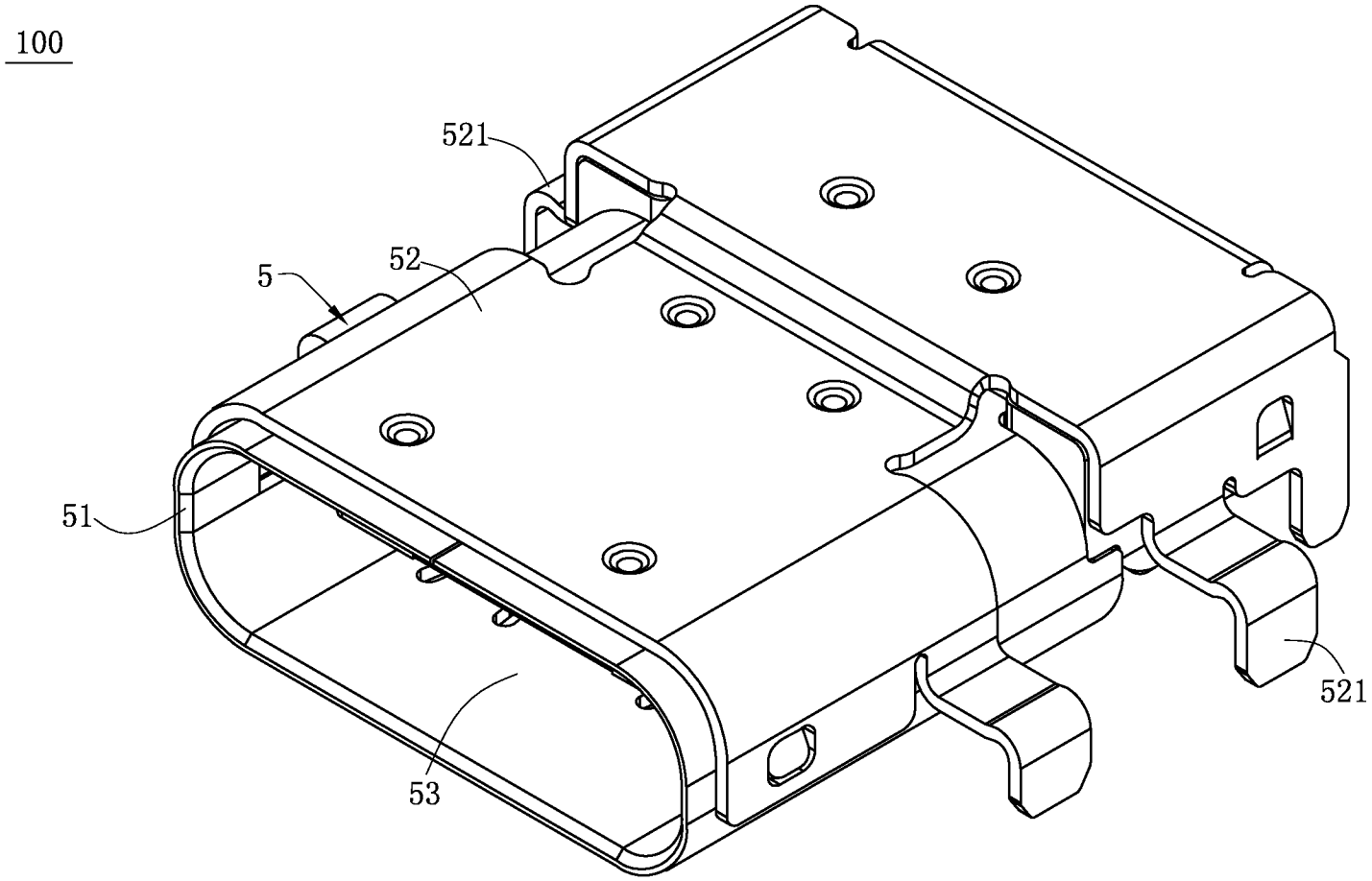
FIG. 32 is a three-dimensional assembly view of the electrical connector according to the tenth embodiment of the present invention.
Figure 33:
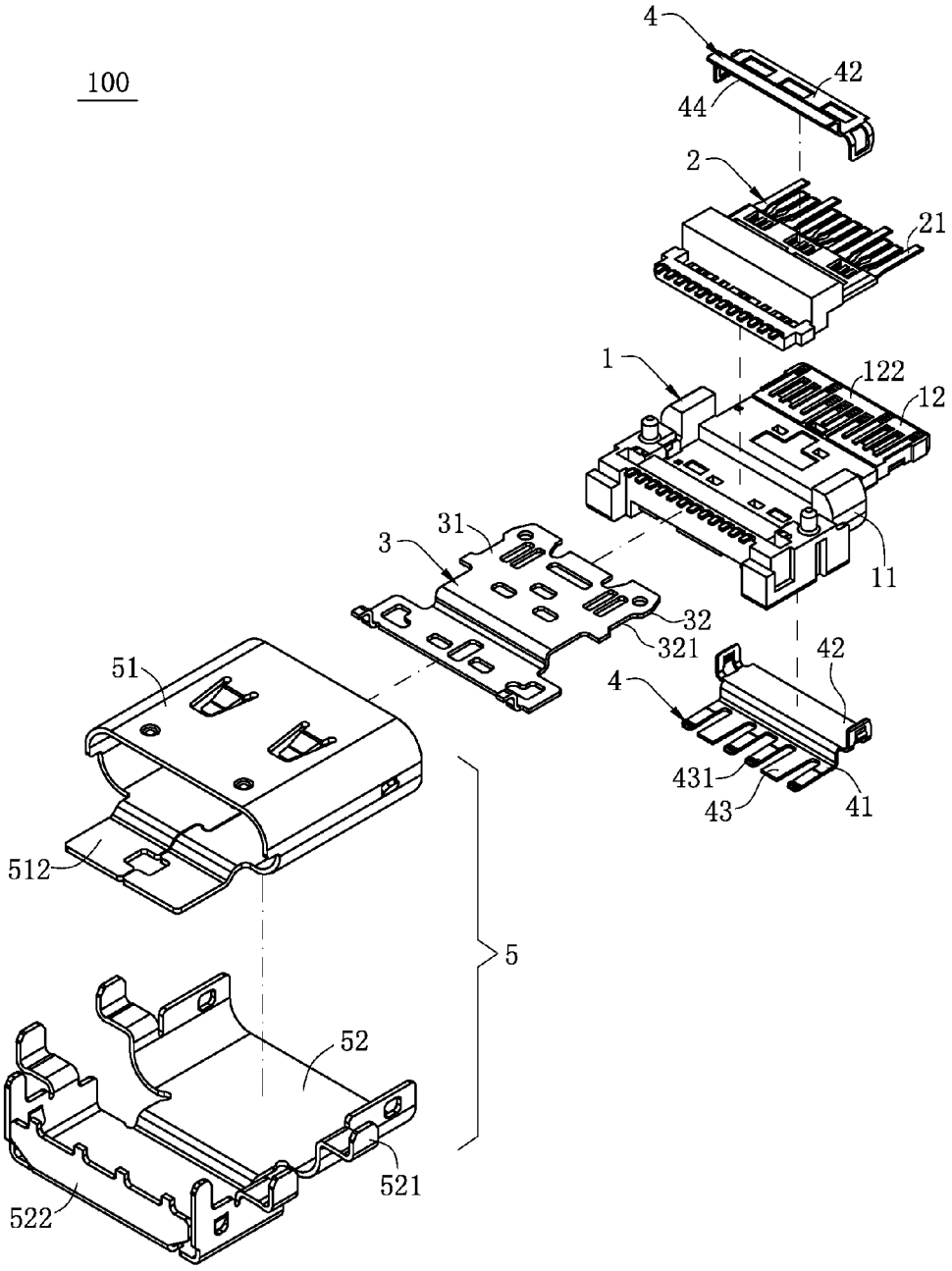
FIG. 33 is a three-dimensional exploded view of the electrical connector viewed from another viewing angle according to the tenth embodiment of the present invention.
Figure 34:
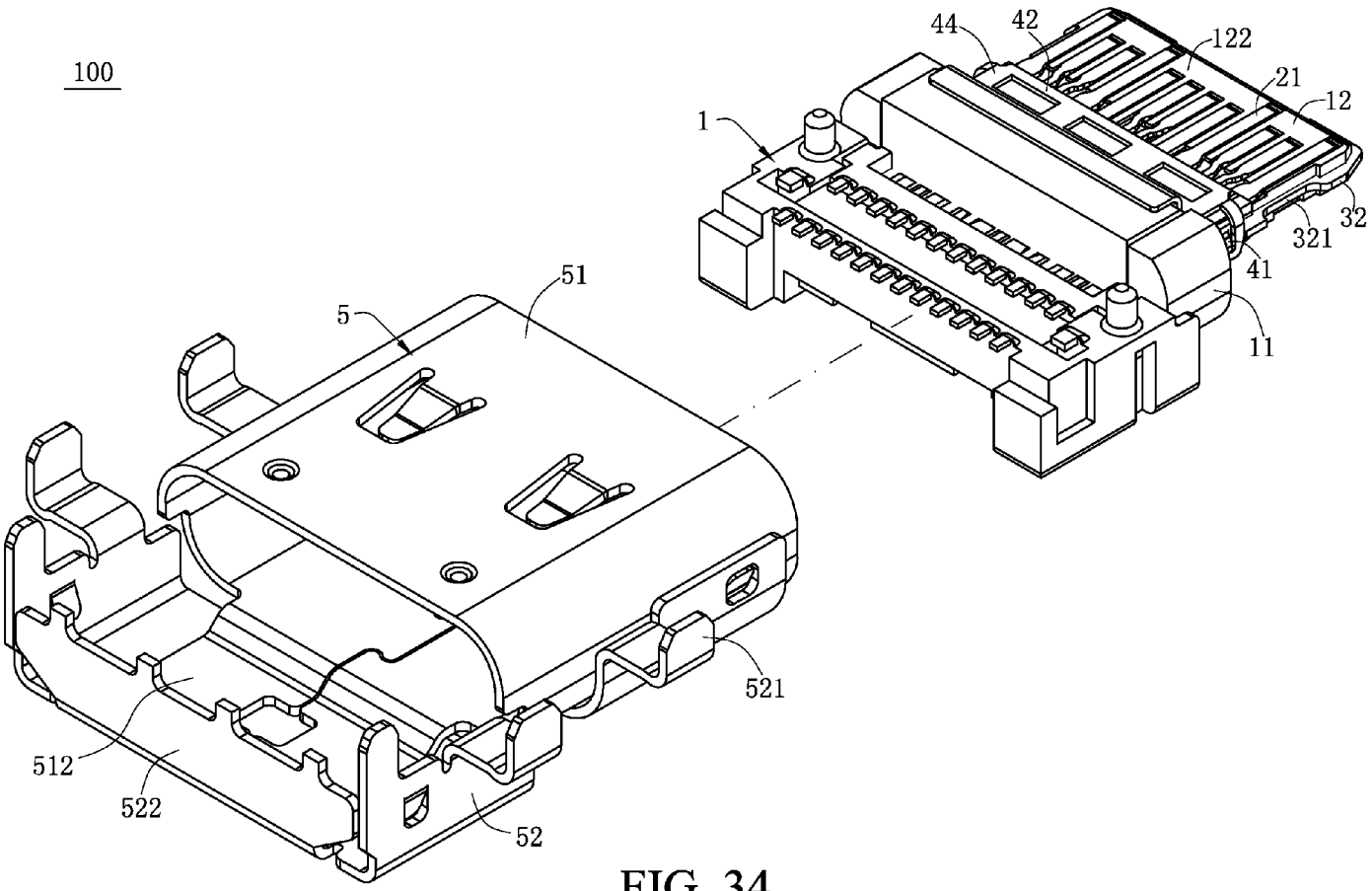
FIG. 34 is a partial three-dimensional exploded view of the electrical connector according to the tenth embodiment of the present invention.
Figure 35:
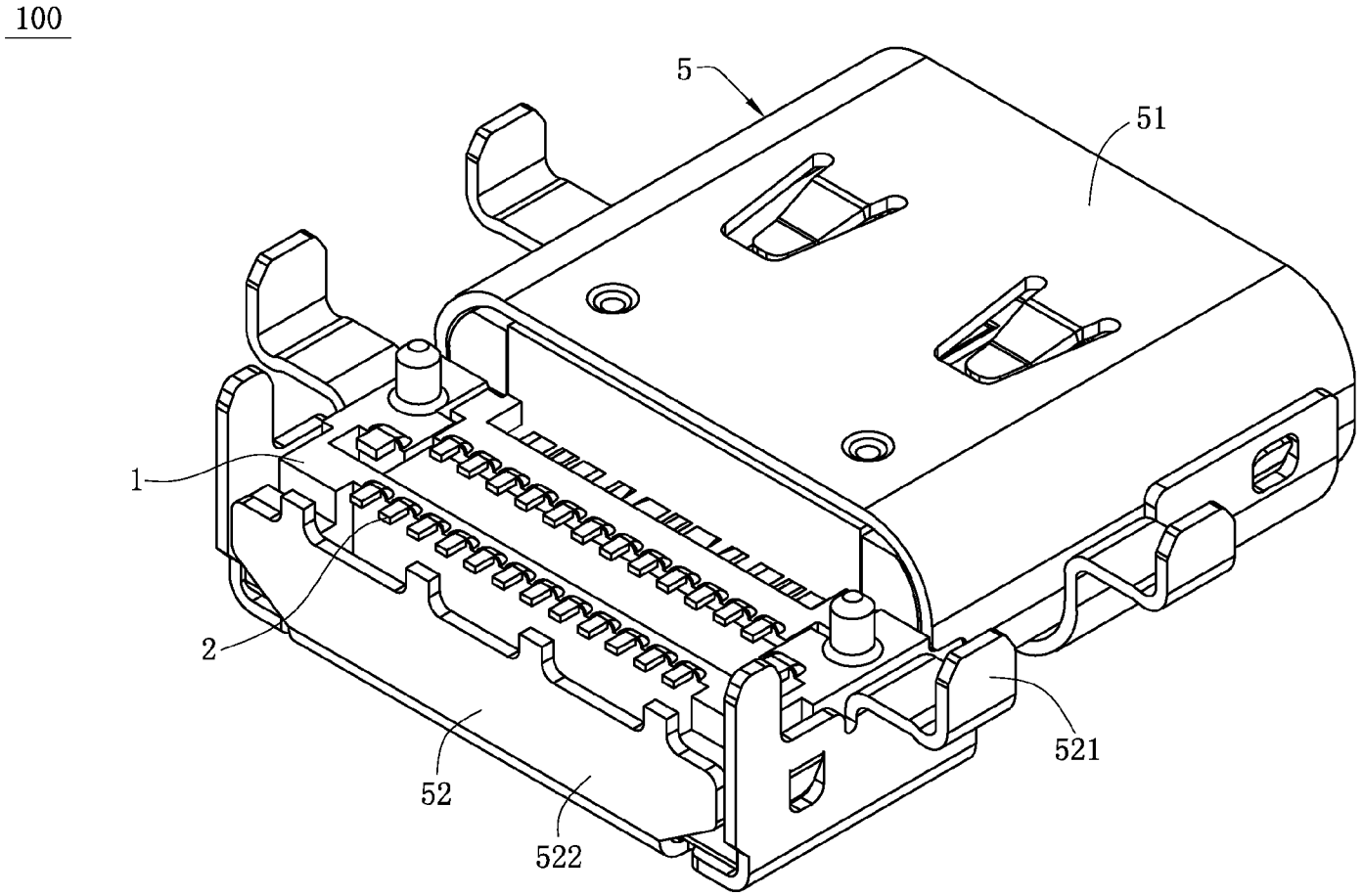
FIG. 35 is a three-dimensional assembly view of the electrical connector viewed from another viewing angle according to the tenth embodiment of the present invention.
Figure 36:
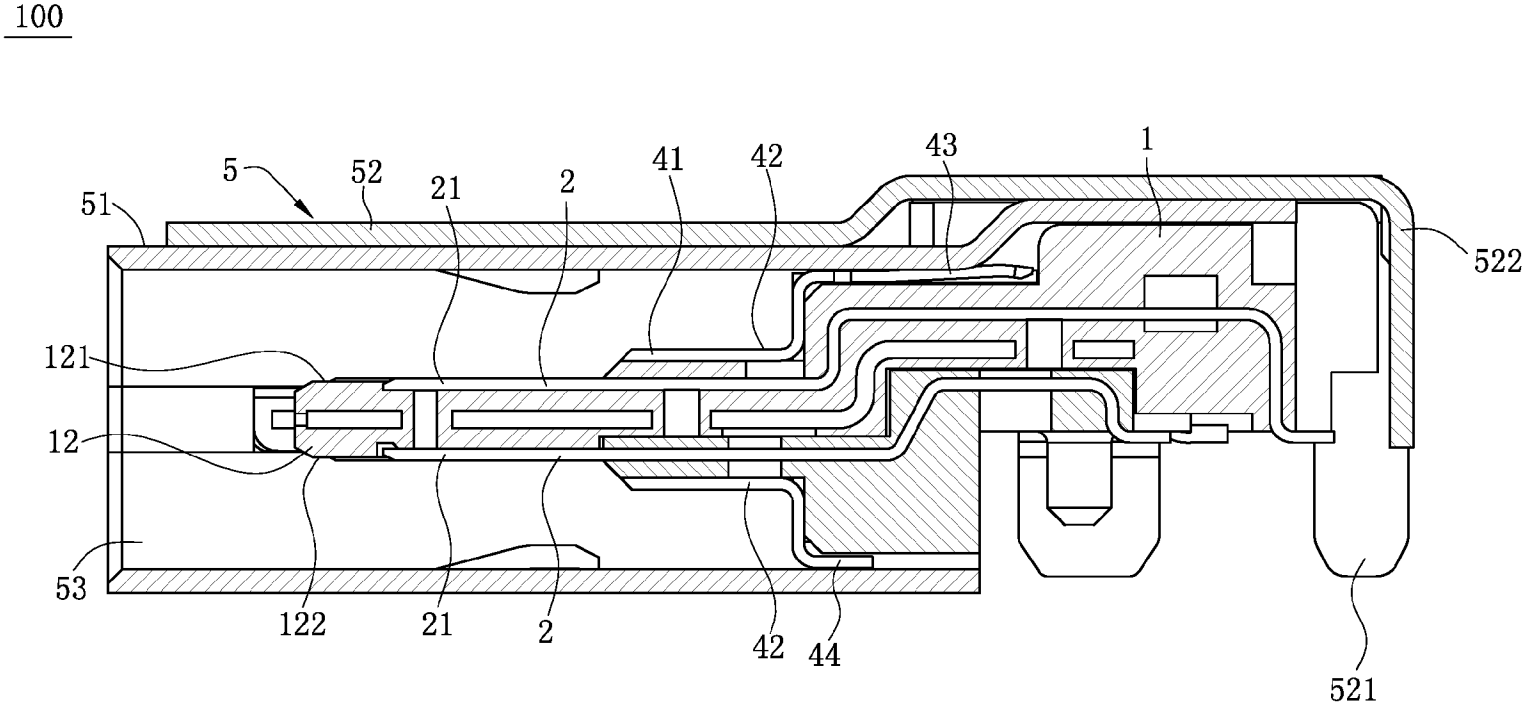
FIG. 36 is a sectional view of the electrical connector according to the tenth embodiment of the present invention.
Figure 37:
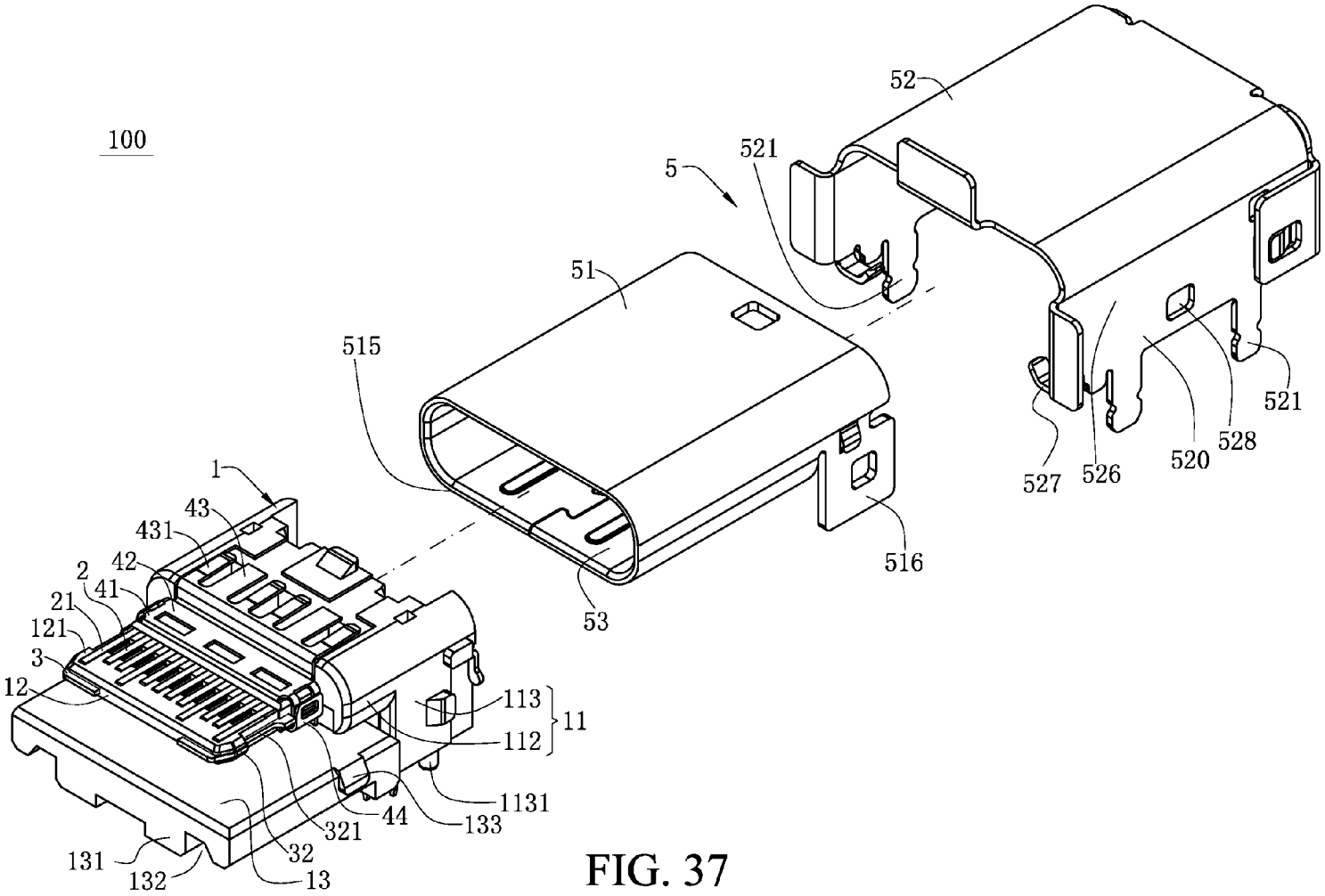
FIG. 37 is a partial three-dimensional exploded view of an electrical connector according to an eleventh embodiment of the present invention.
Figure 38:
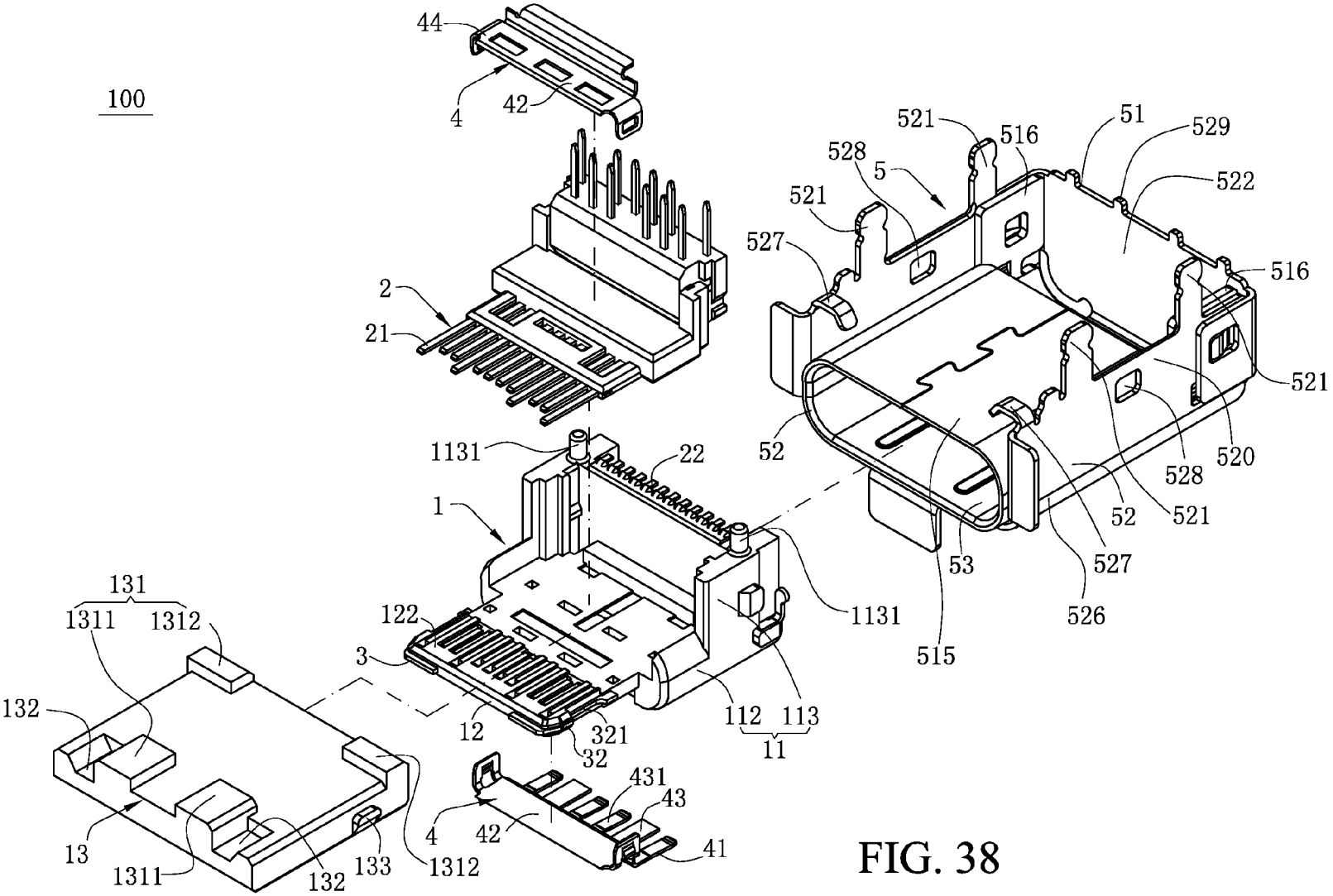
FIG. 38 is a three-dimensional exploded view of the electrical connector according to the eleventh embodiment of the present invention.
Figure 39:
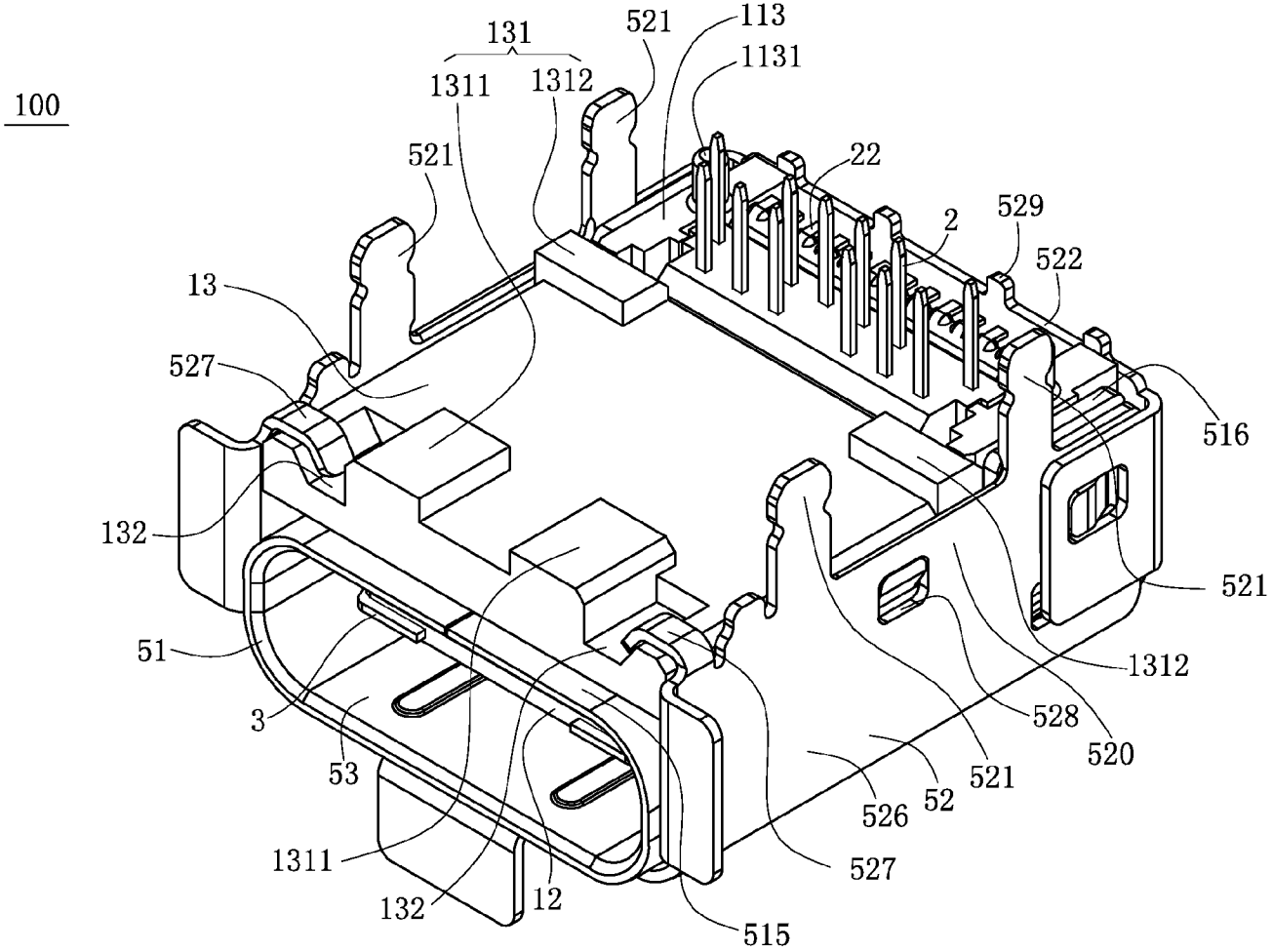
FIG. 39 is a three-dimensional assembly view of the electrical connector according to the eleventh embodiment of the present invention.
Figure 40:
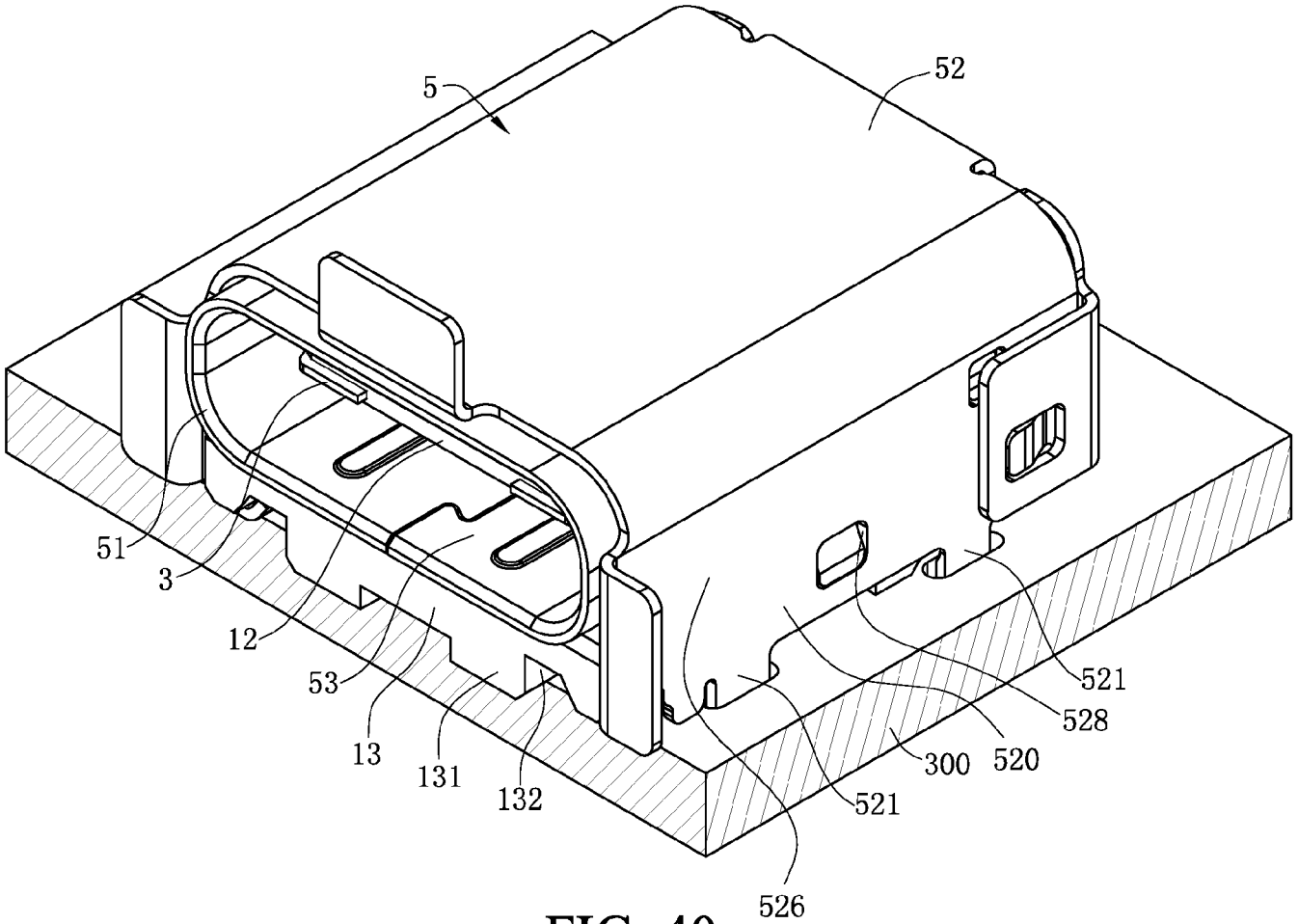
FIG. 40 is a three-dimensional assembly view of the electrical connector mounted on a circuit board according to the eleventh embodiment of the present invention.
Figure 41:
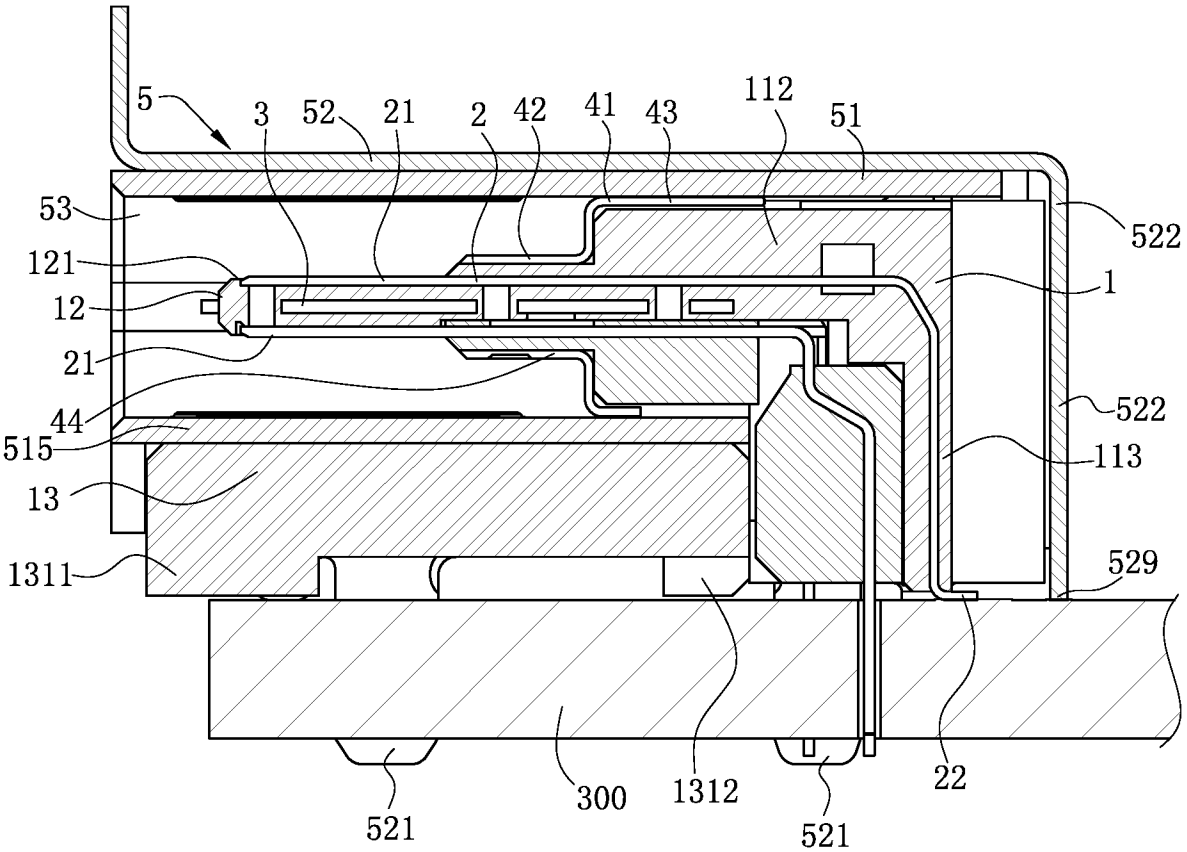
FIG. 41 is a sectional view of the electrical connector mounted on the circuit board according to the eleventh embodiment of the present invention.
Figure 42:
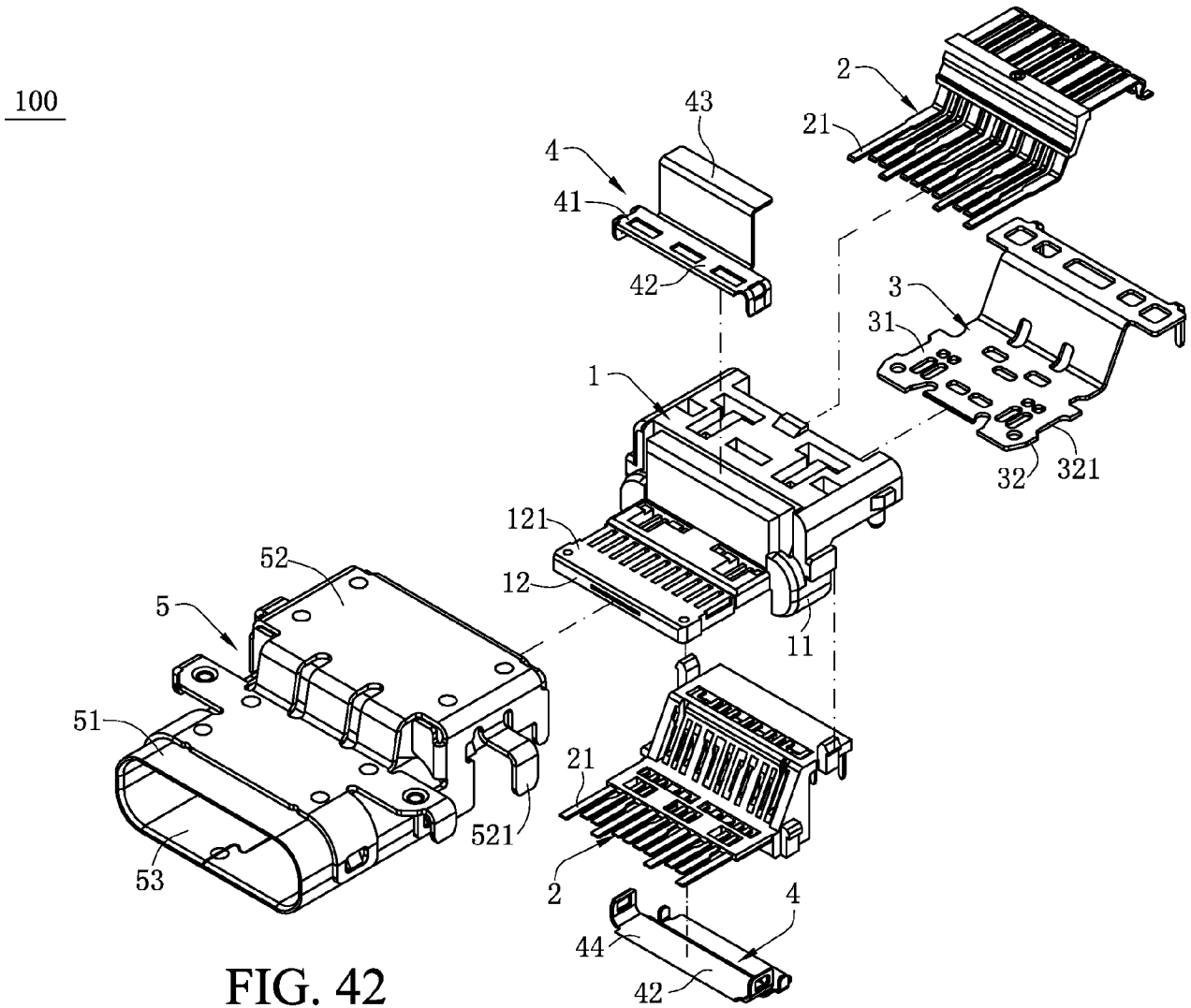
FIG. 42 is a three-dimensional exploded view of an electrical connector according to a twelfth embodiment of the present invention.
Figure 43:
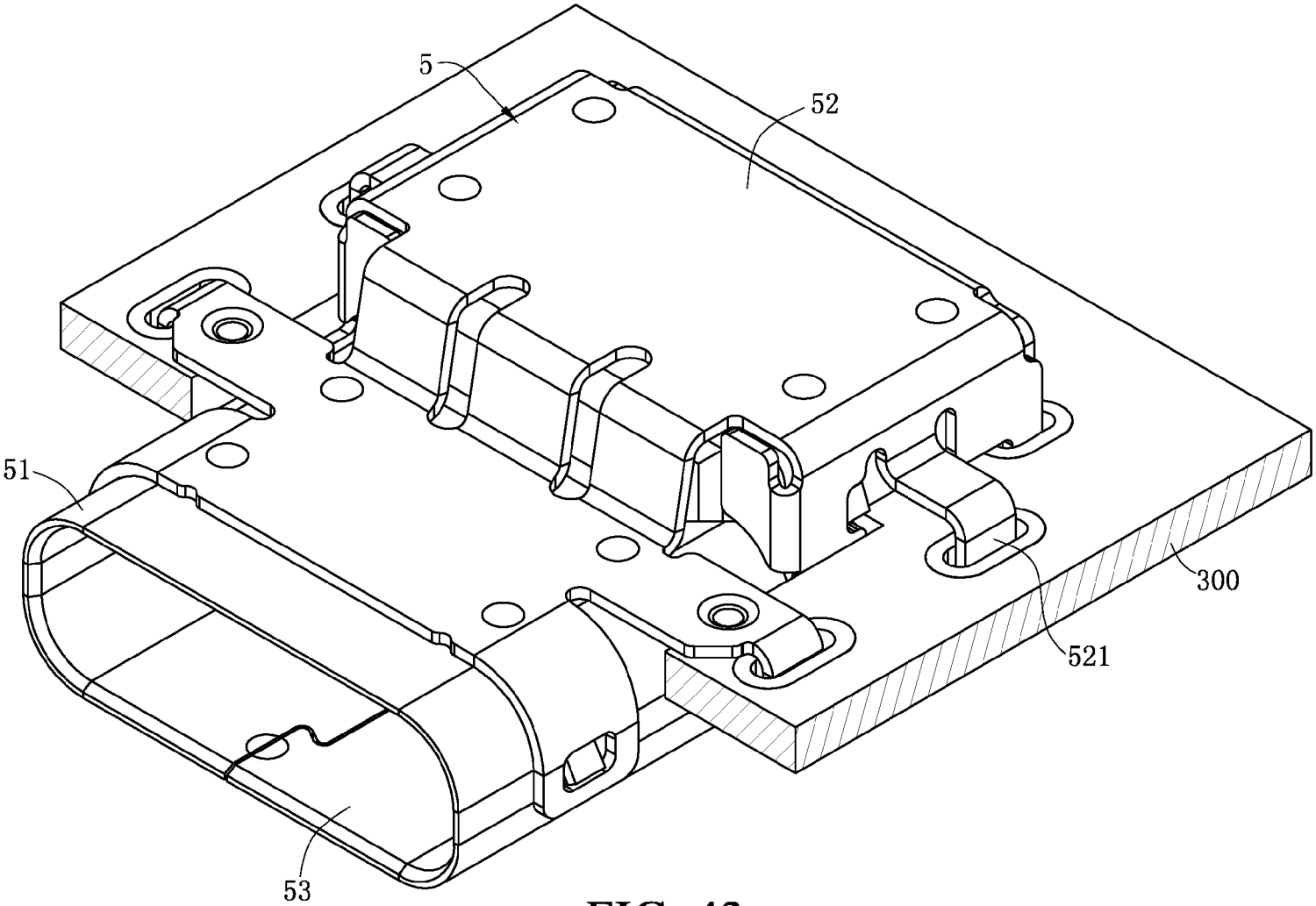
FIG. 43 is a three-dimensional assembly view of the electrical connector mounted on a circuit board according to the twelfth embodiment of the present invention.
Figure 44:
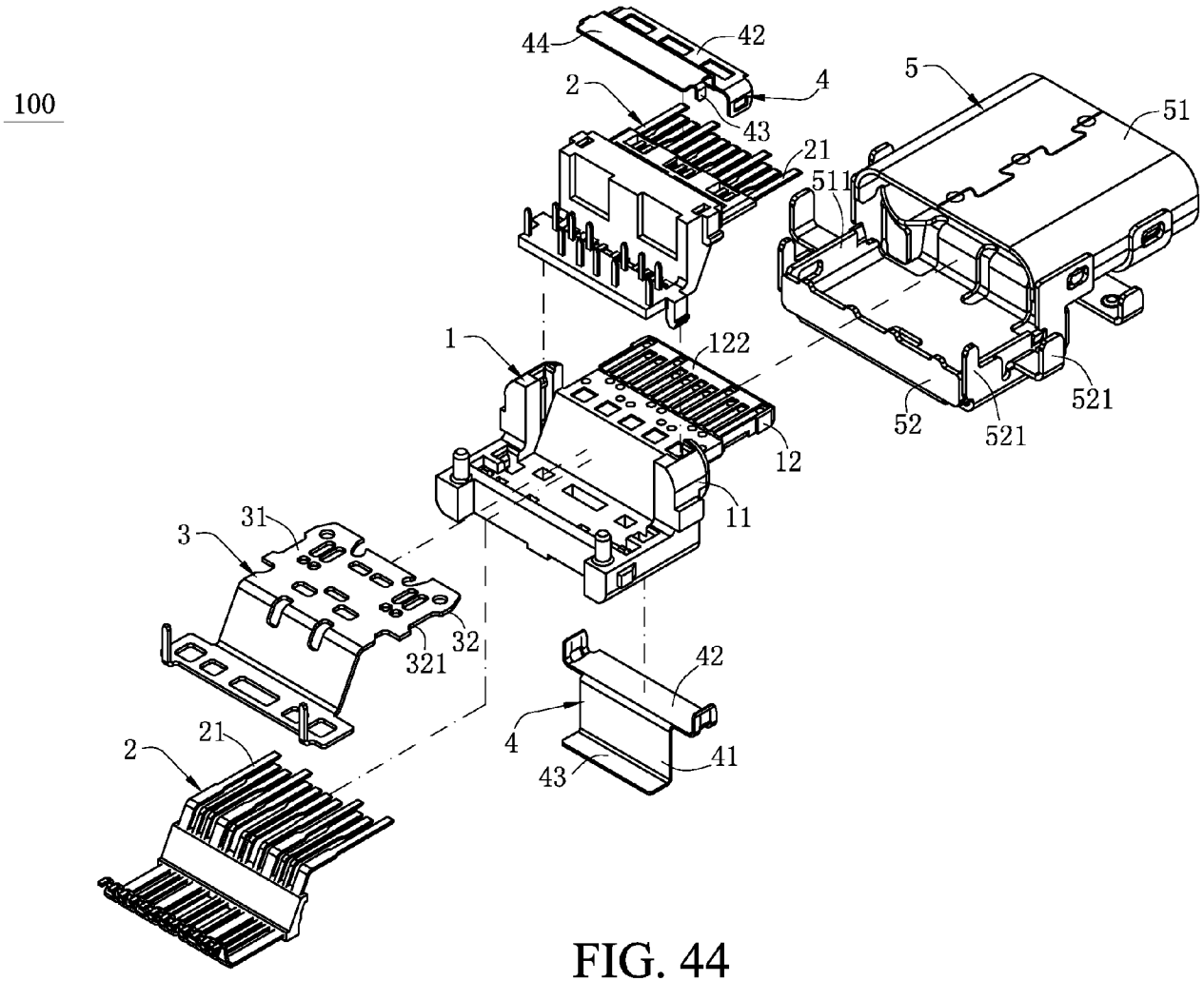
FIG. 44 is a three-dimensional exploded view of the electrical connector viewed from another viewing angle according to the twelfth embodiment of the present invention.
Figure 45:
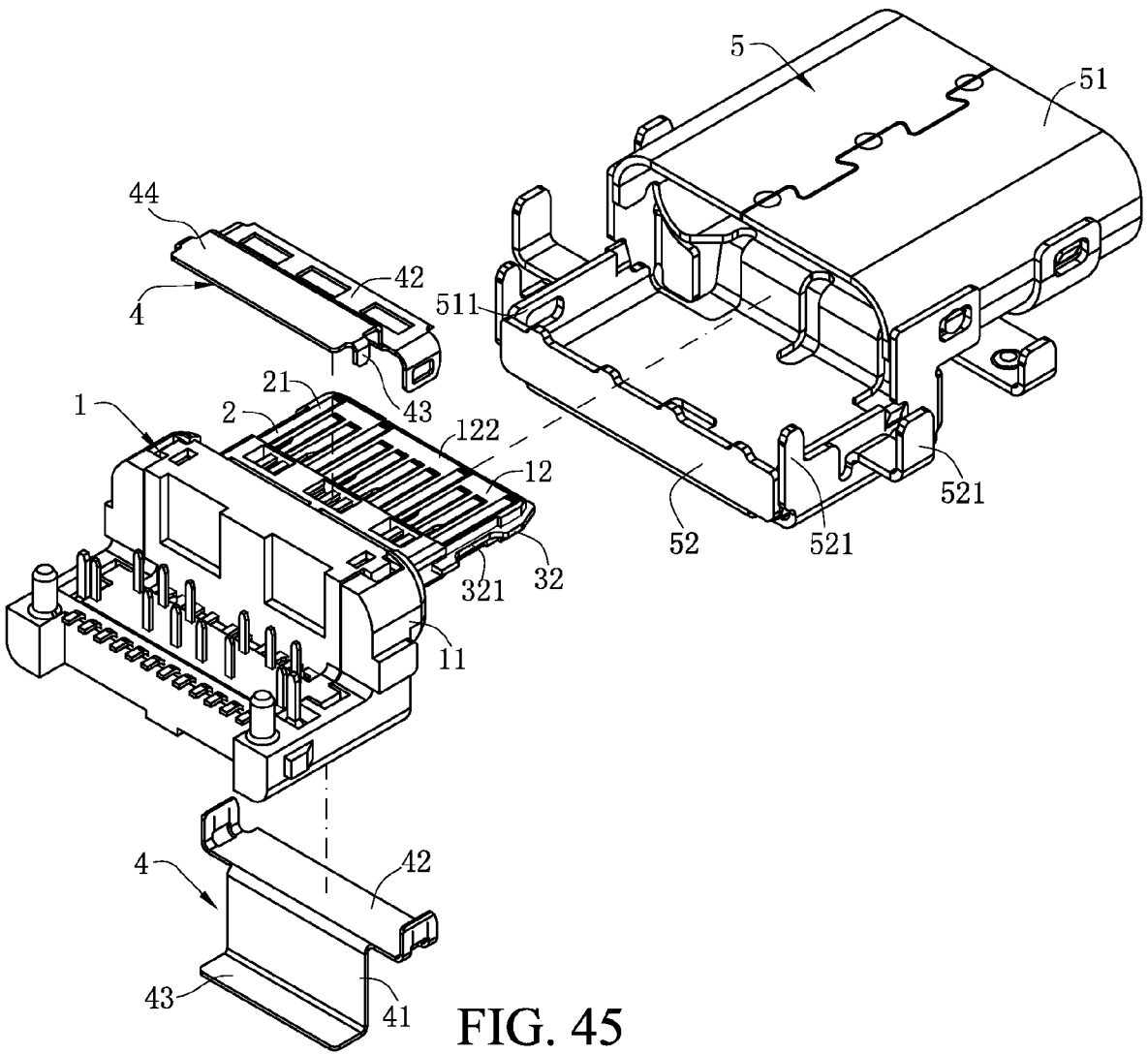
FIG. 45 is a partial three-dimensional exploded view of the electrical connector viewed from another viewing angle according to the twelfth embodiment of the present invention.
Figure 46:
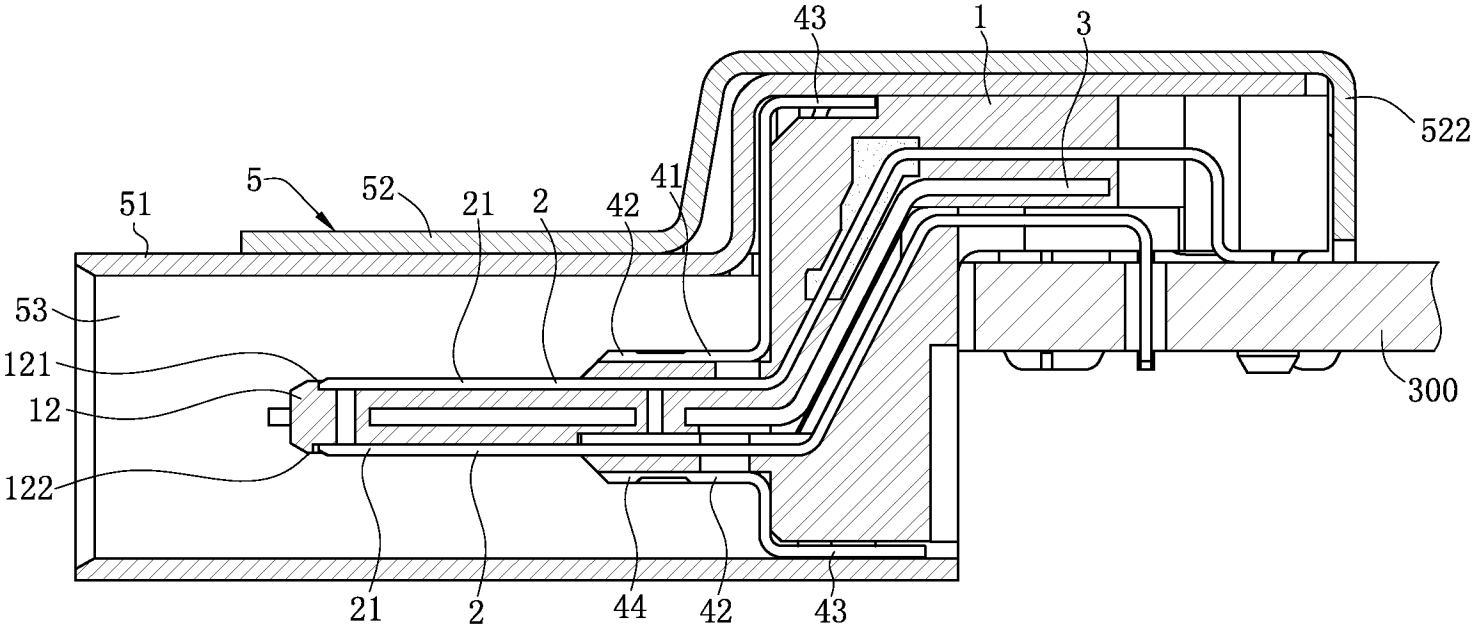
FIG. 46 is a sectional view of the electrical connector according to the twelfth embodiment of the present invention.
Figure 47:
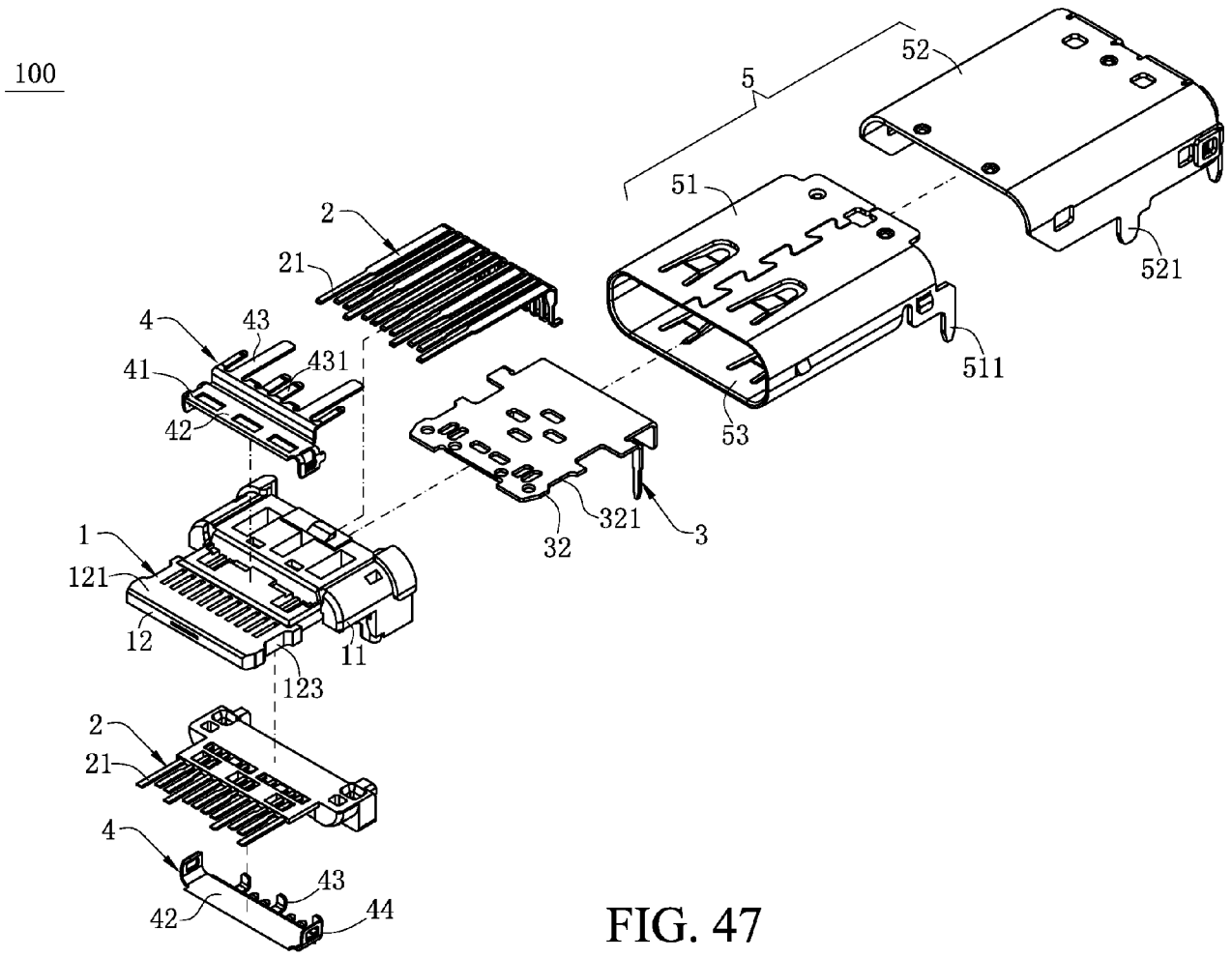
FIG. 47 is a three-dimensional exploded view of an electrical connector according to a thirteenth embodiment of the present invention.

As shown in FIG. 31 and FIG. 36, the electrical connector 100 is also of a sinking board type, and a part of the tongue 12 and the lower row of terminals 2 are lower than the circuit board 300. A height difference is formed between the front segment and the rear segment of the shielding casing 52, the second soldering pins 521 are four in number, and are separately disposed at two sides of the shielding casing 52, and each of the front segment and the rear segment of the shielding casing 52 is provided with two second soldering pins. The sinking board is low, and structures of the electrical connector 100 fixed onto the circuit board 300 are less than those in the on-board type. Therefore, in order to improve the strength, welding is performed between the interior casing 51 and the shielding casing 52 by means of point welding, so as to further firmly fix the interior casing 51 and the shielding casing 52. Disposition of the four second soldering pins 521 also further ensures that the electrical connector 100 is stably welded to the circuit board 300.

As shown in FIG. 37 to FIG. 41, the electrical connector 100 is used in a desktop host. Because of disposition of external interfaces, the center of the electrical connector 100 is at a long distance from the upper surface of the circuit board 300, and the welding portions of the multiple terminals 2 need to be designed to be very long. In the present embodiments, the interior casing 51 is not provided with the first soldering pins 511 as described in the above embodiment, and two opposite sides of the interior casing 51 are provided with extending sheets 516 formed in a downward extending manner. The shielding casing 52 is provided with the soldering pins 521 soldered on the circuit board 300, and correspondingly, the soldering pins 521 also need to be designed to be very long, so that it can be satisfied that the electrical connector 100 is highly disposed on the upper surface of the circuit board 300. In order that the electrical connector 100 is stably mounted onto the circuit board 300, and the electrical connector 100 is not slanted when the mating connector 200 is inserted into the electrical connector 100, a heightening block is added between the electrical connector 100 and the circuit board 300, and the heightening block is used for supporting the electrical connector 100.

The base portion 11 includes a connecting portion 112 formed by extending backward from the tongue 12 and an elevated portion 113 formed by extending backward from the connecting portion 112. A bottom surface of the elevated portion 113 is lower than a bottom surface of the connecting portion 112, and the bottom surface of the elevated portion 113 protrudes downward to form two symmetric positioning posts 1131. The two positioning posts 1131 penetrate through the circuit board 300 to fix the insulation body 1 onto the circuit board 300.

The shielding casing 52 has two side walls 526 opposite to each other. Each side wall 526 extends downward to form a stop wall 520, and each stop wall 520 extends downward to form two soldering pins 521 soldered onto the circuit board 300. The four soldering pins 521 are arranged in two rows in the front-rear direction. Preferably, the soldering pins 521 are located in front of the positioning posts 1131. Furthermore, each stop wall 520 is provided with a fastening portion 527 in front of the soldering pins 521 in a front row, and a buckling hole 528 between upward extending lines of the soldering pins 521 in the front row and the rear row. The shielding casing 52 is also provided with a rear wall 522 located behind the elevated portion 113. The lower edge of the rear wall 522 extends downward to form four supporting legs 529 arranged in a row to abut the circuit board 300. In the present embodiments, the terminals 2 in the upper row have a row of soldering portions 22 extending out of the bottom surface of the elevated portion 113. The soldering portions 22 are soldered onto the circuit board 300 in an SMT (Surface Mount Technology) manner, and are located between the positioning posts 1131 and the supporting legs 529.

The interior casing 51 has a bottom wall 515 above the stop walls 520. Further, the bottom wall 515 is located below the insertion space 53 and the connecting portion 112, and is located in front of the extending sheets 516 and between the two side walls 526. The extending sheets 516 are located between the elevated portion 113 and the stop walls 520. Furthermore, the bottom surfaces of the extending sheets 516 are lower than the bottom wall 515. In the front-rear direction, a width of each of the extending sheets 516 is greater than twice of a width of each of the soldering pins 521, thereby increasing an area of the elevated portion 113 covered by the extending sheets 516, and improving the shielding effect of the interior casing 51. The extending sheets 516 and the soldering pins 521 in a back row are arranged in a same row.

The cushion block 13 is located below the tongue 12 and the connecting portion 112, and in front of the elevated portion 113, thereby playing an effect of raising the connecting portion 112 and the tongue 12, and compensating a height difference between the connecting portion 112 as well as the tongue 12 and the elevated portion 113. Furthermore, the front end surface of the cushion block 13 is further in front of the front end surface of the tongue 12, and is located behind the front edge of the interior casing 51. Preferably, the cushion block 13 is fixed between the two stop walls 520. Specifically, two buckling blocks 133 are respectively formed corresponding to the buckling holes 528 by protruding from two opposite sides of the cushion block 13. The buckling blocks 133 are buckled in the buckling holes 528. Further, a bottom surface of the cushion block 13 is provided with two fastening slots 132 corresponding to the two fastening portions 527. The fastening portions 527 are fastened in the fastening slots 132. Thus, four-point positioning on the cushion block 13 is achieved by virtue of the two buckling holes 528 and the two fastening portions 527, thereby stably fixing the cushion block 13 on the stop walls 520. The cushion block 13 further upward abuts the bottom wall 515 to prevent the cushion block 13 from moving upward. In other embodiments, the cushion block 13 may be only located below the bottom wall 515 without abutting the bottom wall 515, and there is no limitation to the fixing of the cushion block 13 as long as the cushion block 13 can be stably fixed.

The bottom surface of the cushion block 13 protrudes to form four protruding blocks 131. Since the bottom area of each protruding block 131 is far smaller than the area of the bottom surface of the cushion block 13, when the cushion block 13 supports the circuit board 300, only the protruding blocks 131 are in contact with the circuit board 300, so that flatness of a contact surface between the cushion block 13 and the circuit board 300 is convenient to control, and the production difficulty of the cushion block 13 can be reduced. The four protruding blocks 131 are arranged in two rows in the front-rear direction, and include two first protruding blocks 1311 located in a front row and two second protruding blocks 1312 located in a back row. The first protruding blocks 1311 are located in front of the soldering pins 521 in the front row, and the second protruding blocks 1312 are located between the soldering pins 521 in the front row and the back row, thus allowing the heat generated in soldering the soldering portions 22 of the terminals 2 onto the circuit board 300 to be dissipated from a gap between the two second protruding blocks 1312, thereby avoiding overheating of the soldering portions 22, and preventing the terminals 2 from being unfirmly soldered to the circuit board 300. Furthermore, the four protruding blocks 131 are arranged in a distributing manner. When the protruding blocks 131 are supported on the circuit board 300, a supporting force applied to the entire electrical connector 100 is uniform, thus enhancing the overall structural stability. Further, distances from the second protruding blocks 1312 to the soldering pins 521 in one of the two rows and distances from the second protruding blocks 1312 to the soldering pins 521 in the other of the two rows are not equal. In the present embodiment, the distance from the second protruding blocks 1312 to the rear row of soldering pins 521 is apparently smaller than the distance from the second protruding blocks to the front row of soldering pins 521. In other embodiments, the distances from the second protruding blocks 1312 to the two rows of soldering pins 521 are not limited as long as the electrical connector 100 is enabled to be stabilized and balanced. Preferably, areas of bottom surfaces of the two protruding blocks 131 in a same row are equal, and the first protruding blocks 1311 are not connected with the side edge of the bottom surface of the cushion block 13. Furthermore, the first protruding blocks 1311 and the two fastening portions 527 are arranged in a same row.

As shown in FIG. 42 to FIG. 46, the electrical connector 100 is also of a sinking board type, and the tongue 12 and the terminals 2 are all located below the circuit board 300.

In summary, the electrical connector 100 and the electrical connector assembly of the present invention have the following beneficial effects:

(1) The upper shielding sheet 41 has the extending portion 43 covering the base portion 11, so as to increase the coverage range of the inner metal casing 4, and can, when the electrical connector 100 performs high-speed signal transmission, more effectively prevent the electromagnetic radiation in the insertion space 53 from being leaked backward which interferes with the tail of the terminals 2 to cause crosstalk, thereby improving the signal transmission quality of the electrical connector 100.

(2) The middle shielding sheet 3 has the two protruding portions 32 exposed from the two sides of the tongue 12, and the groove 321 is disposed at the protruding portion 32. Because both the middle shielding sheet 3 and the metal elastic sheet 8 are made of a metal material, when the mating connector 200 enters the insertion space 53, the metal elastic sheet 8 and the groove 321 are snap-fit and fixed, which not only can implement stable buckling of the mating connector 200 and the electrical connector 100, but also can prevent the abrasion problem.

(3) The first protruding blocks 131 are located in front of the soldering pins 521 in the front row, and the second protruding blocks 1312 are located between the soldering pins 521 in the front row and the back row, thus allowing the heat generated in soldering the soldering portions 22 of the terminals 2 onto the circuit board 300 to be dissipated from a gap between the two second protruding blocks 1312, thereby avoiding overheating of the soldering portions 22, and preventing the terminals 2 from being unfirmly soldered to the circuit board 300.

Additionally, the protruding portion 32 and the groove 321 extend out of the two sides of the tongue 12 and are located in the insertion space 53, which helps the mating connector 200 enter the insertion space 53 to snap-fit the groove 321, the snap-fit strength is large, and the mating connector 200 is not easily disengaged.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulation body, having a base portion and a tongue located at a front end of the base portion;

a plurality of terminals, fixedly disposed on the base portion and partially exposed from the surface of the tongue;

an outer metal casing, surrounding the base portion and the tongue and forming an insertion space receiving the tongue, wherein the outer metal casing has a bottom wall located below the insertion space and two side walls located at two opposite sides of the bottom wall, the two side walls respectively extend downward to form two stop walls located below the bottom wall, and the two stop walls extends downward to form four soldering pins, wherein two of the four soldering pins are formed on each of the two stop walls, and the four soldering pins are arranged in two rows in a front-rear direction; and a cushion block, located below the bottom wall and fixedly disposed on the two stop walls, wherein four protruding blocks are formed by protruding downward from a bottom surface of the cushion block, and at least two of the four protruding blocks are located between the soldering pins in the two rows.

2. The electrical connector according to claim 1, wherein the four protruding blocks are arranged in two rows in the front-rear direction, and comprise two first protruding blocks located in a front row and two second protruding blocks located in a back row, and wherein the second protruding blocks are located between the soldering pins in the two rows.

3. The electrical connector according to claim 2, wherein distances from the second protruding blocks to the soldering pins in one of the two rows and distances from the second protruding blocks to the soldering pins in the other of the two rows are not equal.

4. The electrical connector according to claim 2, wherein areas of bottom surfaces of the two protruding blocks in a same row are equal, and the first protruding blocks are not connected with a side edge of the bottom surface of the cushion block.

5. The electrical connector according to claim 2, wherein the two stop walls are respectively provided with two fastening portions for fastening the cushion block, and the two fastening portions are located in front of the soldering pins in a front row.

6. The electrical connector according to claim 5, wherein the two fastening portions and the first protruding blocks are arranged in a same row in the front-rear direction.

7. The electrical connector according to claim 1, wherein two opposite sides of the cushion block respectively protrude to form two buckling blocks, each of the two stop walls is provided with a buckling hole corresponding to and fastened to one of the two buckling blocks, and on a same stop wall, the fastening hole is located between upward extending lines of the two soldering pins.

8. The electrical connector according to claim 1, wherein a front end surface of the cushion block is in front of a front end surface of the tongue.

9. The electrical connector according to claim 1, wherein the base portion comprises a connecting portion formed by extending backward from the tongue and a elevated portion formed by extending backward from the connecting portion, a bottom surface of the elevated portion is lower than a bottom surface of the connecting portion, and the cushion block is located right below the connecting portion and the tongue and in front of the elevated portion.

10. The electrical connector according to claim 9, wherein each of the terminals has a soldering portion extending out of the bottom surface of the elevated portion, and the soldering portions of the terminals are arranged in a row, wherein the soldering portion is soldered onto an upper surface of a circuit board, and is located behind the protruding blocks and behind the soldering pins in a back row.

11. The electrical connector according to claim 10, wherein the bottom surface of the elevated portion protrudes downward to form two symmetric positioning posts, and the positioning posts are located in front of the soldering portion and behind the soldering pins in the back row.

12. The electrical connector according to claim 9, wherein the outer metal casing has a rear wall located behind the elevated portion, a lower edge of the rear wall extends downward to form at least one supporting leg located on a circuit board, and the at least one supporting leg is located behind the soldering portions.

13. The electrical connector according to claim 1, wherein the outer metal casing has an interior casing and a shielding casing, the interior casing surrounds peripheries of the tongue and the base portion to form the insertion space, the shielding casing wraps the interior casing and the cushion block, and the side walls are arranged at the shielding casing.

14. The electrical connector according to claim 13, wherein the bottom wall is arranged on the interior casing, and a distance between the bottom wall and the cushion block is smaller than a distance between the bottom wall and the tongue.

15. The electrical connector according to claim 14, wherein the cushion block upward abuts the bottom wall.

16. The electrical connector according to claim 14, wherein two opposite sides of the interior casing respectively extend to form two extending sheets, bottom surfaces of the extending sheets are lower than the bottom wall, and the extending sheets are behind the four protruding blocks.

17. The electrical connector according to claim 16, wherein the base portion comprises a connecting portion formed by extending backward from the tongue and an elevated portion formed by extending backward from the connecting portion, and the extending sheets are located between the stop walls and the elevated portion.

18. The electrical connector according to claim 16, wherein the extending sheets and the soldering pins in a back row are arranged in a same row.

19. The electrical connector according to claim 16, wherein a width of each of the extending sheets is greater than twice of a width of each of the soldering pins in the front-rear direction.

20. The electrical connector according to claim 13, wherein a front end surface of the cushion block is located behind a front edge of the interior casing.

* * * * *